US008858112B2

(12) United States Patent
Wallace et al.

(10) Patent No.: US 8,858,112 B2
(45) Date of Patent: Oct. 14, 2014

(54) ROAD BARRIER

(75) Inventors: Hayden Wallace, Loftus (AU); Terry Colquhoun, Minto (AU); Henry John Hare, Christchurch (NZ); Mark Whiteside, Christchurch (NZ)

(73) Assignee: Industrial Galvanizers Corporation Pty Ltd, Minto, New South Wales (AU)

( * ) Notice: Subject to any disclaimer, the term of this patent is extended or adjusted under 35 U.S.C. 154(b) by 0 days.

(21) Appl. No.: 13/256,661

(22) PCT Filed: Mar. 19, 2010

(86) PCT No.: PCT/AU2010/000321

§ 371 (c)(1),
(2), (4) Date: Sep. 15, 2011

(87) PCT Pub. No.: WO2010/105307

PCT Pub. Date: Sep. 23, 2010

(65) Prior Publication Data

US 2012/0003039 A1 Jan. 5, 2012

(30) Foreign Application Priority Data

| | | |
|---|---|---|
| Mar. 19, 2009 | (AU) | 2009901186 |
| Apr. 17, 2009 | (AU) | 2009901658 |
| Jun. 11, 2009 | (AU) | 2009902697 |
| Nov. 13, 2009 | (AU) | 2009905565 |

(51) Int. Cl.

| | |
|---|---|
| ***E01F 15/00*** | (2006.01) |
| ***E01F 15/08*** | (2006.01) |
| ***E01F 15/04*** | (2006.01) |
| ***E01F 13/12*** | (2006.01) |

(52) U.S. Cl.
CPC ..... *E01F 15/0423* (2013.01); *E01F 15/088* (2013.01); *E01F 13/12* (2013.01)
USPC ..... 404/6; 404/9; 256/13.1

(58) Field of Classification Search
CPC ..... E01F 13/12; E01F 15/0423; E01F 15/088
USPC ..... 404/6, 9–10; 256/1, 13.1
See application file for complete search history.

(56) References Cited

U.S. PATENT DOCUMENTS 2,025,014 A * 12/1935 Brickman et al. ..... 256/13.1
2,520,313 A * 8/1950 Harris ..... 256/22

(Continued)

FOREIGN PATENT DOCUMENTS

| | | |
|---|---|---|
| DE | 3640821 C1 | 3/1988 |
| EP | 0307796 A1 | 3/1989 |
| EP | 0554864 A1 | 8/1993 |

OTHER PUBLICATIONS

Australian Patent Office, International Search Report for International Application No. PCT/AU2010/0000321, dated Jun. 30, 2010.

(Continued)

*Primary Examiner* — Raymond W Addie
(74) *Attorney, Agent, or Firm* — Cahn & Samuels, LLP

(57) ABSTRACT

The present invention provides a roadway barrier or guard rail system which has a post (12) which passes through the carriage (20) with the carriage (20) being free to move up along the post (12). The carriage (20) is prevented from moving down the post (12) by means of a stop or restraint (12.60, 12.50,12.40,12.30) which is separate from and underneath the carriage (20) and which the carriage (20) abuts, with the stop or restraint (12.60,12.50,12.40,12.30) being located on the post (12). The carriage (20) is not otherwise restrained from moving up the post except by the curved channels through the carriage (20) which engage the extremities of the post, and the friction this may produce. Further systems are provided with the same features but additionally additional frictional or other forces such as shearing forces, produced by means of formations or fixtures to the post or the carriage which must be overcome after the carriage starts moving relative to the post, such as restraints or stops on the post above the carriage. In other embodiments additional frictional or shear forces must be overcome before movement between the carriage (20) and the post (12) will occur. The movement of the carriage (2) on the post (12) is guided by formations on the carriage (20) cooperating with the mating formations on the post (12).

32 Claims, 35 Drawing Sheets

(56) References Cited

U.S. PATENT DOCUMENTS

| | | | | | |
|---|---|---|---|---|---|
| 3,214,142 | A | * | 10/1965 | Brown | 256/13.1 |
| 3,493,213 | A | * | 2/1970 | Ackerman | 256/13.1 |
| 3,617,076 | A | * | 11/1971 | Attwood et al. | 403/395 |
| 5,188,342 | A | * | 2/1993 | Ouellette et al. | 256/65.08 |
| 5,219,241 | A | * | 6/1993 | Picton | 404/6 |
| 5,657,966 | A | * | 8/1997 | Cicinnati | 256/13.1 |
| 5,660,375 | A | | 8/1997 | Freeman | |
| 6,007,269 | A | * | 12/1999 | Marinelli | 404/6 |
| 6,036,399 | A | * | 3/2000 | Schalk | 404/6 |
| 6,168,346 | B1 | * | 1/2001 | Ernsberger | 404/6 |
| 6,575,656 | B2 | * | 6/2003 | Suh | 403/109.6 |
| 6,644,888 | B2 | * | 11/2003 | Ochoa | 404/6 |
| 7,478,796 | B2 | * | 1/2009 | Burkett | 256/13.1 |
| 7,832,713 | B2 | * | 11/2010 | King | 256/13.1 |
| 7,980,519 | B2 | * | 7/2011 | Chen | 248/125.8 |
| 2002/0053664 | A1 | * | 5/2002 | Moore | 256/13.1 |
| 2007/0003361 | A1 | * | 1/2007 | Wang | 403/109.3 |
| 2009/0050863 | A1 | | 2/2009 | Conway et al. | |

OTHER PUBLICATIONS

Australian Patent Office, Written Opinion for International Application No. PCT/AU2010/0000321, dated Jun. 30, 2010.
Espacenet, English abstract for EP0307796A1, Mar. 22, 1989.
Espacenet, English abstract for EP0554864A1, Aug. 11, 1993.
Espacenet, English abstract for DE3640821C1, Mar. 24, 1988.

* cited by examiner

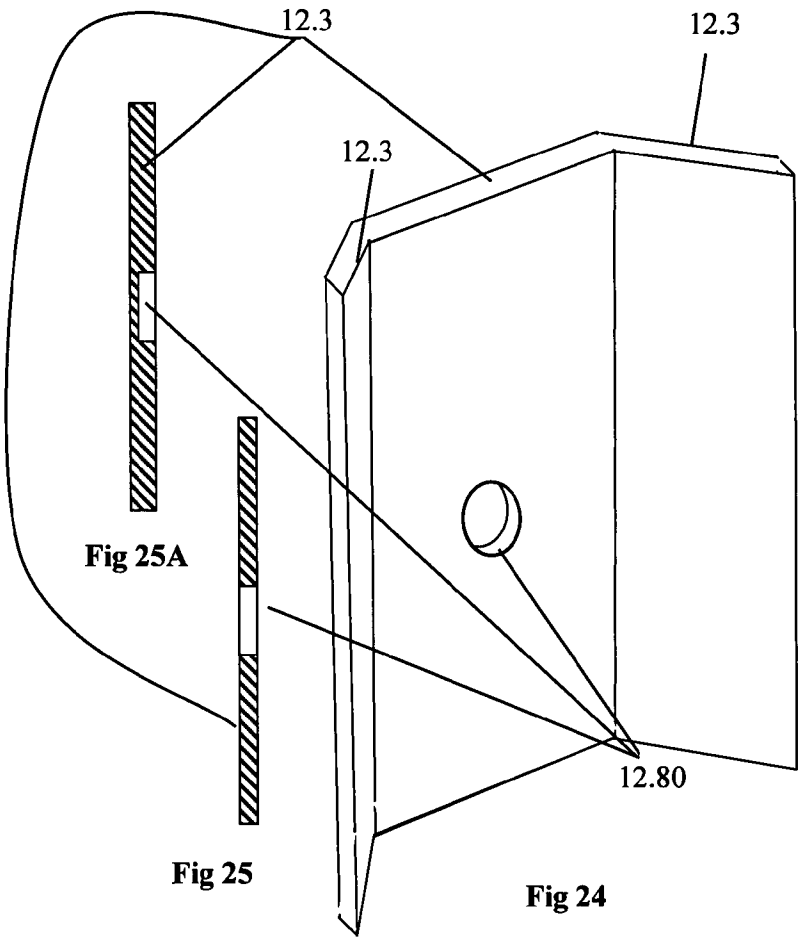
Fig 24
Fig 25
Fig 25A
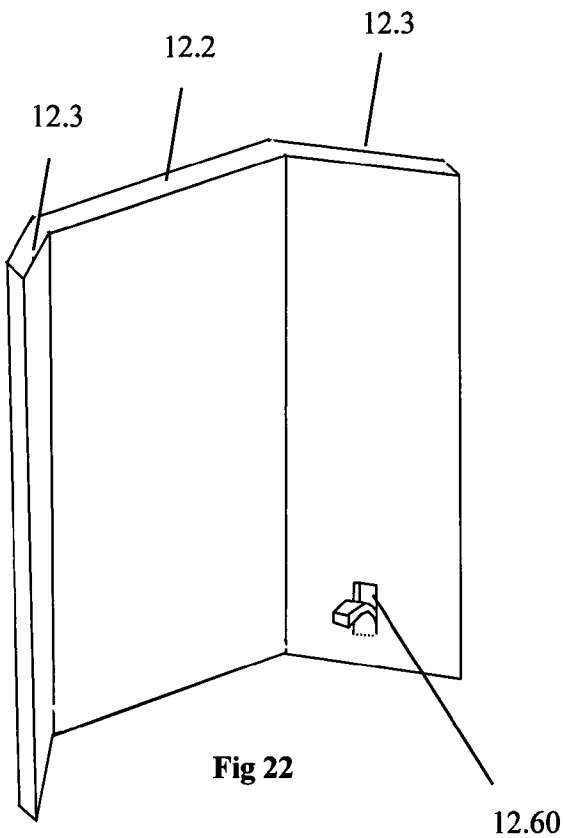
Fig 22
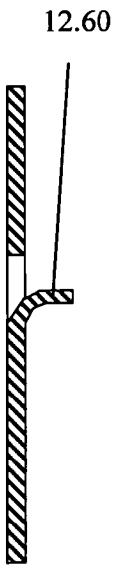
Fig 23

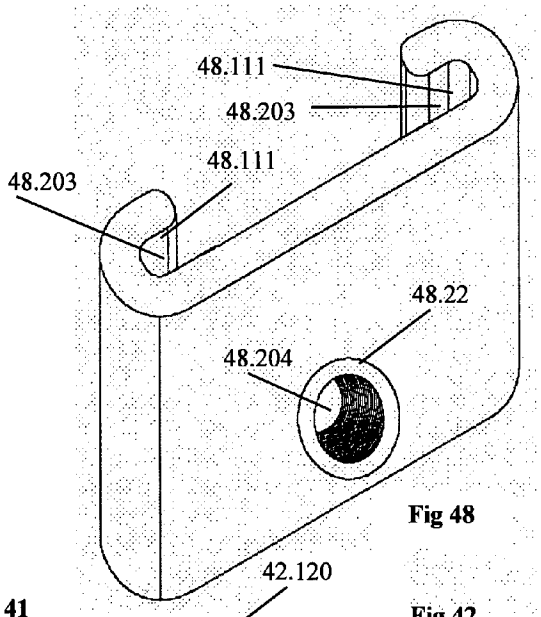
Fig 48
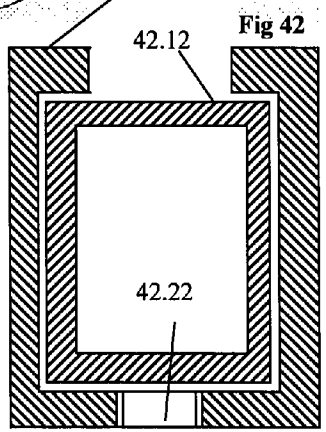
Fig 42
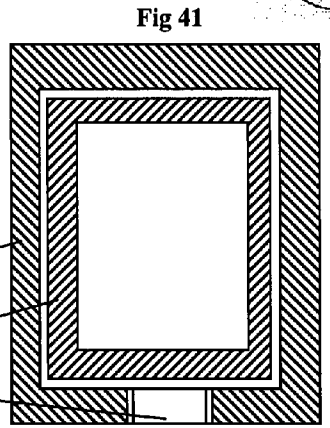
Fig 41
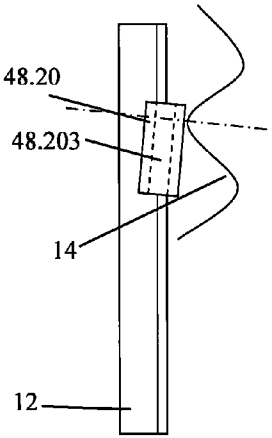
Fig 51
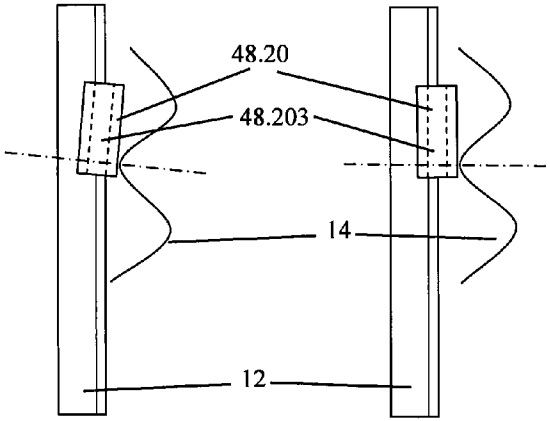
Fig 50
Fig 49
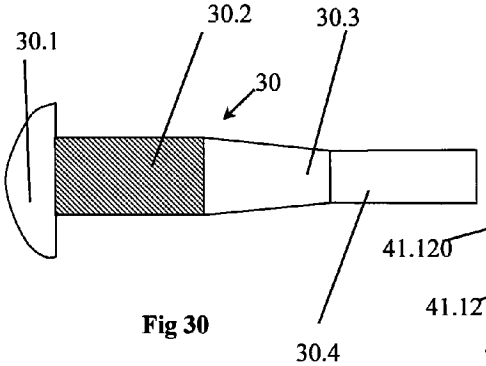
Fig 30

78.13
78.13
78.12
78.14
78.20

75.13
75.13
75.12
75.20
75.14

77.14
77.30
77.13
77.20
77.12

76.14
72.20
72.30
76.13
76.12

82.14
82.221
82.732
82.12
82.20

79.12
79.221
79.20
79.732
79.730
79.733
79.14

81.730
81.14
81.30
81.20
81.12

80.14
80.20
80.30
80.730
80.732
80.12

90.12
90.14
90.20

87.12
87.201
87.202
87.20
87.30
87.14

89.14
89.30
89.20
89.201
81.12

88.14
88.20
88.30
88.201
88.12

102.111
102.119

103,1191
103.20
103.113
103.111

A2
B2
C2
104.113
104.204
104.113
104.119

105.12
105.113
105.20

106.12
106.113
106.20

107.12
107.113
107.20

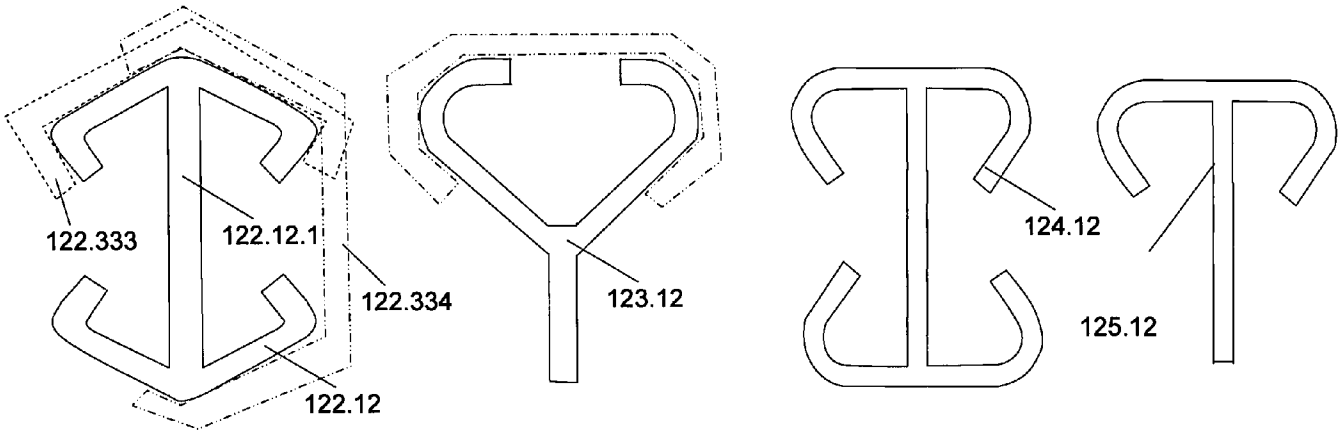
FIG 122
FIG 123
FIG 124
FIG 125
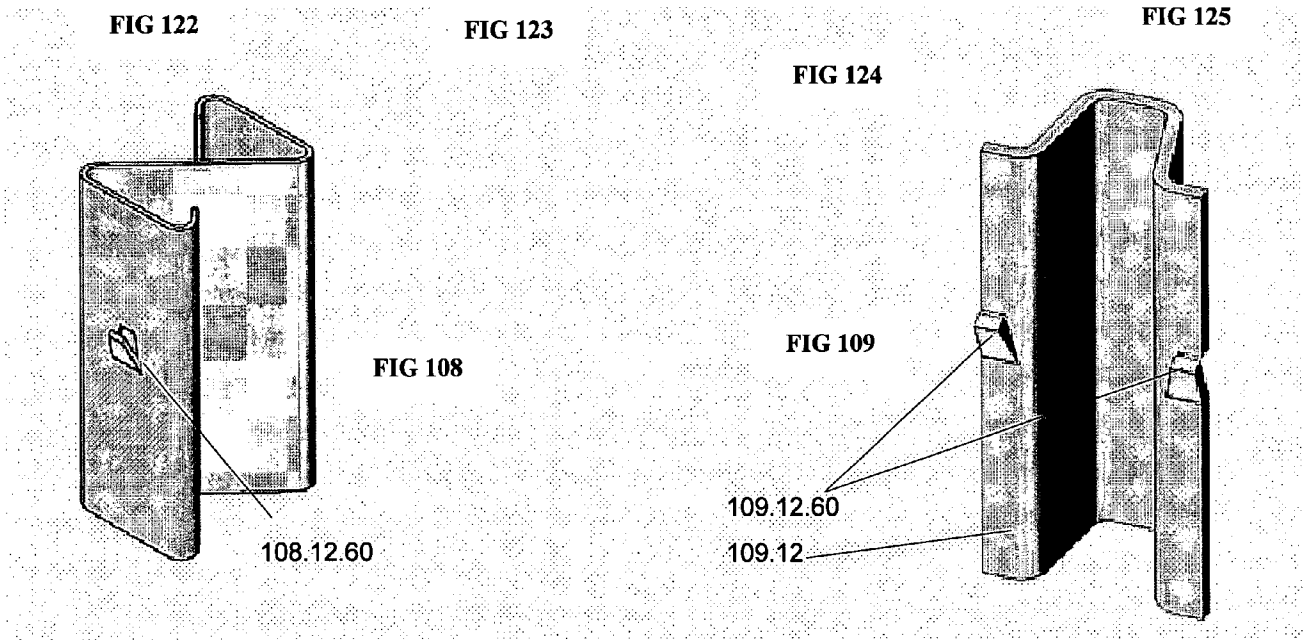
FIG 108
FIG 109

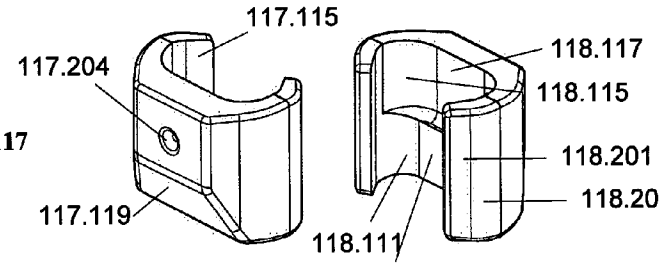
FIG 117
FIG 118
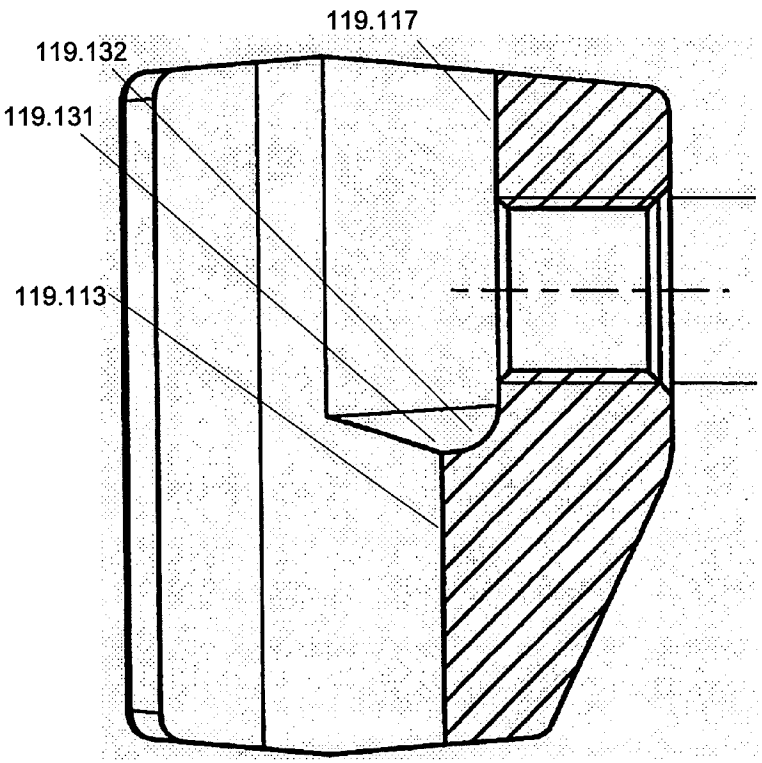
FIG 119
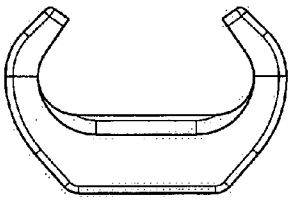
FIG 116
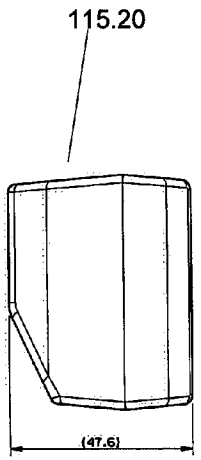
FIG 115
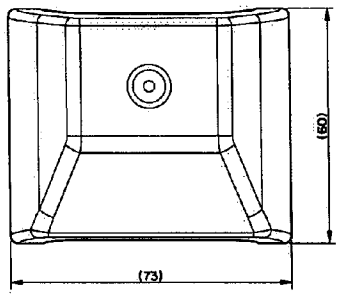
FIG 114

ROAD BARRIER

This application is the National Stage of International Application No. PCT/AU 2010/000321, filed on Mar. 19, 2010, which claimed the benefit of Australian Application No. 2009901186 filed Mar. 19, 2009, Australian Application No. 2009901658 filed Apr. 17, 2009, Australian Application No. 2009902697 filed June 11, 2009, and Australian Application No. 2009905565 filed Nov. 13, 2009, which are hereby incorporated by reference. The International Application No. PCT/AU2010/000321 was published on Sep. 23, 2010.

FIELD OF THE INVENTION

The present invention relates to roadway barrier or guard rail systems and post and rail mounting arrangements related to those barriers or systems.

BACKGROUND OF THE INVENTION

The construction of guard rail systems has been the subject of many developments over many years. It has been desired to develop a system which provides an improved or alternative guard rail system.

Any reference herein to known prior art does not, unless the contrary indication appears, constitute an admission that such prior art is commonly known by those skilled in the art to which the invention relates, at the priority date of this application.

SUMMARY OF THE INVENTION

The present invention provides a roadway barrier or guard rail system having a post and beam construction wherein said beam is mounted to said post by means of an intervening carriage said carriage adapted to slide relative to said post in the event of a collision, said carriage engaging at least a portion of the outer and or inner periphery of said post to enable sliding movement of said carriage relative to said post.

The post can be of any appropriate cross-section including C section, Charlie post, O-post, open hat cross-section, Z-Post or section, square hollow section, round hollow section, I post or section, H shaped post or section.

Engagement of the carriage with the post can entail the partial or complete cross-sectional envelopment of the post by the carriage.

The engagement of the post by the carriage can include the bridging of free ends or edges of the post by the carriage member.

Inter-engagement or engagement of the free ends or edges of the post with the carriage can be provided. This allows the carriage to move or slide along the longitudinal direction of the post.

Movement between the carriage and the post can occur due to forces of sufficient magnitude being applied during assembly or before securement or after assembly or during collision.

The carriage can include means to releasably secure the carriage to the post when the roadway barrier or guard rail system is assembled.

The carriage or the post can include means to make frictional contact between the carriage and the post.

The carriage or the post can include means to make frangible contact between the carriage and the post.

The post or the carriage can include means to control the amount of force required to disconnect or allow the carriage to move relative to the post.

The means to control the amount of force required to disconnect or allow the carriage to move relative to the post can include one or more than one of the following: securing means of the carriage relative to the post; a welded member attached to the post; a bolt through the post; a cap at the top of the post having engagement with the post; a cap and bolt at the top of the post; a frangible bolt between the carriage and the post; a bolt through the carriage to engage the post; a bolt through the carriage to engage a depression or recess in the post; convex formations on the post to engage the carriage; a bolt passing through the carriage and the beam and the post, whether with or without the use of a nut; crimping of the carriage to the post at predetermined locations; a yielding hanger connecting said carriage and said post; said post includes along one or more surfaces thereof which will engage said carriage as it moves along said post one or more of the following: ramp formations, depressible ramp formations, biased ramp formations; yielding ramp formations; cantilevered ramp formations.

The outer periphery of a hollow section post or a portion of the periphery of a post having free ends or edges can be used to guide the carriage relative to the post and constrain the movement of the carriage relative to the post.

A W-cross-section beam can utilize a single carriage to connect to the post.

A three crest two trough beam can utilize: a single carriage with one of the troughs to mount the beam to the post; a single carriage via an upper trough to mount the beam to the post via the carriage; a single carriage via a lower trough to mount the beam to the post via the carriage; a carriage at both troughs to mount the beam to the post; a single carriage that extends at least across both troughs to mount the beam to the post.

The carriage can be made from polymeric material, cast iron, cast steel or steel and manufactured by any appropriate means including fabrication or casting.

Frictional control means can be provided. The frictional control means can be one or more of the following: crimping said carriage to said post in order to control the amount of force required or the amount of force to cause disconnection between said carriage and said post during a collision; the carriage has a shape which assists in the generation of frictional forces; the carriage includes surfaces at a lower portion of the carriage to contact said post which are offset from upper surfaces which do not contact said post prior to collision; the carriage has an angled passage through it for parts of said post to pass through; said post includes along one or more surfaces thereof which will engage said carriage as it moves along said post one or more of the following: ramp formations, depressible ramp formations, biased ramp formations; yielding ramp formations; cantilevered ramp formations.

During a collision as the carriage travels along the post, increasing resistance to movement can be encountered by the carriage relative to the post, or a decreasing resistance to movement is encountered by the carriage as it moves up the post.

The downward movement of the carriage relative to the post can be limited by detents associated with the post engaging a portion of the carriage.

The carriage can include threaded inserts or threaded portions for a bolt to engage in order that the bolt secures the beam to the carriage.

Multiple resistances to movement of the carriage relative to the post can be located along the post.

Bolts utilized to engage the beam to the carriage also engage a portion of the post.

Bolts used to secure a beam to the carriage can include a turned down or narrower or unthreaded section with the threaded section being located at or near the head end of the bolt.

The post can either hot rolled or cold formed.

The carriage can also assist with the post maintaining its cross section.

The carriage can be associated with, or is a part of, or cooperates with, a blocking piece to offset said rail from said post.

The carriage can be captured by or able to slide in the blocking piece.

The blocking piece and the carriage can be integrally formed.

The blocking piece and the carriage can be separate from each other.

The carriage and the blocking piece, whether as a singe piece or as two separate pieces, can form a clamping arrangement to clamp the rail, the blocking piece and the carriage, or a combined blocking piece and carriage, to the post or flanges of the post.

The carriage can have a longitudinal or axial channel therein to cooperate with at least a portion of the outer periphery of the post to enable sliding movement of the carriage relative to the post under predetermined conditions.

There can also be a cap surface lateral thereto to engage an upper extremity of the post.

A mounting aperture can be located at a predetermined distance away from the cap surface or the lower most edge of the carriage.

The carriage can have an axial, height or length dimension which is greater than the width of the carriage or the post. The axial, height or length dimension can be of the order of 200 mm to 600 mm.

The carriage can have a landing formation or an offset mounting surface through which a mounting aperture passes, said landing formation or an offset mounting surface spacing an edge of said beam away from one or both of said post or said carriage.

The carriage can have a series or an array of mounting apertures therein along a height or length dimension of the carriage.

The carriage can include a blocking piece formation which extends in two directions away from a centerline of the carriage, enabling a dual barrier to be assembled.

A channel or aperture of the carriage which receives the post, is si 'Z' to provide enough space to allow a longitudinal axis of the carriage to be at an angle to the longitudinal axis of the post when the carriage engages the post, which will determine an angle which the beam will be oriented relative to the post.

The angle at which the beam is oriented relative to the post can be secured or adjusted by means of a mounting bolt engaging the post.

The carriage can include a cap portion, which will allow the carriage to be slid onto a post, whereby the cap portion limiting the movement of the carriage with respect to the post.

The cap portion can be integrally formed with the carriage.

The cap portion can be formed separately from the carriage and attaches to the carriage.

The cap portion can interlock with the carriage.

There can be connected between the carriage and the post a hanger means which engages a portion of the post and the carriage.

The hanger means can be yieldable in the event of a collision.

The hanger means can engage one or more than one of the following: an upper edge of the post; an aperture in the post; a side edge of the post.

The hanger can include a section having a gathered formation, the gathered formation being able to run out or stretch out in the event of a collision.

The hanger can includes a hook means to engage the post.

The hanger can include means to clamp the carriage to the hanger.

The cap if used can include hook means to engage apertures in the post.

The carriage can have the ability to be crimped to said post on one or more sides of the carriage.

The present invention also provides a roadway barrier or guard rail system having a post and beam construction wherein the beam is adapted to slide relative to the post in the event of a collision, the beam engaging a portion of the post, whereby the portion is clamped between at least the beam and securing member so that the beam and member are secured to the post, to enable a sliding movement of the beam relative to the post during a collision.

The portion can be an open portion of the post, the open portion including two free ends or curved surfaces that are spaced from each other, wherein the beam is secured to the member at a part where the member spans the space between the free ends or curved surfaces.

The sliding movement can be confined by the direction of extension along said post of the two free ends or curved surfaces.

The roadway barrier or guard rail system can also include a bolt which passes through the beam and is received by a threaded hole in the member.

The threaded hole can be a blind hole.

The bolt can pass through a washer located between the beam and the member.

The washer can be made of a polymeric material to influence the friction developed.

The member can have an external shape which matches, at least partially, the internal shape of the post, such as a rectangular shape.

The member can reach a back portion of the post.

The member can fill an internal space of the post.

Relative movement can occur between the post and carriage when a clamping force between at least the plate and the inner periphery is overcome.

There can be included a friction means for providing additional friction against the sliding movement.

The friction means can include a bolt that passes through the beam and reaches an inner surface of the post.

The inner surface can include a recess that is formed in the post.

The present invention also provides a post for a roadway barrier or guard rail system, said post including a pair of opposed convex curved surfaces extending along at least an upper portion of said post, to serve a track function for a carriage to which a beam can be assembled, to enable said carriage to slide along said post, when a carriage is assembled with said post.

The pair of opposed curved surfaces are formed by two opposed flanges.

The flanges include free ends or edges, and wherein the free ends or edges of the post angle toward a mid-section of the post.

The post can have a cross section the same as or similar to one of the following: a generally Z-shaped cross section; a generally Y-shaped cross section; a generally I-shaped cross section; a generally T-shaped cross section; a generally H shaped cross section where the flanges are in a generally chevron shape.

The free ends or edges can extend toward a mid-section of the post by an amount which is of the order of 10% to 40% of the width to the post as measured at the inboard or outboard (with respect to the post orientation when in use) sides of the post.

The free ends or edges can be at approximately the same angle to inboard or outboard (with respect to the post orientation when in use) sides of the post, as the inboard or outboard (with respect to the post orientation when in use) sides of the post are to the mid-section of the post.

The angle between the mid-section and inboard or outboard (with respect to the post orientation when in use) sides of the post can be in the range of 50 to 60 degrees.

The post can be formed from sheet material of a thickness in the range of 4 to 6 mm.

An internal radius in the range of 5 to 20 mm can be formed between the free ends or edges and inboard or outboard (with respect to the post orientation when in use) sides of the post, or can be formed between inboard or outboard (with respect to the post orientation when in use) sides of the post and the mid-section.

A base plate and support post can be used to mount the Z-shaped post described above to structures by means of bolting, with the support post being oriented at substantially the same angle that the mid-section of said post is with respect to either the free ends or edges of the Z-shaped post or the inboard or outboard (with respect to the Z-shape post orientation when in use) sides of the Z-shaped post is with respect to its free ends or edges.

The present invention also provides a carriage for use with a roadway barrier or guard rail system which has a post and beam construction wherein said beam is mounted to said post by means of said carriage, said carriage being adapted to slide relative to said post in the event of a collision, said carriage including engagement means to engage at least a portion of the outer and or inner periphery of said post to enable sliding movement of said carriage relative to said post.

The engagement means can interact with said post to provide guided sliding movement to said carriage.

The carriage can partially or completely envelop at least a portion of the cross-section of the post.

The carriage can include means to releasably secure the carriage to the post when assembled.

The carriage can include means to make frictional contact between the carriage and the post.

The carriage can be made from polymeric material, cast iron, cast steel or steel and manufactured by any appropriate processing including fabrication or casting.

The carriage can include threaded inserts or threaded portions for a bolt to engage in order that the bolt secures said beam to said carriage. The bolts utilized to assemble said beam to said carriage also engage a portion of said post.

The carriage can include a longitudinal or axial channel therein to cooperate with at least a portion of the outer periphery of said post to enable sliding movement of said carriage relative to said post.

The carriage can have a landing formation or an offset mounting surface and a mounting aperture passing through said landing formation or an offset mounting surface thereby spacing an edge of said beam away from one or both of said post or said carriage.

The carriage can be such that channel or aperture of said carriage which receives said post, is sized to provide enough space to allow a longitudinal axis of the carriage to be at an angle to the longitudinal axis of said post, which will determine an angle which the beam will be oriented relative to the post.

The carriage can include two opposed concave curved surfaces to receive curved surfaces of said post.

The carriage can include inboard upper and lower portions, wherein said upper and lower portions are offset from each other. The lower portion can be offset from said upper portion so as to make contact in use with said post.

Between the upper and lower portion can be an edge, which can include a radiused portion.

Between the upper and lower portion there exists a 90 degree corner.

The present invention also provides a roadway barrier or guard rail system having a post and beam construction wherein the beam is mounted to the post by means of an intervening carriage, wherein the post passes through the carriage, with the carriage being free, to move up along the post, and wherein the carriage and or said beam is prevented from moving down the post by means of a stop or restraint, which is separate from and underneath the carriage and which the carriage or said beam abuts, the stop or restraint being located on the post.

The present invention further provides a method of constructing a roadway barrier or guard rail system including the following steps in no particular order:

a) inserting posts into ground in a desired position to an appropriate depth;

b) assembling a respective carriage onto each of the posts, the carriage being free to slide relative to the post before a collision occurs, the carriage engaging at least a portion of the outer and or inner periphery of the post to enable sliding movement of the carriage relative to the post, the carriage coming to rest on the post when the carriage abuts the restraint;

c) securing the beam to the carriage by a securement means in such a manner that the securement means does not contact or engage the post.

The method can be such that step (a) is performed by pile driving the post into the ground, to an appropriate depth in the range of 500 mm to 900 mm.

The post can have a Z configuration in cross section.

The spacing between posts can be 2 meters.

The restraint can be located of the order of 180 to 230 mm, below the upper terminus of the posts.

The restraint can be located at a height down from the upper terminus of the post, so that once a beam or rail is assembled to said carriage, the top edge of the beam or rail is at a regulation or desired height, and approximately 10 to 30 mm of the post protrudes above said upper edge of said beam or rail.

The steps of the method can be performed in the following order: (a),(b),(c); or (a),(c),(b); or (b),(a),(c); or (b),(c),(a); or (c),(a),(b); or (c),(b),(a).

Another step can be added to the method: providing a restraint on the posts at a location below the upper terminus of the post prior to assembly or during assembly.

BRIEF DESCRIPTION OF THE DRAWINGS

An embodiment or embodiments of the present invention will now be described, by way of example only, with reference to the accompanying drawings, in which:

FIG. 22 illustrates an alternative mechanism to that of FIGS. 16 to 18 to set the height of a carriage member on a post;

FIG. 23 illustrates a cross-section through the bent tab of FIG. 22;

FIG. 24 illustrates an alternative to the depression of FIG. 19 which acts to set the height of a carriage member relative to a post by locating the bolt or a portion of the bolt therein;

FIG. 25 illustrates a portion of the cross-section through FIG. 24;

FIG. 25A illustrates a portion of the cross-section through FIG. 24 where the aperture 12.80 is a blind aperture;

FIG. 30 illustrates a bolt for use with present invention;

FIG. 41 illustrates schematic cross section of a carriage mechanism for use with a Square or Rectangular hollow section post;

FIG. 42 illustrates a schematic cross section of an alternative carriage mechanism for use with a Square or Rectangular hollow section post;

FIG. 48 is a perspective view similar to the carriage of FIG. 46;

FIG. 49 illustrates as schematic of the carriage of FIG. 48 assembled with a post, showing orientation when a short bolt is used;

FIG. 50 illustrates the schematic of FIG. 49, when a long bolt is used;

FIG. 51 illustrates a schematic of the carriage of FIG. 48 assembled with bolt hole at the top, showing orientation when a short bolt is used;

FIG. 52 illustrates a perspective view of a fully enveloping cap and carriage;

FIG. 53 illustrates a perspective view of a combination cap, carriage and two direction blocking piece;

FIG. 54 illustrates a combination cap and carriage which will engage the top of the post and the flanges only when deployed;

FIG. 55 illustrates a perspective view of a combination cap and carriage similar to the carriage of FIG. 52, including a landing formation for the mounting aperture to pass through;

FIG. 56 illustrates a schematic side view similar to FIGS. 49 to 51, showing the carriage of FIG. 55 assembled with a beam and post;

FIG. 108 is a perspective view of a Z-post with punched tag;

FIG. 109 is a perspective view of an open hat post with punched tags on its inboard flanges;

FIG. 114 is a front view of a casting of a carriage of a preferred embodiment;

FIG. 115 is a right side elevation of the carriage of FIG. 114;

FIG. 116 is a plan view of the carriage of FIG. 114;

FIG. 117 is a front perspective view of the carriage of FIG. 114;

FIG. 118 is a rear perspective view of the carriage for FIG. 114;

FIG. 119 is a centre vertical plane cross section through the carriage of FIG. 114;

FIG. 120 is a plan view of a base plate and post support for use with the post of FIG. 113;

FIG. 121 is a side elevation of the base plate and post support of FIG. 120;

FIG. 122 is a cross section or a plan view of another post;

FIG. 123 is a cross section or a plan view of a further post;

FIG. 124 is a cross section or a plan view of another post;

FIG. 125 is a cross section or a plan view of a further post;

FIG. 126 illustrates a rear perspective view of further post, carriage and beam;

FIG. 127 illustrates a side view of a guard rail system similar to FIG. 126; and FIG. 128 illustrates a side view of a guard rail system similar to FIG. 127

Figures 120, 121, 126, 127, 128:
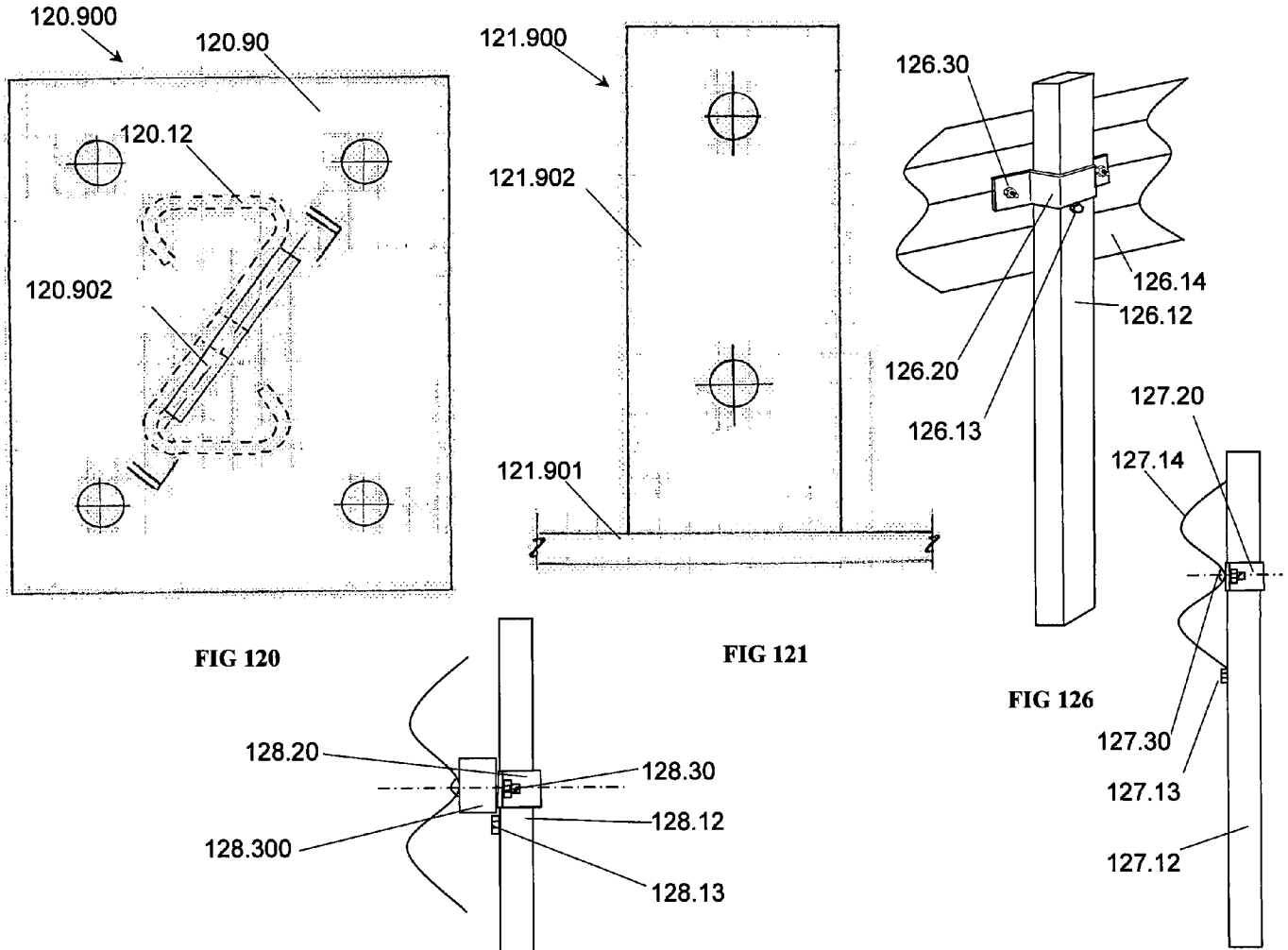

The numbering convention used in respect of FIGS. 30 to 128 of the drawings is that the digits in front of the full stop indicate the drawing number, and the digits after the full stop are the element reference numbers. Where possible, the same element reference number is used in different drawings to indicate corresponding elements, and numbered elements which appear in FIGS. 1 to 29, are used to label like features in FIG. 30 to 128.

DETAILED DESCRIPTION OF THE EMBODIMENT OR EMBODIMENTS

Figures 1, 2:
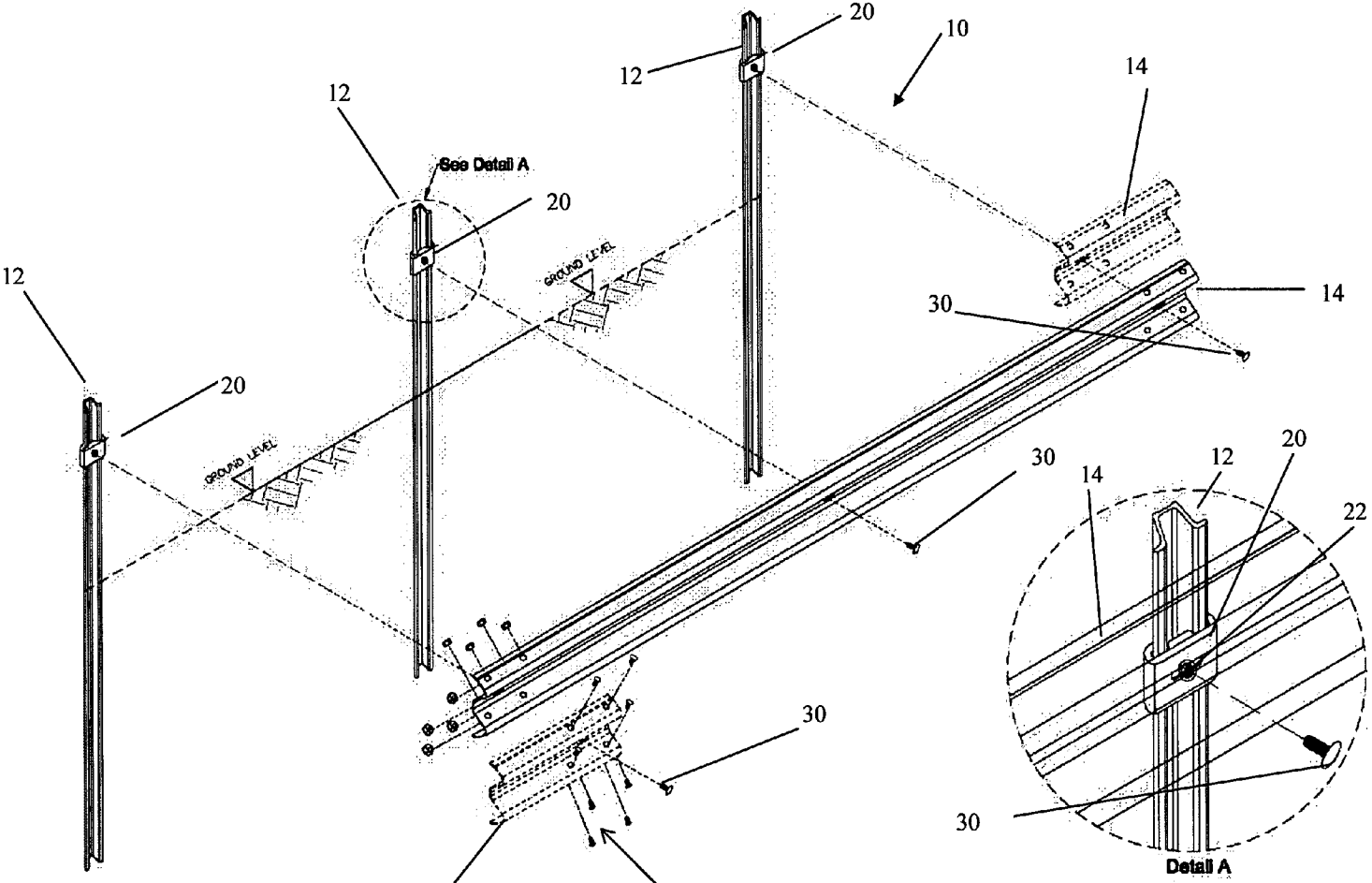
FIG. 1 illustrates an exploded perspective view of a guard rail assembly.
FIG. 2 illustrates a detail perspective view of a part of FIG. 1.

Illustrated in FIG. 1 is a roadway barrier or guard rail system 10 constructed from a series of posts 12, of which 3 are illustrated so as to span a length of guard rail or beam 14, which is in this instance a W-beam.

On the left side of FIG. 1, at an end 14.1 of the beam 14, there is shown details of the splicing of an overlapping beam 14 of which only the right side is viewable. On the right side of FIG. 1 another overlapping beam 14 is illustrated but of which only the left side is viewable. The overlapping occurs in the direction of traffic whereby in the direction of traffic the upstream beam is located on the outside and overlaps the next downstream beam 14, as is generally known in the art, and complies with governmental regulations governing the installation of such roadway barrier or guard rail systems.

As is more clearly visible in FIG. 2 the post 12 is an open hat cross-section post onto which has been slideably engaged a carriage 20, which in this instance slideably engages the free ends or edges of the post 12.

Carriage 20 includes a threaded portion 22 into which can be received a threaded bolt 30 for securing a W-beam 14 to the carriage 20.

Figure 5:
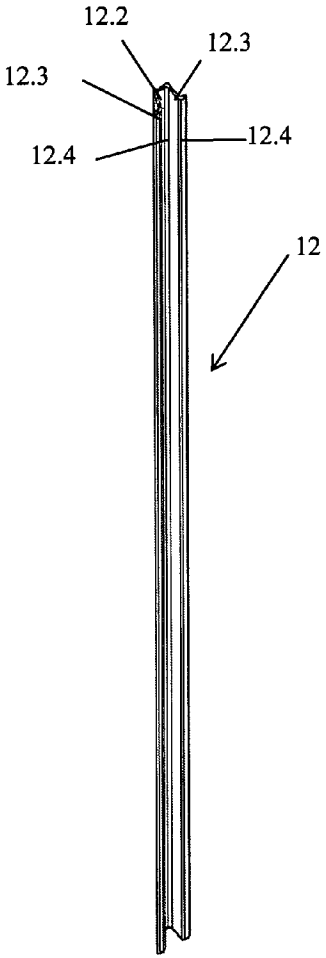
FIG. 5 illustrates a perspective view of the post of FIGS. 3 and 4.
Figure 4:
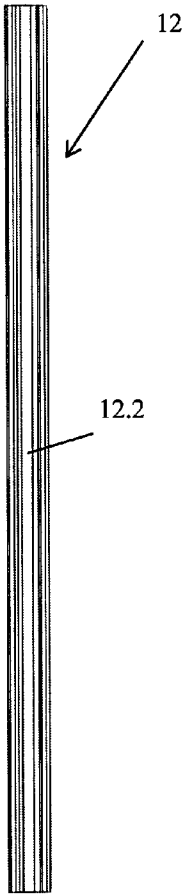
FIG. 4 illustrates a side view of the post of FIG. 3.
Figure 3:
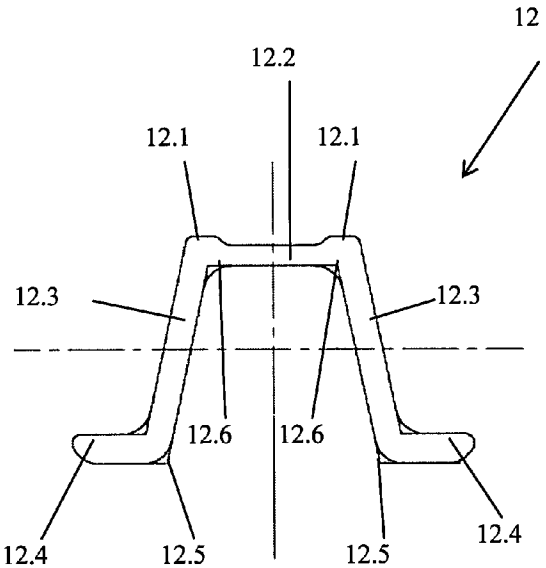
FIG. 3 illustrates a cross section of a post, manufactured either by hot rolling or cold rolling.

Illustrated in FIGS. 3 to 5 is a more detail view of the post 12. As discussed above the post 12 has an open hat construction, that is, in the cross-section of FIG. 3 the cross-section resembles the cross section of a hat having a brim. The post 12 has two ribs 12.1 on its central side 12.2 and two angularly extending legs 12.3 which extend at an angle away from the central side 12.2. The legs 12.3 terminate in flanges 12.4 which form free ends or edges of cross-section of the post 12, with the flanges 12.4 being parallel to the direction of general extension of the central side 12.2.

In the illustration of FIG. 3 the apexes 12.5 between the intersection of the legs 12.3 and flanges 12.4 are shown with both radiused representation and angular representation. If the post 12 is manufactured from a hot rolling process then sharp corners 12.5 and 12.6 will result, whereas if a cold forming process is used to produce post 12 then by virtue of that process radiused apexes 12.5 will result.

Figure 6:
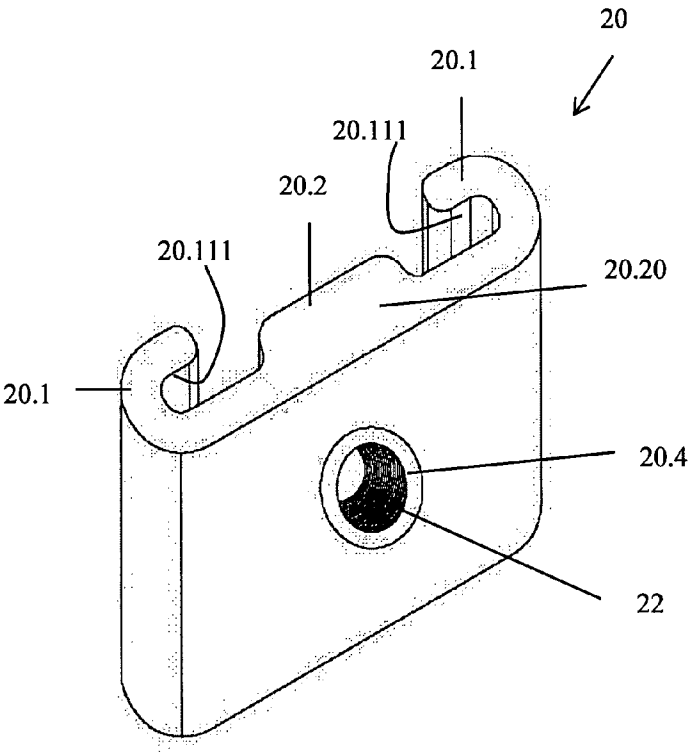
FIG. 6 illustrates a perspective of a carriage for use with an embodiment of the present invention.
Figure 7:
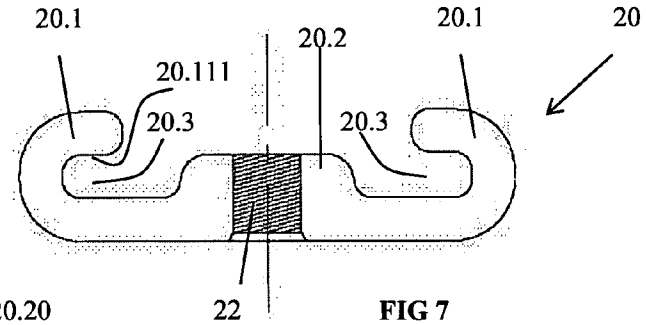
FIG. 7 illustrates plan view of the carriage of FIG. 6.
Figure 8:
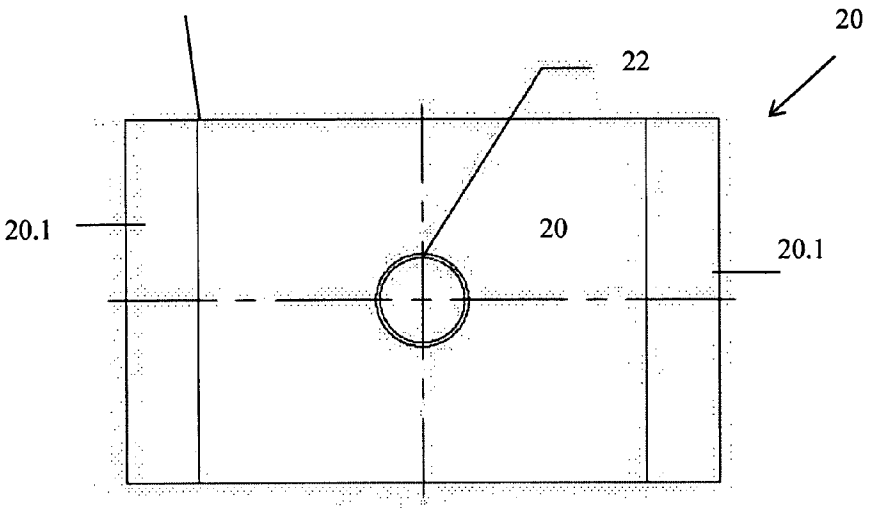
FIG. 8 illustrates a front elevation of the carriage of FIG. 6.
Figure 9:
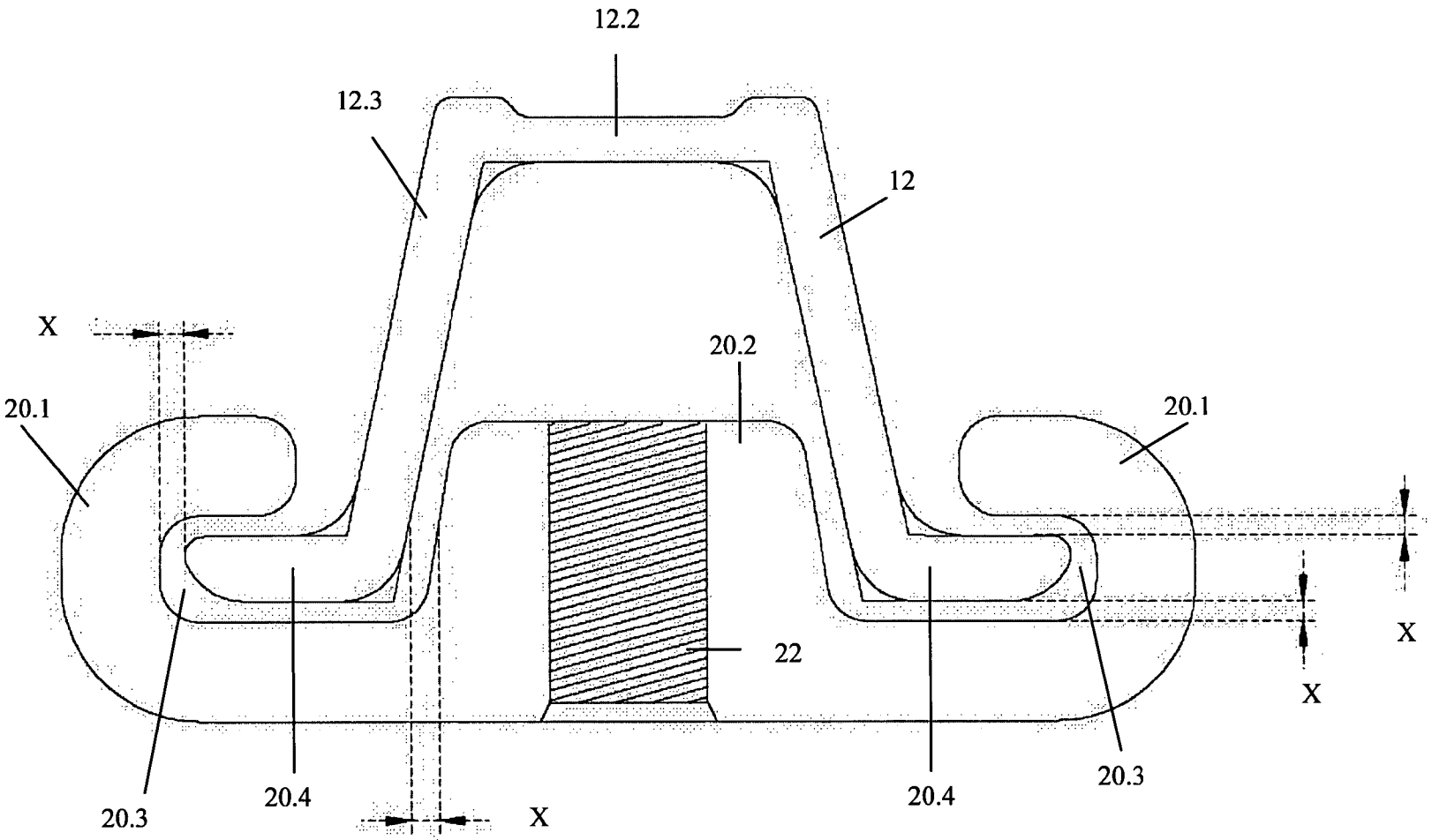
FIG. 9 illustrates a cross sectional view through the post and carriage of previous Figures when in an assembled condition prior to securing.

Illustrated in FIGS. 6 to 8 is the carriage 20 in greater detail. The carriage 20 is of substantially a "3" or "E" cross section—that is the cross section is similar in shape to a number 3 or the letter E. The cross-section includes a bulbous middle section 20.2 through which the thread 22 passes. The bulbous middle section 20.2 has tapered sides and a flat outboard face, which shape matches reasonably closely to the shape of the space bordered by the post 12 between the legs 12.3 and the inboard side of central side 12.2. The bulbous middle section 20.2 together with wraparound ends 20.1, as illustrated in FIG. 9, are shaped so as to provide channels 20.3 on the carriage 20 which enable carriage 20 to be received onto the post 12, in particular onto the flanges 12.4 of the cross-section of the post 12, and the space in between the legs 12.3.

The wraparound ends provide or form on their internal surfaces curve sided channels to receive the portions of the post 12 they engage. By means of the channels 20.3, as will be described later, the carriage 20 also assists the post 12 in maintaining its "shape" during a collision.

The threaded section 22 can be formed by standard threading techniques depending upon the material of the carriage 20 or if the carriage 20 is manufactured from plastic or ductile iron a steel threaded insert 20.4 can be inserted in the mould and the carriage cast around it so as to provide the threaded portion 22. In the cross-section of FIG. 7 and FIG. 8 the carriage 20 illustrated doesn't utilize a threaded insert 20.4, but rather as the carriage 20 is made from steel, a thread 22 is simply formed in the through hole which passes through the bulbous portion 20.2.

Figures 44, 45, 46, 47:
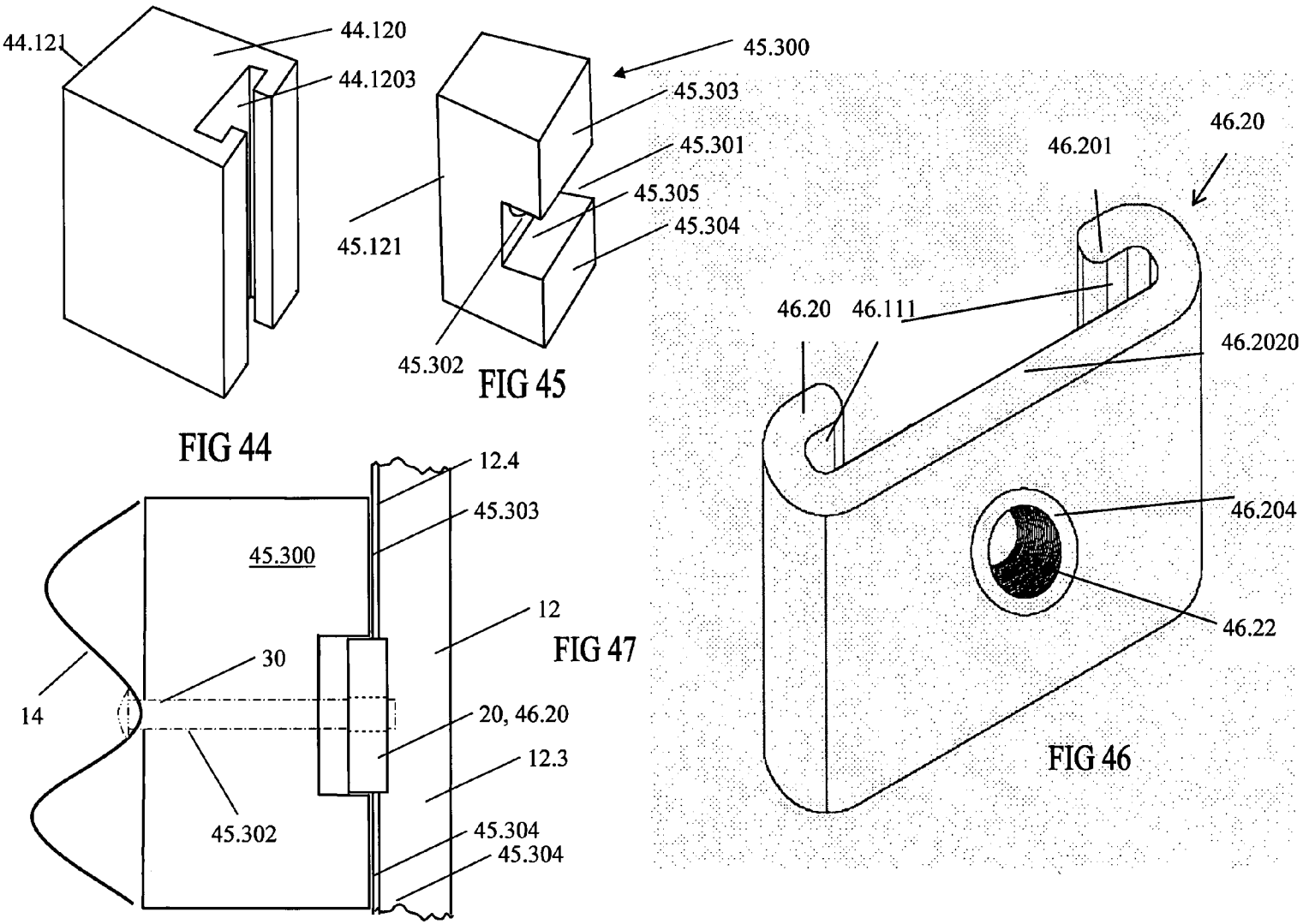
FIG. 44 illustrates a blocking piece with free end engagement formations.
FIG. 45 illustrates a schematic perspective view of a blocking piece for engagement with a carriage.
FIG. 46 illustrates a perspective view of a simplified carriage.
FIG. 47 illustrates a schematic assembly side view of a W-Beam, blocking piece of FIG. 45, a carriage such as in FIG. 46 or FIG. 1, and a post as in FIG. 1.

Illustrated in FIG. 46 is a carriage 46.20 which is similar to the carriage 20 of FIG. 6, except that the bulbous portion or projection 20.2 is absent. The carriage 46.20 can function in the same manner as the carriage 20 of FIG. 6, as will be described below, and like parts have been like numbered, but with a prefix "46." being included in the numbers on FIG. 46.

As is illustrated in FIG. 9 where the post 12 and carriage 20 are illustrated in cross-section as assembled, the size of the channel 20.3 and bulbous portion and the dimensions of the bulbous portion 20.2 are selected so as to produce a clearance dimension X which is preferably of approximately 2 mm depending upon manufacturing tolerances and the like.

It will be seen from FIG. 9 that the bulbous portion 20.2 has angled sides which generally match the angle of the sides 12.3 so as to provide a similar clearance X between the bulbous portion 20.2 and the sides 12.3.

In the embodiment illustrated in FIGS. 1 to 9, the length of the bolts 30 is such that once the W-beam 14 has been secured to the carriage 20 by the bolt 30 tightened with respect to the carriage 20, the distal end of the shank of the bolt 30 will not protrude past the bulbous portion 20.2 to make contact with the inboard side of central side 12.2. Instead, the height at which W-beam 14 will sit with respect to the post 12 can be determined by other means described later in this specification with the carriage 20, beam 14 and post 12 being made to sit at an appropriate height awaiting collision with a vehicle. When collision occurs and the beam 14 is impacted by a vehicle, and as the momentum of the vehicle pushes the beam 14 towards the post 12 causing the post to bend, the beam 14 can be maintained at the collision height because as the post 12 bends the carriage 20 is able to slide along the post 12.

If desired longer bolts can be utilized, either in replacement of height control methods discussed below or in addition thereto, which when sized so as to engage the inboard face of the side 12.2, will force the carriage 20 away from the side 12.2, so that a clamping of the carriage 20 to the post 12 will occur. By this means an additional frictional force will be developed by the pushing of the inboard face 12.111 against the outboard face of the flanges 12.4, thereby introducing a frictional force at this location in addition to the location of the distal end of the bolt 30 shank where it engages the side 12.2 of the post. This additional frictional force will increase the total amount of friction and thus increase the breaking or magnitude of the force required to allow movement between the carriage and the post.

Figure 10:
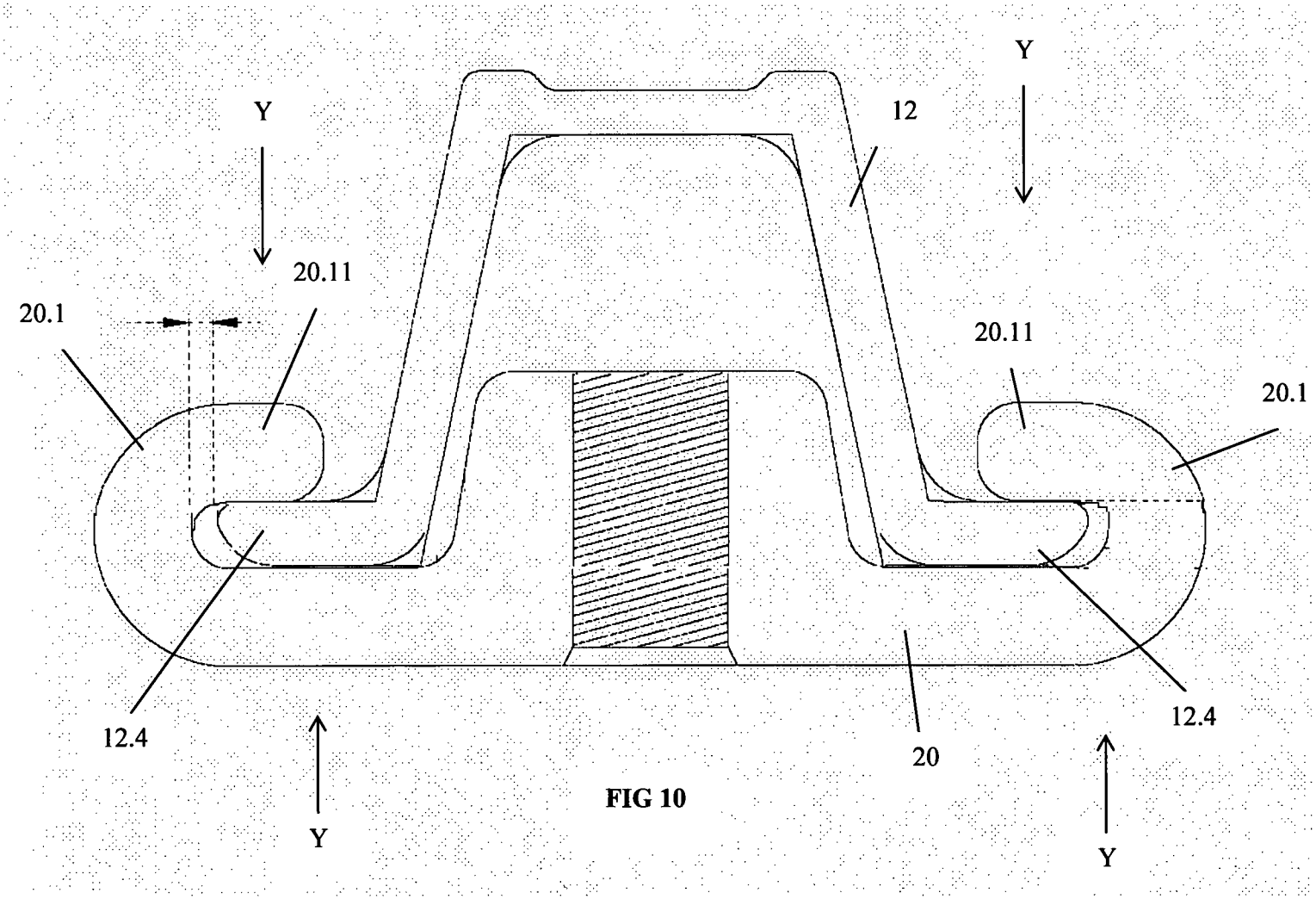
FIG. 10 illustrates an assembly similar to that of FIG. 9.

Illustrated in FIG. 10 is an embodiment similar to that described above except that in this embodiment a predetermined amount of resistance is provided, in the form of friction, to retard or delay or provide a starting limit of the motion of the carriage 20 with respect to the post 12.

This achieved by means of the free ends or edges 20.1 of carriage 20 having their termini 20.11 crimped by compressive forces in the direction of arrows Y, once installed onto the post 12 and before assembly of the guard rail 14. By such crimping there is produced a decrease in the width of the channel 20.3 and the application of a compressive force to the flanges 12.4 of the post 12. By this mechanism a degree of friction is generated between the post 12 and carriage 20 to thereby prevent the carriage 20 from moving relative to the post until a predetermined force has been applied to the carriage 20 by a colliding vehicle making contact with the beam 14 to thereby induce movement relative to the post 12. The amount of friction and crimping force applied can be readily determined relative to the amount of force required to produce relative movement between the carriage 20 and the post 12, or to allow separation of the carriage 20 from the post 12.

Figure 12:
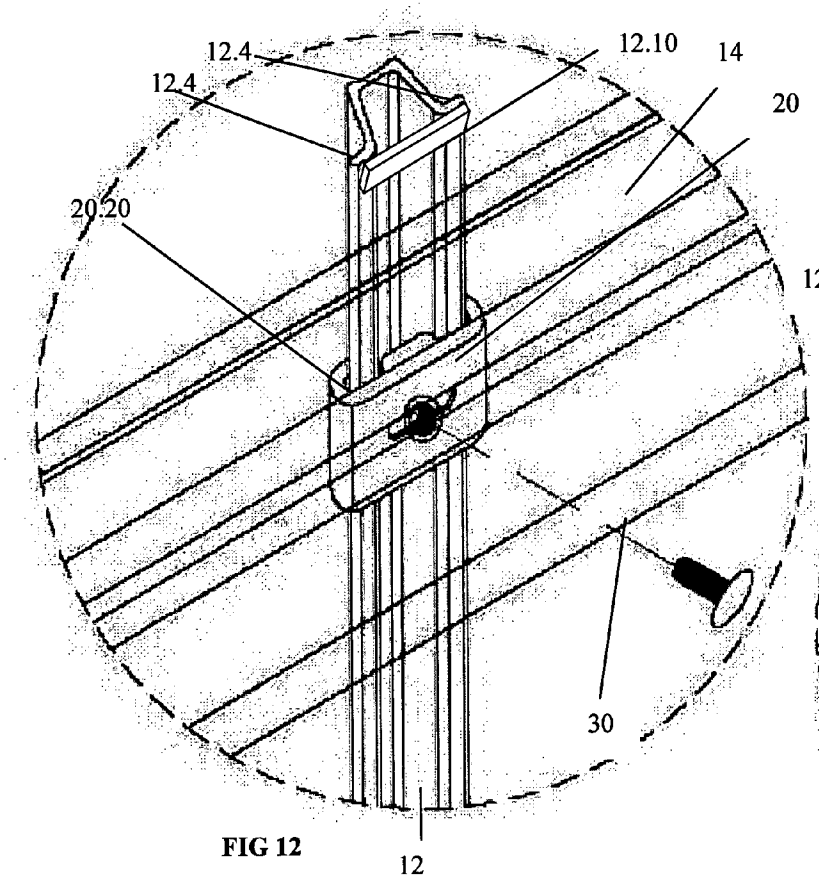
FIG. 12 illustrates one means of controlling the rate or time or the amount of force required for the carriage to disconnect.

Illustrated in FIG. 12 is another mechanism which can be utilized with the previous embodiments to determine or limit or set the minimum force required to allow continued movement of the carriage 20 relative to the post 12 after collision.

As can be seen from FIG. 12 the post 12 includes a welded crossbar 12.10 which extends across the flanges 12.4 and is welded to the flanges 12.4. The length of welding and types of welding can be selected so as to set or predetermine the minimum amount of force required to break the cross member 12.10 away from the post 12.

Accordingly once the upper face 20.20 of the carriage 20 engages the lower face of the cross member 12.10 and until such time as the breaking force is applied the carriage member 20 will move up to or remain in position or contact with the post 12. If the beam 14 is moving with sufficient speed and momentum to generate enough force to break the welds or contact mechanism (whether it be by bolt or otherwise) to disconnect the cross member 12.10 from the post 12, then at this point the carriage 20 can disconnect from the post 12.

In respect of the embodiment of FIG. 12, if desired the cross member 12.10 can be connected by bolts to the flanges 12.4, and as the shear strength of bolts is readily determined or calculated the breaking force required will be known. If desired bolts having reduced cross-section, such as discussed below, or frangible sections can be utilized so as to more accurately control the breaking force required.

Figure 13:
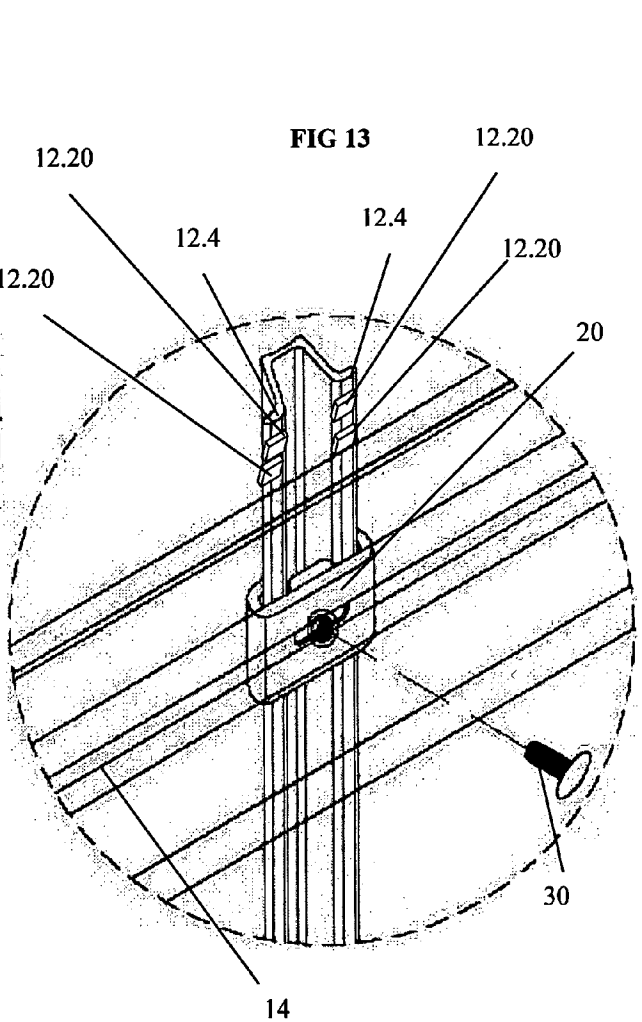
FIG. 13 illustrates an alternative mechanism to that of FIG. 12 utilizing a series welded elements or peened formations.

Illustrated in FIG. 13 is an embodiment similar of that to FIG. 12 except that a series of smaller members 12.20 are appropriately attached to the flanges 12.4. By utilizing a series of members 12.20 down the length of the flange 12.4 if each of the members 12.20 have the same breaking force requirement, then a "staccato" or "stop start" breaking or disconnection action may occur as the carriage 20 engages respective members 12.20.

Another feature of utilizing the members 12.20 in a series along the flange 12.4 is that by providing welds of same or different strength or bolts of same or different strengths to secure the members 12.20 to the flange 12.4, a system can be produced whereby the carriage 20 will require increased force as it travels up to break successive members 12.20 from flanges 12.4, or constant force above a certain magnitude, or decreasing force in an upward direction.

Figure 14:
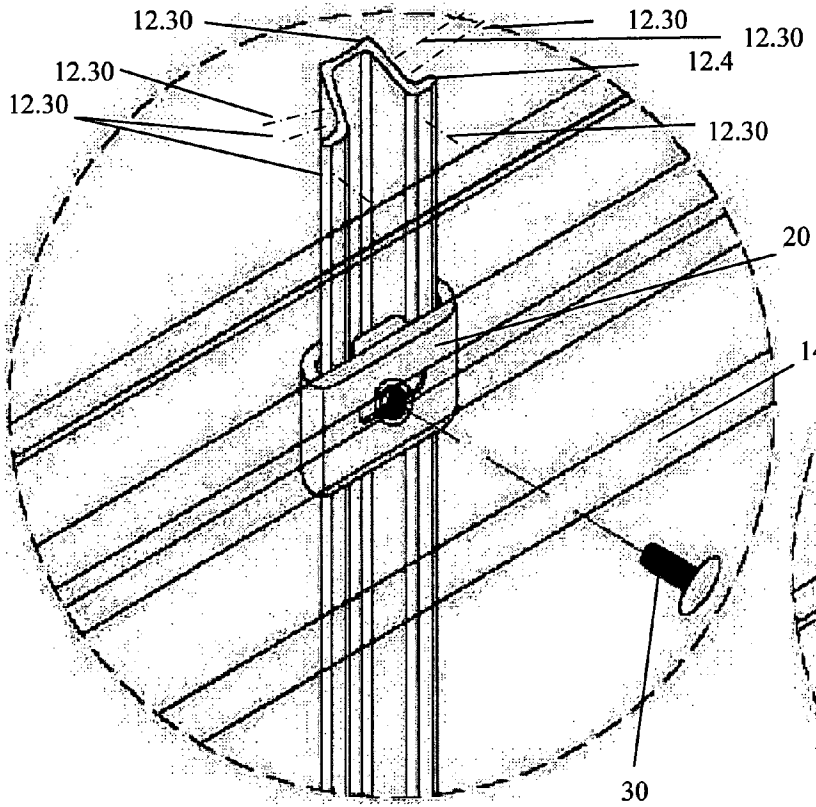
FIG. 14 illustrates a means similar to FIGS. 12 and 13 utilizing bolts.

Illustrated in FIG. 14 is an embodiment similar to FIG. 13 where the location or positioning of bolts either into the flanges 12.4 or into the legs 12.3 are indicated by centre lines 12.30. It will be seen that bolts (or members 12.20 secured by bolts) could be positioned on the inboard sides of the legs 12.3 so as to make contact of the bulbous section 20.2 so as to provide resistance to relative motion between the post 12 and carriage 20. Alternatively it could be achieved by a series of such bolts represented by centre lines 12.30 or members 12.20.

Figure 15:
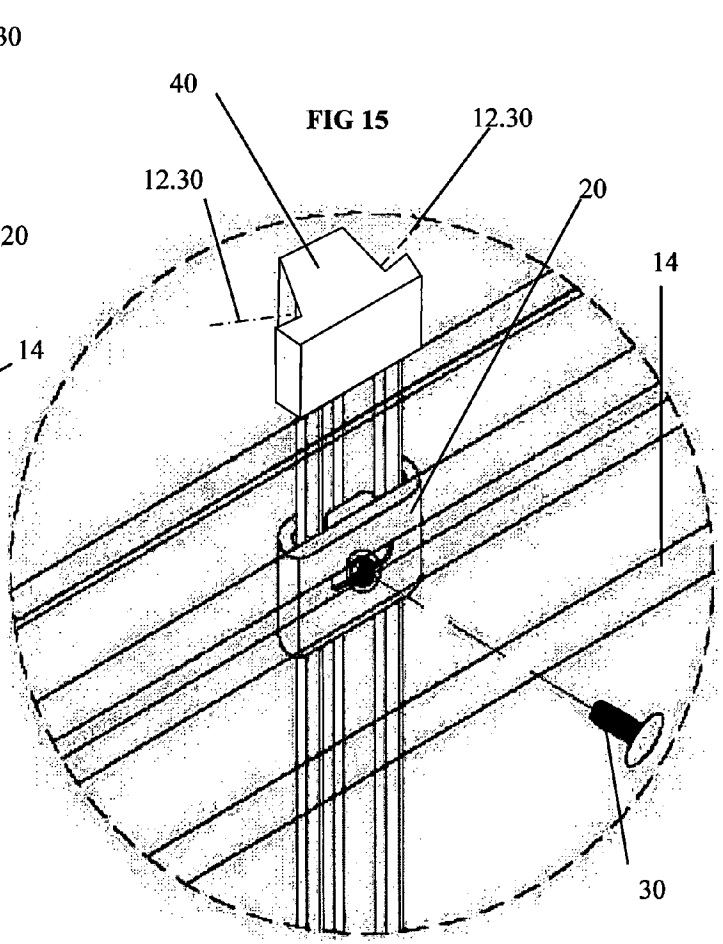
FIG. 15 illustrates a means similar to FIGS. 12 and 13 wherein a cap and bolts can be utilized to produce similar effects to the systems disclosed in FIGS. 12 to 14.

Illustrated in FIG. 15 is a polymeric or cast steel post cap 40 which can be secured to the post by any means, such as by bolting along centre lines 12.30. The breaking strength of the cap 40 and or the shear strength of the bolts placed along centre lines 12.30, when engaged by sufficient force from the carriage 20, will determine the breaking force required for the carriage 20 to disconnect from the post 12 during relative motion.

Figures 16, 17, 18, 19, 20, 21:
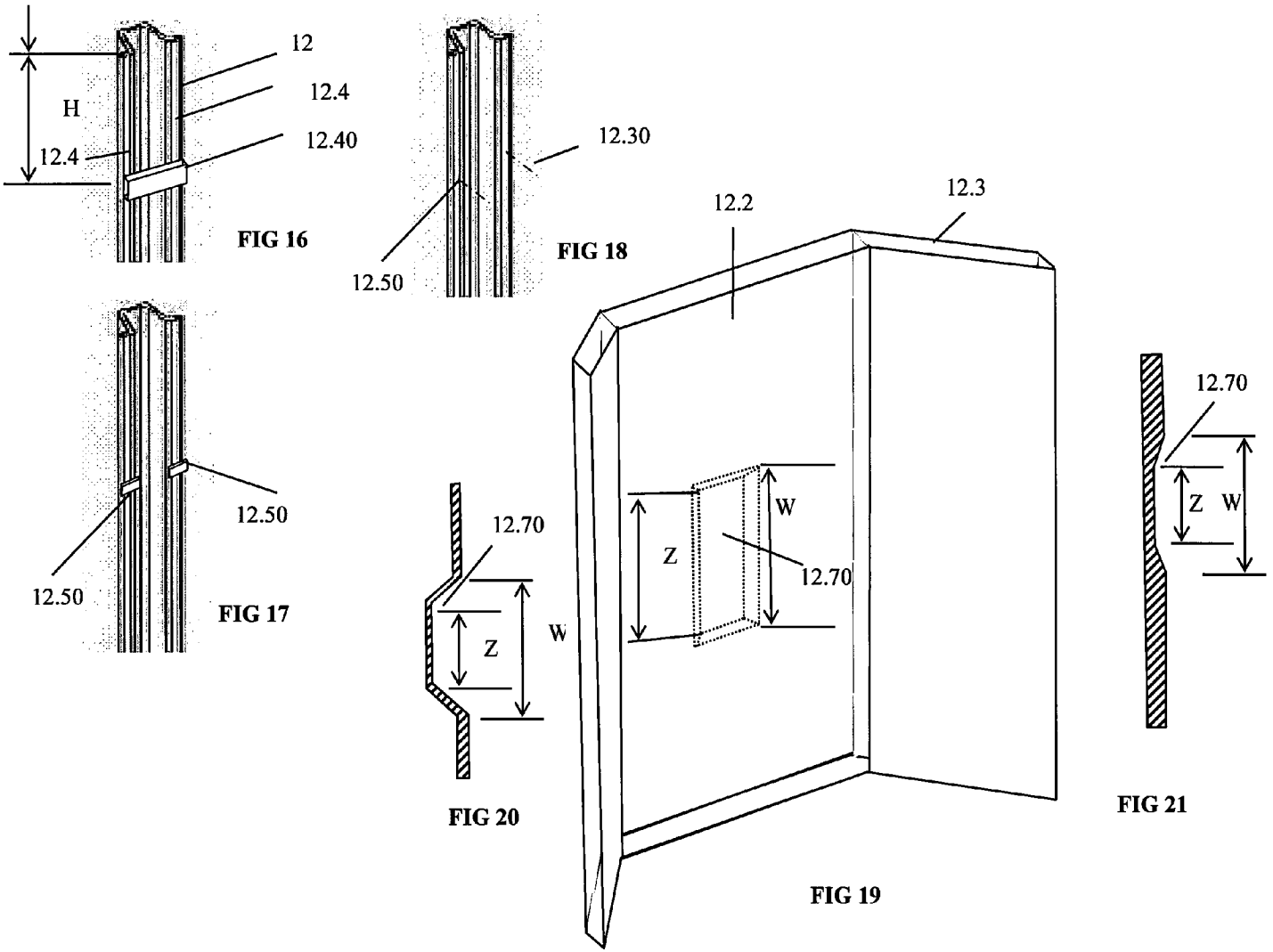
FIG. 16 illustrates a first means to control the height of a carriage member on a post.
FIG. 17 illustrates alternative mechanism to that of FIG. 16.
FIG. 18 illustrates an alternative mechanism to that of FIG. 16 or 17.
FIG. 19 illustrates a partial view of some of the walls of the post of FIG. 3 in a schematic view with a depression formed in one face.
FIG. 20 illustrates a cross-section through the depression of FIG. 19.
FIG. 21 illustrates an alternative cross-section through the depression of FIG. 19.

As mentioned above, with regard to the assembly of the roadway barrier or guard rail system 10 of FIG. 1, the post 12 can include a means to set the height of the carriage 20 with respect to the post 12. As illustrated in FIG. 16 a rectangular block member 12.40 can be welded or bolted or otherwise attached to the flanges 12.4 at a desired or specified height H, so as to locate the beam 14 at the appropriate height as governed by regulations or circumstances at installation.

Illustrated in FIG. 17 is an alternative mechanism which would prevent the carriage from moving down the post 12 past a specified location. The system of FIG. 17 includes individual blocking members 12.50 attached only to respective flanges 12.4 by bolting or welding or any known means. If desired a single block member 12.50 on only one flange 12.4 can be utilized. Alternatively, instead of blocking members being welded, a line of welds, or the placement of weld metal onto the outboard surfaces of the post or flanges, to effect a change of the cross section of the post can be utilized to thus provide an abutment for the carriage to engage to limit its downward travel on the post.

Illustrated in FIG. 18 is another alternative to that of FIGS. 16 and 17 where the centre lines 12.30 of bolts are illustrated wherein if one or more bolts are positioned in one or more flanges 12.4 so that the amount of travel down the post 12 of by the carriage 20 can be limited.

As illustrated in FIGS. 22 and 23 is a further mechanism for locating the carriage 20 on the post 12. In this embodiment, there is produced a pierced and bent out tab 12.60 which can either be formed in a flange 12.4 or as illustrated in the leg or legs 12.3 of the post 12. If desired a tab 12.60 can be located above the carriage 20 when assembled to a post 12, which can also be used to provide a predetermined amount of resistance to the motion of the carriage relative to the post 12 in much same way as the embodiments of FIGS. 10, 12, 13, 14 and 15 function. When used with such a purpose in mind the tab 12.6 may be formed in the same fashion as illustrated in FIGS. 22 and 23 or could be formed in an upside down orientation relative to FIGS. 22 and 23 depending upon the magnitude of force which is desired to be generated to break the connection between the carriage 20 and the post 12.

Illustrated in FIGS. 19, 20 and 21 is an alternative means to provide both the height control of the carriage 20 relative to the post 12 when assembled, as well as the breaking force required to separate or allow movement of the carriage 20 relative to the post 12 during collision.

In the embodiment of FIGS. 19, 20 and 21, a depression or recess 12.70, in this instance represented by a generally rectangular depression, can be formed on the inboard side of central side 12.2 of the post 12. The depression 12.70 can have a height Z from top to bottom at the inboard surface of central side 12.2, and at the base surface of the depression a height W.

The depression 12.70 can be formed by pressing as in FIG. 20 whereby the outboard side of central side 12.2 in the region of the depression 12.70 projects outwardly. Alternatively, as illustrated in FIG. 21, the outboard side of central side 12.2 can be such that the depression 12.70 does not have any effect on the outboard face side. It is envisaged that to produce the cross-section of FIG. 20 a pressing technique would be utilized to form the depression 12.70 whereas in respect of the cross section FIG. 21 a machining or possibly even a rolling technique might be utilized.

The depression 12.70 functions as follows. When utilized on a post 12 and carriage 20 the bolt 30 used with this embodiment will be longer than the bolt utilized with embodiments described above. In this instance the bolt 30 will be long enough so as to engage the base surface of depression 12.70 within the height Z illustrated in FIGS. 19, 20 and 21. By the bolt 30 being of an appropriate length a predetermined amount of friction can be applied between the bolt and the depression 12.70 in the confines of height W to frictionally locate the carriage 20 at an appropriate height on the post 12. During collision first the friction force between the base surface of depression 12.70 and the bolt 30 would need to be overcome by the collision force and then as the carriage 20 moves upward relative to the post 12 to the upper limit of the height W, the inclined formation between the top of height Z and the top of height W will be engaged by the bolt 30. In this case a planar inclined formation or beveled formation is formed, but this could be curved whether concave or convex.

Being a beveled formation in FIGS. 19, 20 and 21, this formation will provide an increase in frictional force. If a square shoulder or wall is formed instead, this will provide a point of shearing of the bolt 30 during a collision. The breaking force of such shearing or interaction with the formation can be readily determined so that breakage or disconnecting of the carriage 20 will start its motion and ultimately disconnect from the post 12 at an appropriate force magnitude.

With regard to the embodiments of FIGS. 1 to 15 as illustrated, further frictional force can be provided by the utilization of longer bolts 30 which would simply provide a frictional interaction between the ends of the bolt shanks and the inboard side of the central side 12.2 of the post 12.

Illustrated in FIGS. in 24 and 25 is another method similar to that of FIGS. 19 *to* 21 which can control the location of the carriage during assembly and also provide a detent means to prevent the carriage from moving relative to the post until a predetermined breaking force is achieved during a collision. In the embodiment of FIG. 24 either a blind hole or recess 12.80 as illustrated in FIG. 25A, or through hole 12.80 as illustrated in FIG. 25, can be provided in the inboard side or through the central side 12.2 of the post 12 through or into which a threaded shank of the bolt 30 can pass. If desired, the hole 12.80 can also be threaded as it may, in some circumstances, provide more control of the breaking force. Further if the hole 12.80 passes right through the central side 12.2 a nut could also be located on the end of the bolt. The hole 12.80 could also be vertically elongated if desired irrespective of whether it is a through hole or a blind hole.

With the embodiments of FIGS. 19, 20, 21, 22, 23, 24 and 25 a special bolt 30 can be utilized. This bolt is illustrated in FIG. 30 which has a mushroom head 30.1, a threaded shank 30.2 which is of sufficient length to remain within the confines of the bulbous portion 20.2 and provide sufficient strength to effect the join. The bolt 30 also includes a turned down or tapering portion 30.3 and a smaller diameter terminus 30.4 which can either engage the inboard surface of the central side 12.2, the depression 12.70 of FIG. 19 or the blind hole or aperture 12.80 or FIGS. 24 and 25.

A particular advantage of the bolt 30 is that the assembler does not have to wind the bolt along a full length thread as only sufficient thread is provided so as to engage the thread 22 on the carriage 20. This means the bolt can be pushed through the threaded aperture which has the thread 22. The terminus 30.4 and dimensions of the length and surface area of the shank can be calculated so as to apply the appropriate amount of pressure and thus friction produced or to engage formations that might be on the post 12.

The bolt 30 of FIG. 30 preferably has in its mushroom head 30.1 a recess or a slot to allow Allen keys or hexagonal drivers or Phillips screwdrivers or flat screwdrivers or any appropriate tool to be inserted therein so as to rotate and to secure the bolt 30 relative to the carriage 20 and its thread 22. The mushroom heads 30.1 preferably have a recess because as they are on the outside of the assembled guard rail this provides a lower profile than a hexagonal headed bolt. This arrangement helps reduce the potential harm from the impact, particularly to bicycle and motor cycle riders who collide with the assembled barrier system.

Figure 26:
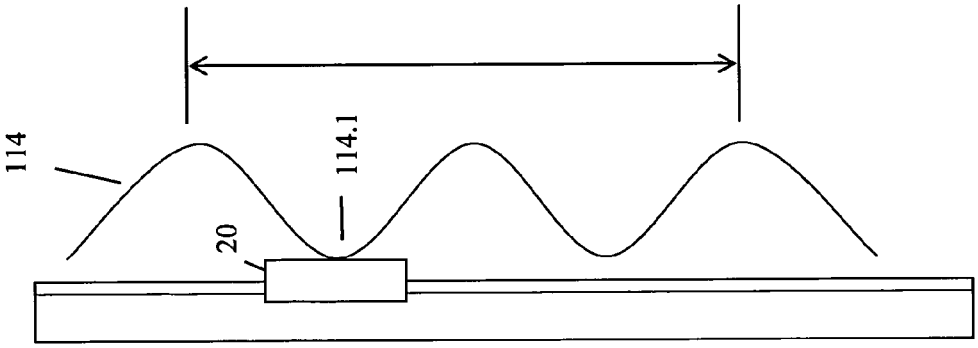
FIG. 26 illustrates a schematic of a three-beam mounted on the post of previous embodiments utilizing a single carriage member and an upper location.

In FIGS. 26 to 29, are embodiments showing use of carriages 20 with a guardrail system utilizing a three crest two trough beam, known by the trade mark THRIEBEAM guard rail. In FIG. 26 is schematic of the post 12 with a single carriage 20 assembled together with a beam 114. In the embodiment of FIG. 26 the carriage 20 is located at an upper trough 114.1. Whereas in FIG. 27 the single carriage is utilized and it is mounted with respect to the lower trough 114.2.

Figure 28:
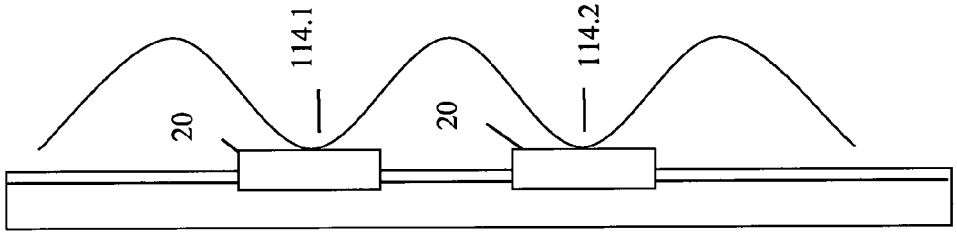
FIG. 28 illustrates two carriages utilized with embodiment of FIG. 26 or 27.
Figure 27:
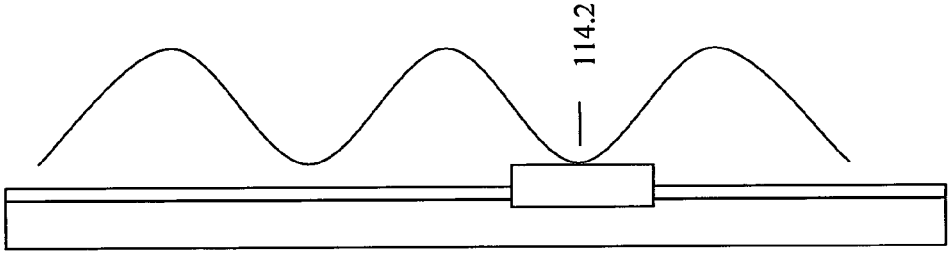
FIG. 27 illustrates an embodiment similar to FIG. 26 where a single carriage is utilized on a lower location.

In FIG. 28 two carriages 20 are utilized one each at the upper and lower troughs 114.1 and 114.2.

Figure 29:
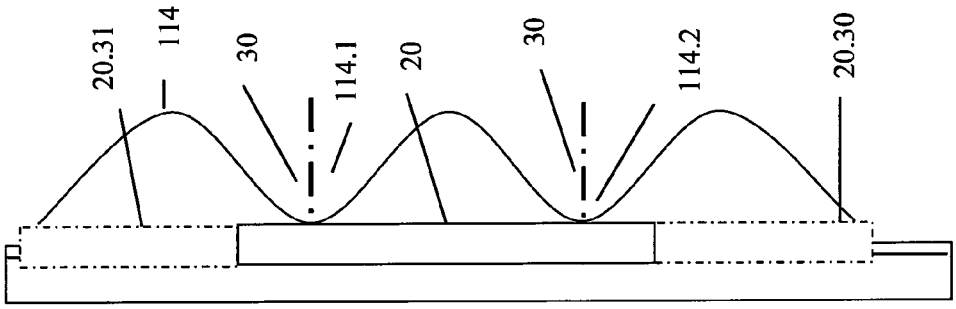
FIG. 29 illustrates a single carriage member for use with three-beam across one or two peened locations.

Finally in FIG. 29 a single, much longer carriage 20 is utilized which allows the beam 114 to be mounted by bolts 30 through the upper and lower troughs 114.1 and 114.2 respectively. If desired the carriage 20 of FIG. 29 could have an even greater length indicated by extensions 20.30 and 20.31 so as to provide a contact point with the free ends or edges of the beam 114.

As mentioned briefly above, an advantage of the use of a carriage 20 with the post 12 is that the carriage 20 can provide a degree of reinforcement of the post during collapse to help them maintain the cross-section in the vicinity of the carriages 20 in a similar manner to that described in co-pending application PCT/AU2006/001955 (WO2007/079520) the contents of which are incorporated herein by reference.

Figure 11:
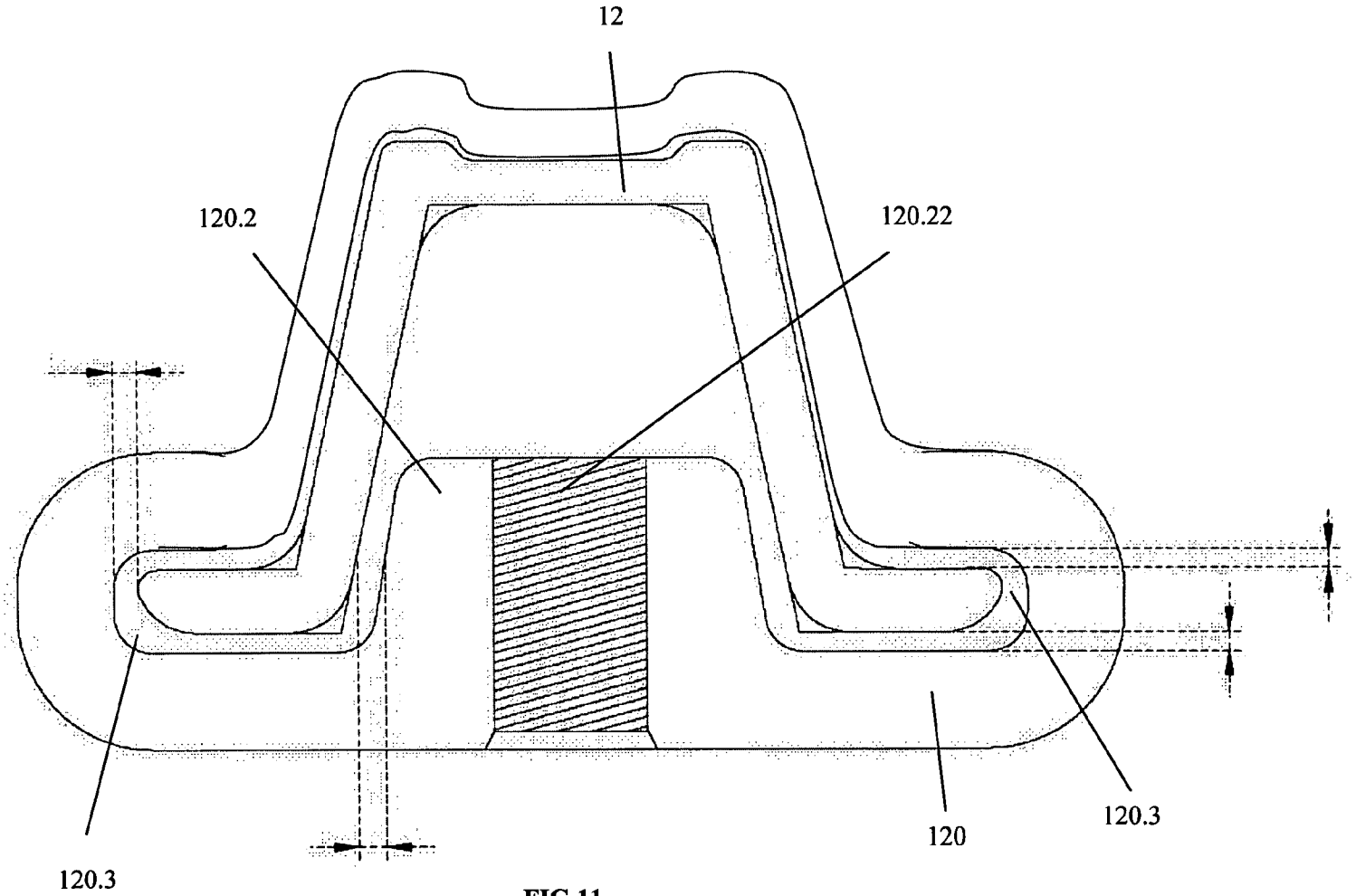
FIG. 11 illustrates a carriage mechanism which fully envelops the post of previous Figures.

Illustrated in FIG. 11 is an embodiment similar to those described above except that the carriage 120 fully surrounds the post 12. The carriage 120 or the post 12 can have any of the features previously described such as crimping, the use of bolts through thread 22 to engage depressions holes or the central side 12.2 or any appropriate means to control the amount of friction and thus breaking force required to allow relative movement between the post 12 and the carriage 120.

While the above described embodiments generally utilize the open hat cross-section embodiments will be described wherein other shape posts can be utilized such as O-post, I-beam, H-shaped or C or Charlie shaped posts. However posts such as rectangular hollow sections or square hollow sections can also be used with the present invention in which case a carriage similar to the carriage 120 of FIG. 11 which completely envelops or sufficiently envelops an RHS or square hollow section post can be utilized. Such an arrangement as is illustrated in Figures is 41 and 42 are schematic representations of carriages 41.120 and 42.120 as may be used with RHS or SHS posts.

Figure 31:
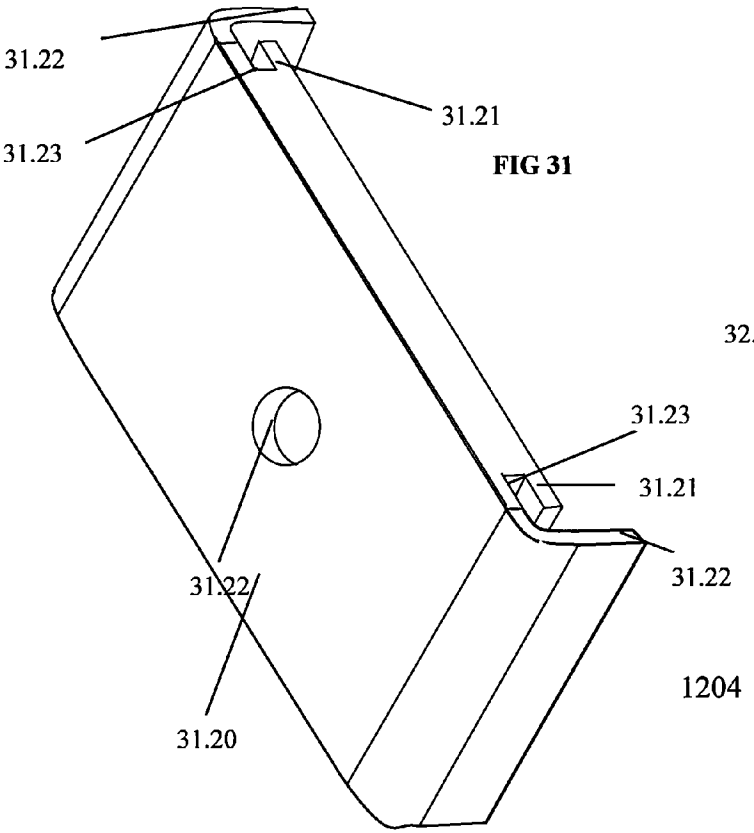
FIG. 31 illustrates an alternative carriage mechanism for use with a Charlie post.

Illustrated in FIG. 31 is a carriage 31.20 for use with a Charlie post or C-section post (see the post of FIG. 39) this can be made to function in a manner similar to that described above. If desired the channel 31.23 can have its dimensions reduced so as to produce an interference fit on the free ends or edges of the Charlie post to provide a predetermined amount of friction. Alternatively the side of the channel 31.21 can be crimped during or after assembly to provide these friction levels, or alternatively the free ends or edges 31.22 on the carriage 31.20 can be angled inwardly whereby a predetermined amount of friction achieved when the carriage 31.20 is assembled onto a Charlie post with respect to the outside surface of a Charlie post.

Figure 32:
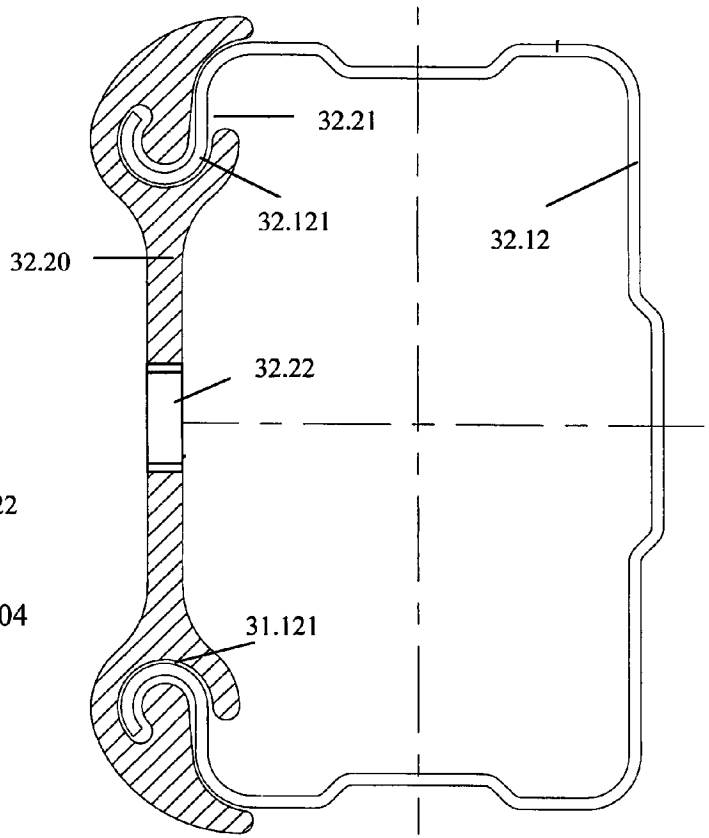
FIG. 32 illustrates a carriage mechanism for use with an O-post in cross-section.

Illustrated in FIG. 32 is a carriage 32.20 for use with an O-post 32.12. The O-post is noted for its curled free ends or edges 32.121, and the carriage 32.20 has an appropriately shaped curved channel 32.121 to accommodate this. In the embodiment of FIG. 32 the open section of the O-post could be utilized in the same manner as the post 12 of FIG. 1, or the carriage 32.30 can include a securement formation to allow the O-post to be used in its strongest orientation, that is in the orientation as illustrated in FIG. 32 and whereby the rail or guard rail or beam 14 can be secured thereto.

Figure 33:
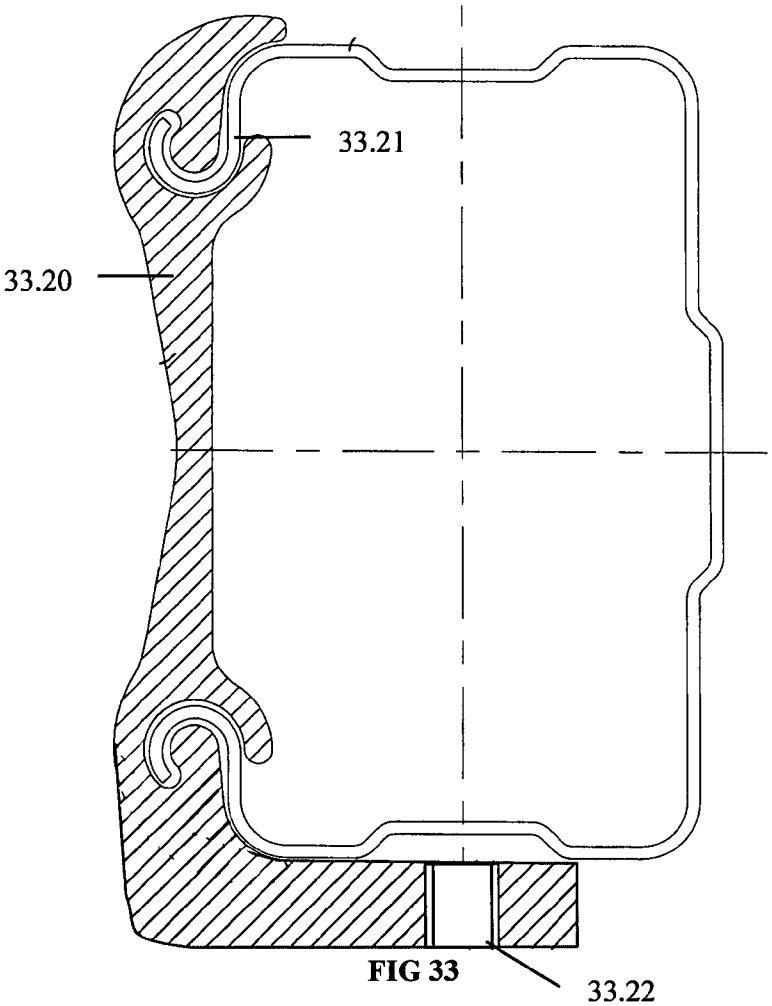
FIG. 33 illustrates an alternative carriage cross-section for use with an O-post.

A similar arrangement is illustrated is FIG. 33 with the carriage 33.20 having a slightly different cross-section to that of carriage 32.20 of FIG. 32. Illustrated in FIG. 34 is an embodiment similar to that of FIGS. 32 and 33 where the threaded section 22 is off centre allowing the O-post to be used in its strongest orientation.

Figure 34:
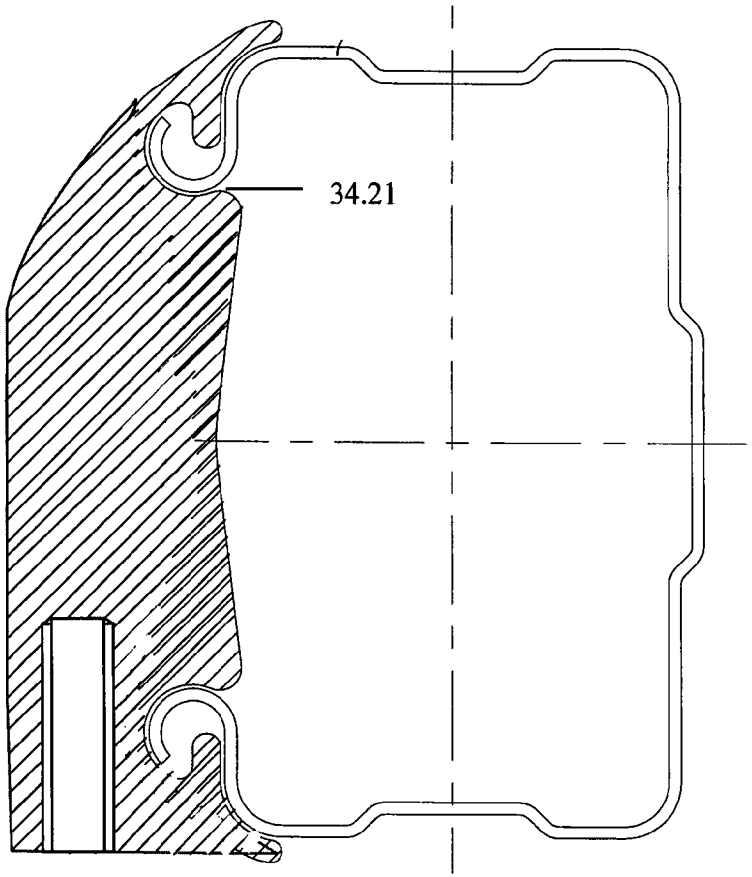
FIG. 34 illustrates a further carriage mechanism for use with an O-post.

For the embodiments of FIGS. 32, 33 and 34 the amount of friction can be controlled by the size of the channels 32.21, 33.21 and 34.21 as well as the amount of friction generated on the outside surface of the O-post.

Figure 35:
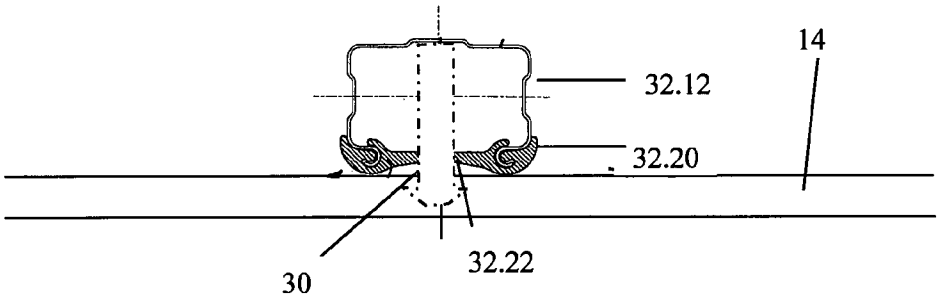
FIG. 35 illustrates plan view of the O-post with a carriage similar to that of FIG. 33.
Figure 36:
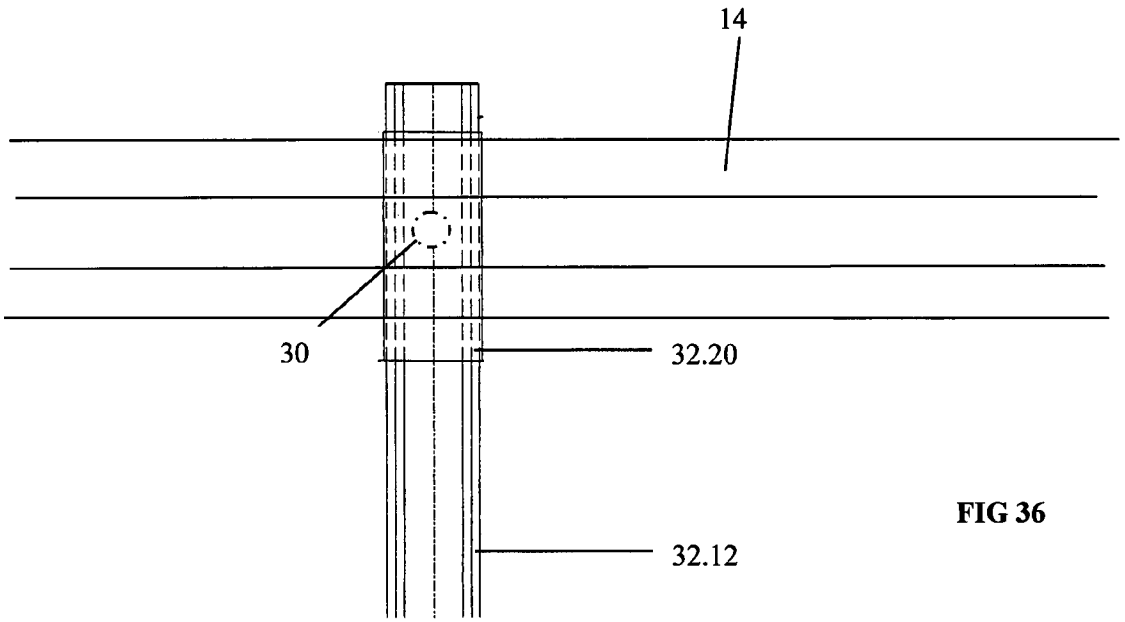
FIG. 36 illustrates a front elevation of the apparatus of FIG. 35.

Illustrated in FIGS. 35 and 36 is the carriage 32.30 showing a plan and front elevation assembled with a beam 14 or a beam 114.

Figure 37:
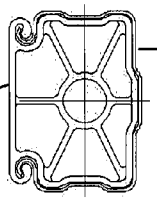
FIG. 37 illustrates an internally held carriage unit used with an O-post or upper open section.
Figure 38:
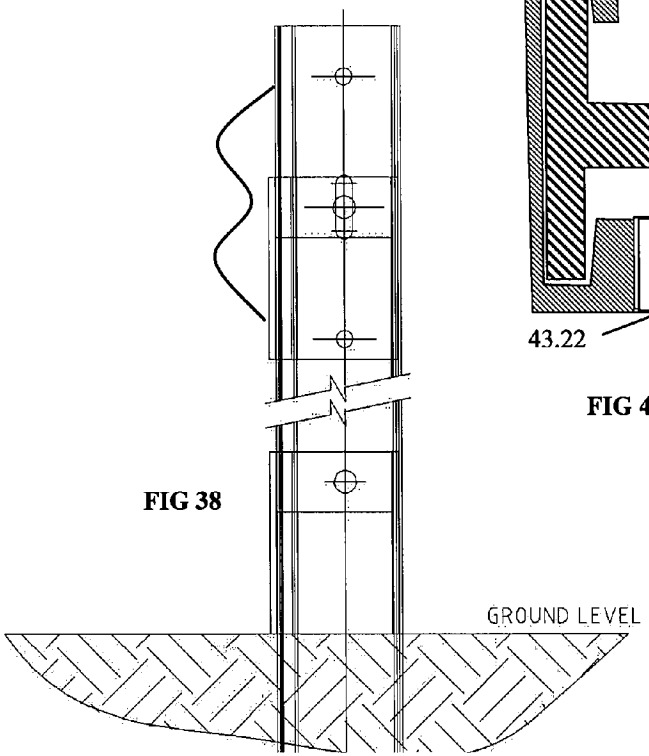
FIG. 38 illustrates a side elevation of the apparatus of FIG. 37.

Illustrated in FIGS. 37 and 38 is a carriage 37.20 which fits completely within the confines of the inboard periphery of the O-post. Respective movement between the carriage 37.20 and the O-post 37.12 can be controlled by the amount of friction generated by the relative sizes of the carriage 37.20 and the post 37.12. Additionally self tapping screws could be passed through the outboard side of the O-post 37.12 into the carriage 37.20 to thereby control the amount of shear force or breaking force required to allow movement to occur.

Figure 39:
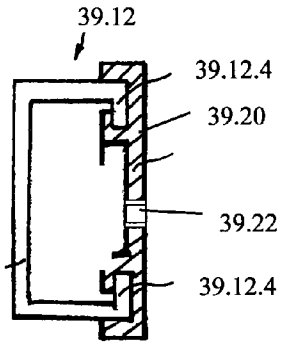
FIG. 39 illustrates a carriage member interacting with a Charlie post.

Illustrated in FIG. 39 is Charlie post 39.12 and carriage 39.20 which engages the free ends or edges of the Charlie post.

Figure 40:
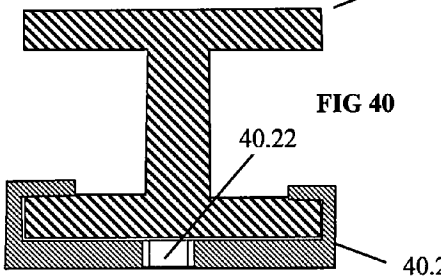
FIG. 40 illustrates a carriage member interacting with an I-post.

In FIG. 40 is a schematic of an I-post 39.12 having a Charlie or C-shaped cross-section carriage.

Figure 43:
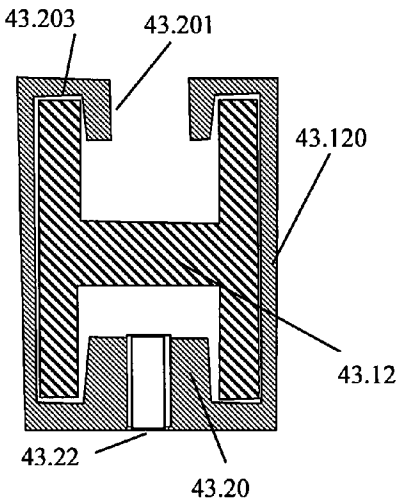
FIG. 43 illustrates a schematic cross section of a carriage mechanism for use with an I-post.

In FIG. 43 is a schematic of an I-POST 43.12 rotated through 90 degrees by comparison with the I-post 12 of FIG. 40. The I-post 43.12 has a carriage 43.120 with a bulbous portion or channel projection 43.20 on its inboard side, and on its opposite outboard side it has enveloping projections or arms 43.201 which form a channel 43.203 into which the outboard free ends or edges of the I-post can be received.

The embodiments of FIGS. 12, 13, 14 and 15 utilize attached members and or bolts to control the breaking force. However other formations could be utilized in the flanges 12.4 such a pressed depressions or recesses (as illustrated in FIG. 19 and cross section of FIG. 20) which will change the cross-section of the flanges 12.4 to thereby provide resistance to motion of the carriage 20 relative to post 12.

The embodiments of the carriages 20 and 120 described above are not able to perform the function of a blocking piece (also known as block-outs, blocks, and other similar names). Blocking pieces are required to offset the location of the beam or rail 14 relative to the post 12, so as to prevent tires of vehicles, which may make nuisance collision with the system, from making connection with the post 12. As blocking pieces can be called for, in FIGS. 44, 45 and 47 are embodiments which utilize blocking pieces.

Illustrated in FIG. 44 is a combination blocking piece and carriage 44.120. It has a shaped groove 44.1203 into which can pass the free ends or edges or flanges 12.4 of the post 12. The face 44.121, against which the beam or rail 14 will rest, includes a threaded aperture (not illustrated) similar to thread 22 of the carriage 20 of FIG. 6, so that the beam 14 can be mounted to the combined carriage and blocking piece 44.120. With this embodiment, the height location on the post can be provided by one or more of the means described above, as can the control of the release or disconnection of the carriage 44.120 from the post 12 be controlled by one or more of the means described above. It will be noted in the embodiment of FIG. 44, that the carriage/block piece 44.120 has a "C section" in contrast to the "3" or "E" section of the carriage 20 of FIG. 6.

Illustrated in FIG. 45 is a blocking piece 45.300 which has a cut out or groove 45.305 in its outboard face into which can be located a carriage such as carriage 20 or 46.20. Through the central section is an aperture 45.302 which passes from the inboard face 45.121, at which can be mounted a beam or rail 14, through to the cut out 45.305. The blocking piece 45.300 includes upper and lower outboard faces 45.303 and 45.304 for bearing against the inboard side of the flanges 12.4 of a post 12.

The cut out 45.305 is deep enough so as to allow the carriage 20 or 46.20 room to move in an outboard direction, so that once the free ends or edges 20.1, 46.201 have been slid onto the flanges 12.4 of the post 12, with the blocking piece 45.300 located as in FIG. 47, by securing the beam 14 in place to the carriage 20, the carriage 20 will act as a nut, and the front faces 45.303 and 45.304 will bear against the inboard sides of the flanges 12.4 of the post 12. By this arrangement, and an appropriate torquing or torque setting for the bolt 30, a desired amount of friction can be developed between the faces 45.303 and 45.304 with the inboard paces of the flanges 12.4, as will as between the free ends or edges 12.1 and the outboard faces of the flanges 12.4 of post 12. With this arrangement, the frictional, clamping or compressive forces exerted on to the flanges 12.4, will maintain the arrangement at the desired height on the post 12, and will be the means to control the breaking or disconnect or magnitude of forces at which movement is to start between the carriage and blocking piece relative to the post 12.

If desired the carriage 20 or 46.20 can be captured during the molding or production process used to make the blocking piece 45.300, in which case the cut out 45.305 can be dispensed with, and instead a cavity is provided in the blocking piece to receive the carriage 20 to 46.20. With such an embodiment the ends 20.1, 46.201 are moved so as to project proud of faces 45.303 and 45.304, then the channel 20.3 can be placed over the flanges 12.4 of the post, and the combined blocking piece and carriage moved to the desired height on the post. Then the beam 14 can be assembled, via bolt 30 which is passed through aperture 45.302, and which engages the threaded portion 22, 46.22, and by tightening up the bolt relative to the carriage 20, 46.20, the height and friction settings of the arrangement are set.

An feature of the embodiments described above, as is particularly depicted in FIG. 47, is that the assembly or assemblies of the carriages 20, 44.120 or 46.20 is such that the outboard face of side 12.2 of post 12 does not have any components, such as the bolt 30 or its distal shank, projecting through or past this side 12.2. This feature will not be present in the embodiments such as FIGS. 24 and 25, or where a through aperture 12.80 is provided, however if the aperture 12.80 is a blind aperture, the feature will also be present. A similar comment can be made about the embodiment of FIGS. 19 and 20, where a projecting formation is present, but if the depth of depression 12.70 is not too great, the projection through to the outboard face of side 12.2 will have little impact. Maintaining the outboard surfaces of side 12.2 and 12.3 of post 12 to be completely or substantially free of projections leads to a more desirable assembly, particularly if the assembly 10 is involved in a collision of, for example a motorcycle rider or a bicycle rider, and the post 12 and the guard rail assembly 10.

Illustrated in FIG. 48 (see sheet 12 of the drawings) is a carriage 48.20 which is similar in construction the carriage 46.20, except that the mounting aperture 48.22 and thread 48.204 are located closer to the bottom edge of the carriage 48.20 than the aperture 46.22 and thread 46.204 are to the bottom edge of carriage 46.20—in the embodiment of FIG. 46 they are substantially centrally located.

In use, as illustrated in FIG. 49 (sheet 12 of the Figures), it can be seen that the channel 48.203 allows the carriage and the beam 14 to be oriented at an angle to the vertical, if the beam, carriage are assembled with a short bolt 30. A short bolt being one which will not extend to the inboard surface of the side 12.2 of the post 12. If such an angled arrangement is undesired, a longer bolt 30 can be utilized, which if sized correctly will allow the inboard face 48.111 of the channel 48.203 to be forced into contact with the outboard face of flanges 12.4, as illustrated in FIG. 50, thereby orienting the carriage 48.20 and the beam 14 generally parallel to the flanges 12.4 of the post 12. The angle of orientation of the carriage to the post flange will be determined by the width of the channel 48.203.

The carriage 48.20 of FIG. 48, can be used in an upside down orientation to that illustrated in FIG. 48, as is illustrated in FIG. 51. In the arrangement of FIG. 51, with the aperture 48.22 now being at the top of the carriage 48.20, by connecting with a short bolt 30 through the trough of the W-beam 14, the lower edge of the beam 14 is not in contact with the inboard face of the flange 12.4 and the beam 14 has a downwardly angled orientation. In this arrangement, it is expected that the use of a long bolt 30, due to a much smaller distance to the effective pivot point at the upper end of channel 48.203, will maintain the beam and the carriage 48.20 with a downwardly angled orientation. In some applications this may be a desirable angle.

Figures 52, 53, 54, 55, 56:
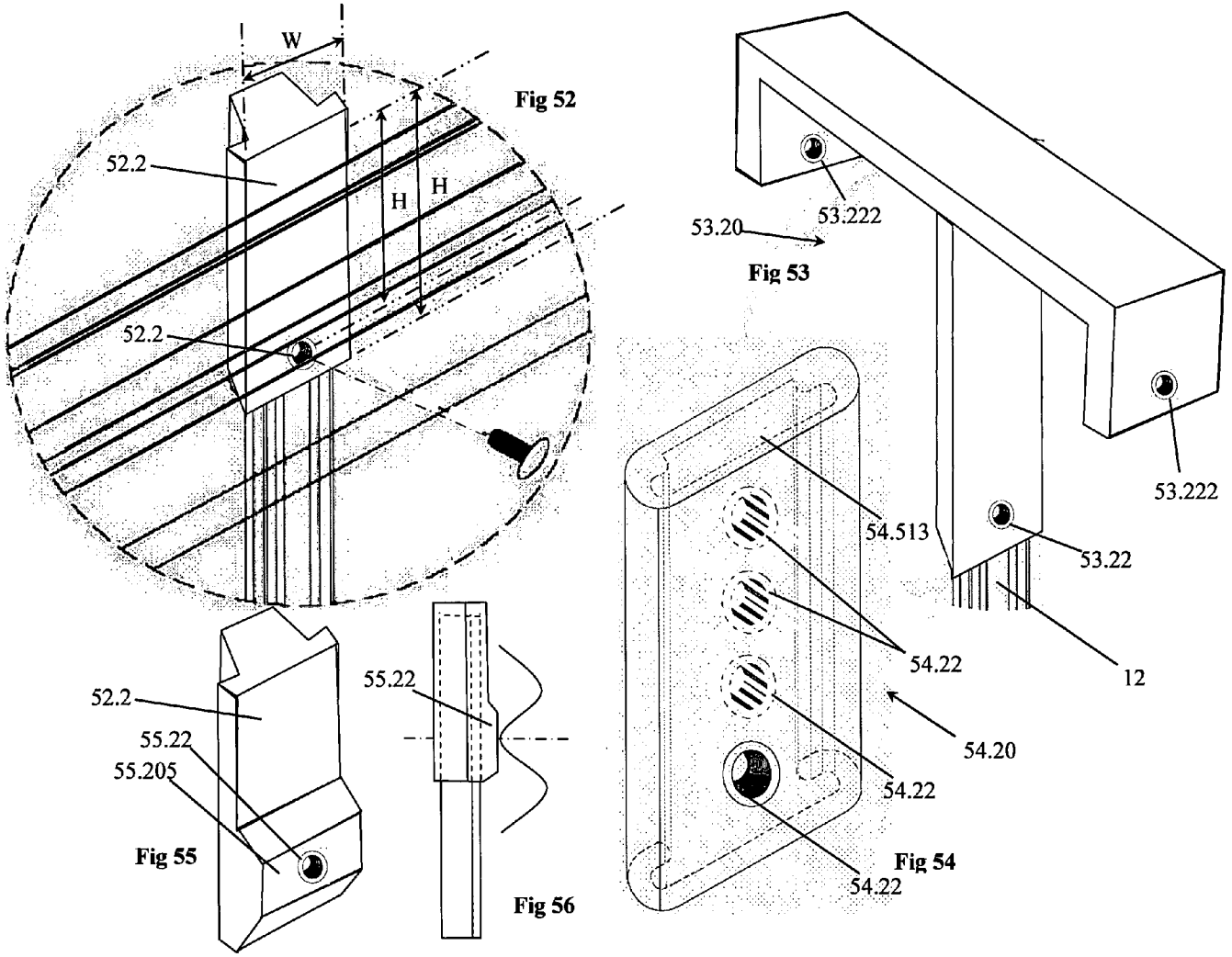

Illustrated in FIG. 52 is a combined cap and carriage 52.20. The carriage 52.20 has a blind aperture in it which has a cross section to receive the post 12 therein. At a lower end of the inboard face of the carriage 52.20 is a threaded aperture 52.22 to receive a short bolt 30 (or a long bolt 30 if desired to control friction and post contact thereby) to mount a beam 14 to the carriage 52.20. The height H measured between the centre of the threaded aperture 52.22 and the under surface of the cap upper face, against which will rest the upper edge of the post 12, will determine at what height the beam 14 will be located at relative to the post 12 upper edge. The time of contact, and thus the amount of energy that can be absorbed by the post 12, between the carriage 52.20 and the post 12 during a collision can be controlled by means of the height H2 between the lowermost edge of the carriage 52.20 and the under surface of the cap upper face, against which will rest the upper edge of the post 12. This height H2 is greater than the width W of the carriage or the width of the post 12. Preferably the height H2 is of the order of 200 mm to 600 mm.

The carriage 52.20, like the other carriages described above, can be freely moving on the post 12 in a disconnection direction, with only weight of components and a small or minor amount of friction to be overcome which originates from components being in contact. If this movement is to be additionally or further limited, then to control the magnitude of the friction forces or the amount of force required to let movement begin between the carriage 52.20 and the post 12, a variety of methods can be used such as those described above, including crimping to engage the flanges 12.4, or use of long bolts 30, or the formation of section changes in the flanges 12.4 to provide an interference fit between the channel in the carriage 52.20 and the flanges 12.4. Another method could be to provide the cross section of the channel inside the carriage 52.20 of a size so that an interference fit with the post 12 is made, requiring the hammering of the carriage 52.20 onto the top of the post 12.

If desired a series of mounting apertures 22 can be formed down the length of the carriage 52.20 so that assemblers can select the appropriate mounting aperture 52.22 (see FIG. 54 where the carriage 54.20 has several mounting apertures 54.22 indicated). This can be particularly useful if long carriages 52.20 are utilized.

The arrangement of carriage 52.20 as illustrated in FIG. 52 would mean that the upper edge of the beam 14 will rest against the upper portion of the carriage 52.20. This can be resolved by the use of washers to provide spacing, alternatively, as illustrated for the carriage 55.20 in FIGS. 55 and 56, the mounting apertures 55.22 are formed in a landing or thicker portion or offset portion, formed as part of the carriage 55.20, so as to provide the required spacing between the upper edge of the beam 14 and the carriage 55.20.

Illustrated in FIG. 53 is a carriage 53.20, which has a vertical post receiving section similar to the carriage 52.20. The carriage 53.20 differs from carriage 52.20 in that it has blocking piece formations 53.511 extending in two directions away from the centerline of carriage 53.20. This is useful to locate the carriage 53.20 to posts inserted into a median strip so that a dual barrier can be formed from two beams 14 being mounted to the carriage 53.20, one to each mounting aperture 53.222. A mounting aperture 53.22 is also provided, but in this instance it need not be used to mount a beam 14. If it is desired to produce a barrier with two beams 14 on one side, one above the other, with one located further inboard than the other with respect to the roadway, the mounting aperture 53.22 can be used to secure one beam 14, while the inboard mounting aperture 53.222 can be used for the other.

While the embodiment of FIG. 53 indicates a post 12 of open hat section, a different section would be more suitable for a dual barrier, due to the directional qualities of the open hat section which may render it unsuitable for this purpose.

Illustrated in FIG. 54 is a carriage 54.20 which is a combination cap and carriage similar to FIG. 52, except that the cap and carriage 54.20 engages only the flanges 12.4 of the post 12 and the upper edge or terminus of the post 12 only. As can be seen by the hidden detail of FIG. 54, the outboard side has a slot formed therein between the free ends or edges of the carriage section to receive the post 12. The underside of the top section 54.513 of the carriage 54.20 will engage the upper edge of post 12. In carriage 54.20, the mounting aperture 54.22 is located at the desired height, but if desired a series of mounting apertures 54.22 can be provided to enable an installer to select the appropriate aperture via which to mount the beam 14.

It will be noted from FIG. 54 that the carriage 54.20 is of a height greater than the width of the carriage 54.20 or the post 12 to which it can be attached.

In FIGS. 52 to 55 the carriages illustrated therein are formed from a single piece, or integrally formed, combination cap and carriage. Whereas in FIGS. 57 to 60 there are illustrated carriages and caps which are separate, and which can be combined to form a combination cap and carriage, for use in the manner described above.

Figures 57, 58, 59, 60:
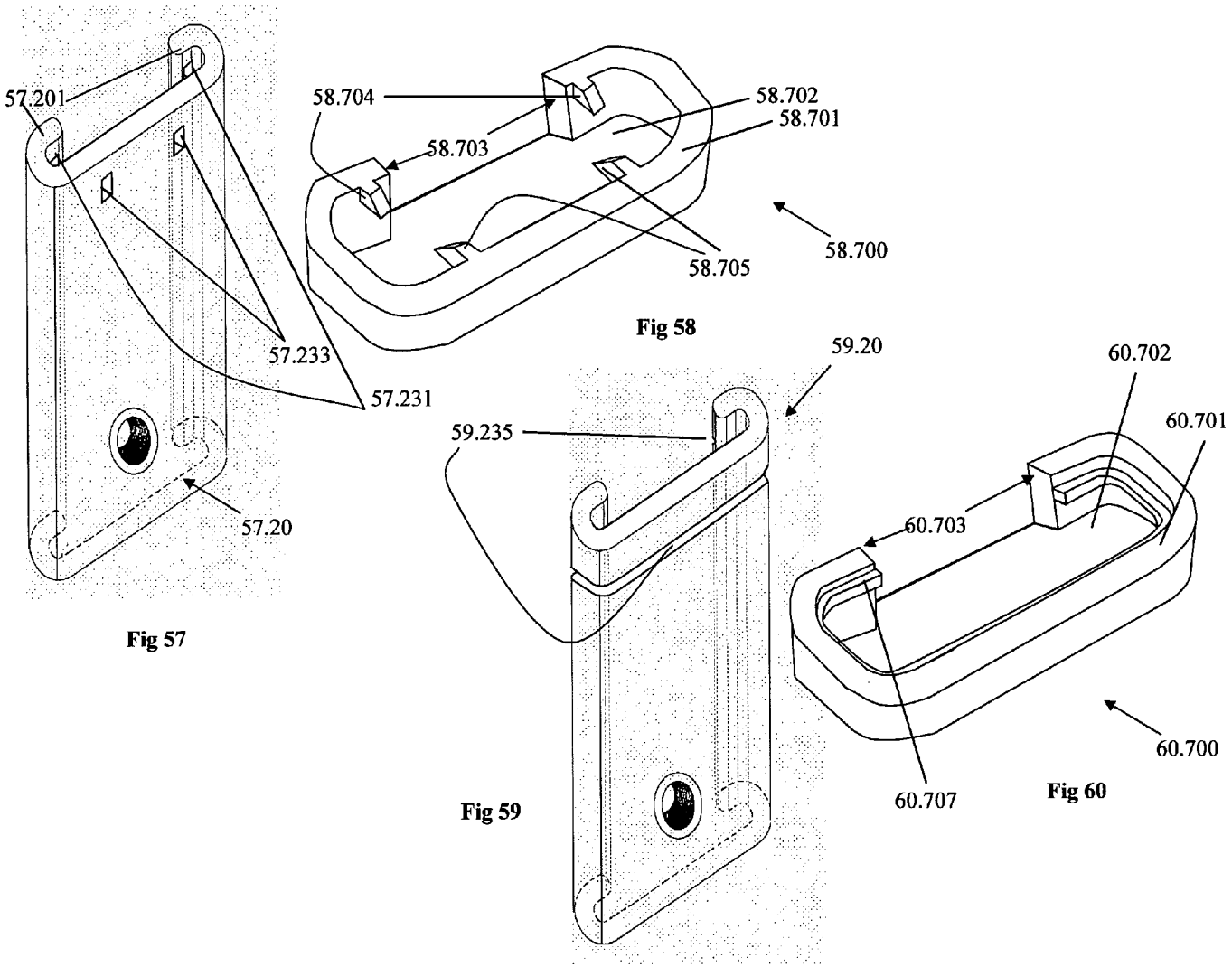
FIG. 57 illustrates a perspective view of carriage which can receive a cap.
FIG. 58 illustrates a schematic perspective view of a cap for use with the carriage of FIG. 57.
FIG. 59 illustrates a perspective view of a carriage having a peripheral channel to receive a matching formation on a cap, to lock the carriage and cap together.
FIG. 60 illustrates a schematic perspective view of a cap for use with the carriage of FIG. 59.
Figure 61:
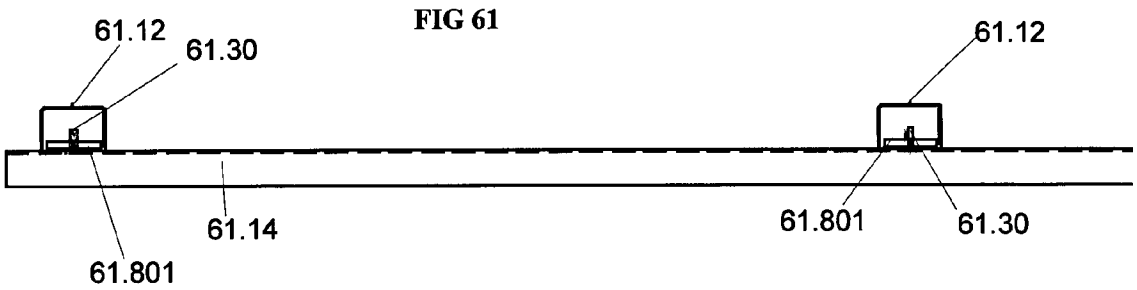
FIG. 61 illustrates a plan view of a post and beam assembly.
Figure 62:
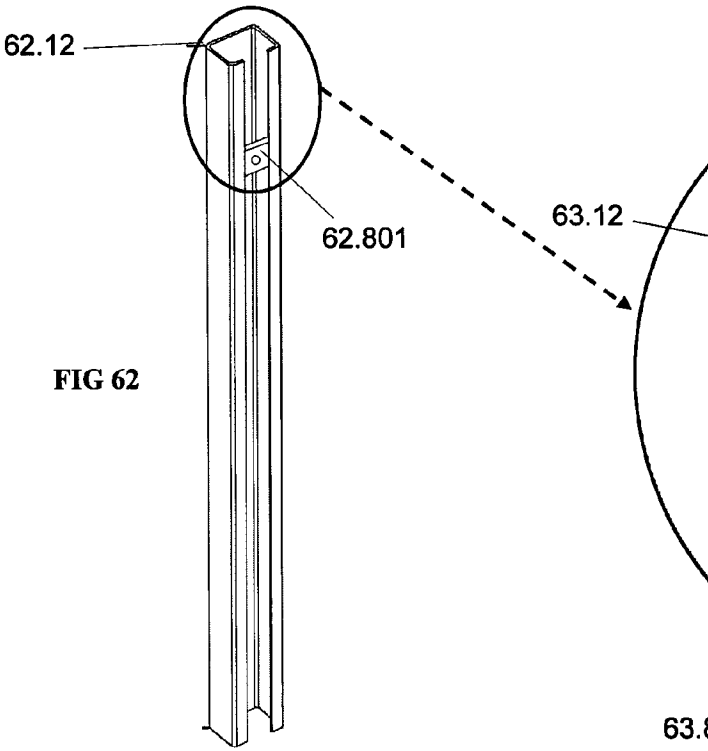
FIG. 62 illustrates a perspective view of a post and a plate that are used in the assembly depicted in FIG. 61.
Figure 63:
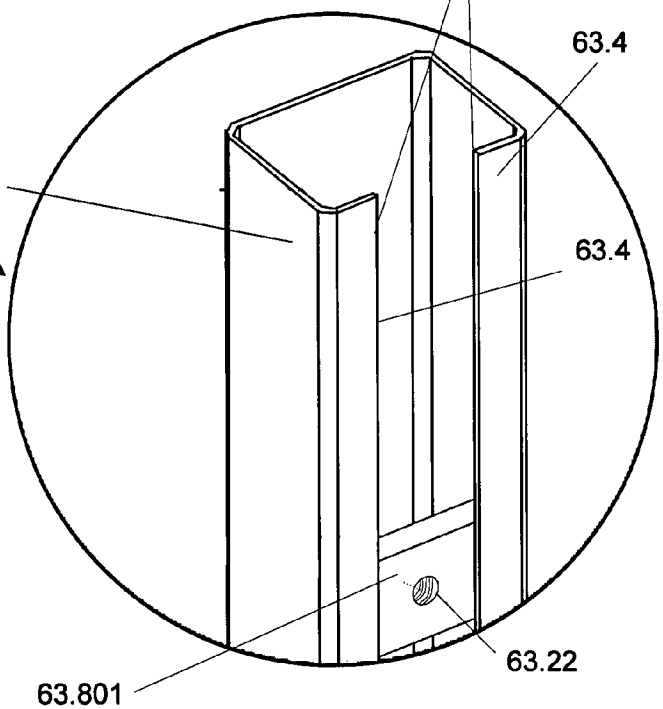
FIG. 63 illustrates a perspective view of a part of the post and plate shown in FIG. 62.

Illustrated in FIG. 57 is a carriage 57.20 which is similar to that illustrated in FIG. 48, but is generally of greater length or height. The carriage 57.20 has generally square apertures 57.231 through the ends 57.201 and apertures 57.233 through the central portion of the carriage 57.20. The apertures 57.231 and 57.233 are sized, shaped and located on the carriage 57.20, so as to match with complementary features on a cap 58.700.

The cap 58.700 is illustrated upside down in FIG. 58, from the orientation it will be used in, as this helps to best illustrate the features of the cap 58.700. The cap 58.700 includes a top portion (illustrated in this orientation as a base) 58.702, around a significant portion of the periphery of which is a wall 58.701 which extends perpendicularly away from the portion 58.702.

The cap 58.700 includes a gap 58.703 which corresponds to approximately the same gap which exists between the free ends or edges 57.201 on the carriage 57.20. These gaps allow the uppermost portions of a post, onto which the combined cap 5070 and carriage 57.20 will be placed, to be received therein.

The cap 59.700 and the internal dimensions of the peripheral wall 58.701 are sized so as to be received within the peripheral wall 58.701 at the upper end of the carriage 57.20. As the cap 58.700 and top of carriage 57.20 are pushed together, inwardly directed projections 58.704, and 58.705 on the cap 58.700, due to their inclined terminations, will force respective portions of the peripheral wall 58.701 away from each other, until further pushing together of the carriage 57.20 and cap 58.700 will eventually align the projections 58.704 with apertures 57.231, and projections 58.705 with apertures 57.233, at which point the projections will enter into the respective apertures. This will lock the cap 58.700 to the carriage 57.20 to form a combination cap and carriage, which will function in the same manner as the integrally formed cap and carriage combinations of FIGS. 52 to 56.

The shear strength of the projections 58.705 and 58.704 with respect to the peripheral wall 58.701, from which they project, will determine the maximum weight of beam that can be supported by the combined cap and carriage combination. The projections and apertures can be sized and shaped so as to best bear this static load.

Illustrated in FIG. 59 is another carriage 59.20, which differs from the carriage 57.20 by having a peripheral groove 59.235 which extends all around the outer faces of the carriage 59.20. This groove 59.235 receives a lock flange 60.707 on the cap 60.700. The cap 60.700 is very similar to the cap 58.700, except that the locking mechanism, in the form of an internally projecting peripheral lock flange 60.707 is provided. The lock flange 60.707 is shown have a generally rectangular cross section, but like the projections in FIG. 58, it too can have an inclined surface to facilitate the engagement of the cap 60.700 with the top of the carriage 59.20.

As the cap 60.700 functions in much the same way as does the cap 58.700, the combined cap 60.700 and carriage 59.20 will also function in much the same way as will the combined cap 58.700 and carriage 57.20 will.

An advantage of the use of a cap and carriage combination where the cap is not integral with the carriage is that less inventory is required, whereby an installer can choose whether to combine them or use the carriage without the cap. Another advantage is that the cap helps to finish off the end of the carriage which may be exposed when a roadway barrier or guard rail system is assembled. While the caps of FIGS. 58 and 60 are shown with generally sharp corners between the portions 58.702 and the wall 58.701, these caps can be made with more rounded formations to as to minimize protruding sharp edges. The caps of FIGS. 58 and 60, depending upon the shear strength required, can be made a variety of materials, such as from any appropriate material, such as polymeric, steel or other metal.

The guardrail systems described above, like all roadway barrier or guard rail systems, is installed along the side of a roadway. Roadway barrier or guard rail systems function by both absorbing energy of impact of a colliding vehicle and also by directing or re-directing a colliding vehicle. The guardrail systems described above when impacted by a vehicle will be such that the posts 12 in all likelihood will be bent in an outboard direction or bent in the direction of impact by a vehicle when such a vehicle impacts beam 14, with the beam 14 also being deformed and thus also absorbing impact energy.

Further, as the impact forces from the impacting vehicle against the beam 14 cause the post 12 to bend in an outboard direction or in the direction of impact by a vehicle, if sufficient impact force is applied to the system to overcome: a) the form, weight and inertia of components and a minor amount of friction from the geometry, that is, the carriage is not intentionally restrained from moving along the post and or b) the forces needed to break or overcome any detents or obstructions or friction increasing formations; then the carriages 20, 43.120, 46.20 will slidingly move with respect to the post 12, with the post acting as a track for the carriage, to maintain the beam 14 at the impact height with respect to the vehicle, or relatively close thereto, to continue to engage the vehicle thereby continuing to dissipate further energy. The action of the carriage moving along the post helps the post to remain in contact with or remain immediately behind the beam 14, ensuring that the post 12 can continue, for as long as possible, to absorb further energy of impact.

If the impact force is sufficiently large, the post 12 may fracture, or the beam 14 and associated carriage can completely disconnect from the respective post, in which case the post 12 may not assist further to absorb further energy. In this scenario the expectation is that the beam 14 will be maintained at the impact height or close thereto which allows the beam 14 to continue its energy absorption role after disconnection from a post, or the fracture of a post, in which case posts adjacent a broken post will absorb further energy.

An feature of the carriages 20, 46.20, or 48.20 or other carriages illustrated and described herein, is that the carriage allows the spacing of the edges of the beam 14 away from the inboard faces of the flanges 12.4 of the post 12, as is illustrated in FIGS. 26 to 29 and 49 and 50. This can be helpful in the event of an impact in that there is less of a tendency of the beam 14 to fail due to beam or rail tearing, which might otherwise occur during impact in the case of the edges of the beam 14 resting up against the post 12 in a pre-impact assembly.

FIGS. 61 to 66 illustrate a further mechanism for controlling the amount of force that enables the beam 14 to move along the post 12 once a collision occurs, by generating additional friction between the rail 14 and the post 12. This mechanism is suitable for use with, for example, a C-section post 12, where the flanges 63.4 of the post 12 are inwardly directed, as opposed to being outwardly directed as in an open hat-shaped post shown in FIG. 1. The control mechanism is enabled by the use of a member 63.801, such as a plate, which has a threaded hole 63.22 which can receive a bolt 61.30. The member 63.801 extends across the width of the space between the free edges 63.802 of the flanges 63.4.

The member 63.801 is sized and shaped so that providing the shape of the post 12 is not changed during the collision, the member 63.801 will not pass through the space between the free edges 63.802, as the member 63.801 moves along the post 12. In this instance the member 63.801 is of a generally rectangular cross section and is of a width which is less than the internal width of the post.

The bolt 61.30 is passed through a corresponding hole provided in the beam 14, and then into the hole 63.22 to secure the beam 14 on the post 12 by means of a clamping force. This clamping force is generated between the roadside face of the member 63.801 which will bear against the inward facing sides of the flanges 63.4 and the outward facing side of the flanges 63.4 will bear against the edges and surfaces of the rail or beam 14. This clamping force will generate friction between the post 12, the rail 14 and the member 63.801, thereby determining the force needed to begin movement of the combined rail 14 and member 63.801 relative to the post 12.

As the flanges 614 are interposed between the beam 14 and the plate 61.801, the amount of torque by which the bolt 61.30 is tightened to the plate 63.801 determines the friction force generated and thus the collision force that will be sufficient to break or overcome the clamping force. Once the clamping force is overcome, the beam 14 and the plate 63.801, guided by the free edges of the flanges 63.4 and the shank of the bolt 61.30 travelling therethrough, are moved along the post 12 by the collision force.

Other features and mechanisms described in respect of previously described embodiments and drawings, can be used with the system of FIGS. 63 to 66. For example, a long bolt 30 which reaches the inboard surface 12.2 of the post 12 of FIG. 63 will increase the required collision force, or a bolt through the flange will position plate 63.801 at a desired height. Other examples include crimping, applying a compressive force to the plate and the beam, and recessing the inboard surface 12.2 of the post 12 and using a long bolt 30.

The threaded hole 63.22 can be a through hole or a blind hole. If it is a blind hole, the blind hole 63.22 can be configured so that the length of the shank of the bolt 61.30 is wholly taken up by the thickness through the beam 14, the thickness through the flanges 61.4, and the depth of the hole. This offers a means of applying a predetermined clamping force which clamps the beam and the plate 63.801 onto the post 12, which is based on the respective thicknesses of the rail 14, flanges 64.3, the length of the bolt hole 63.22 and the bolt 61.30.

Figure 64:
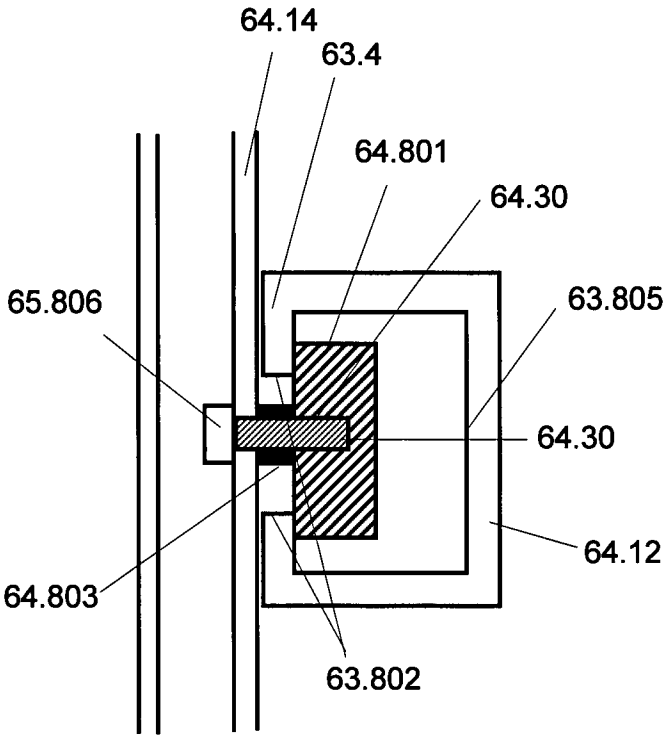
FIG. 64 illustrates a cross section view of a post and beam assembly, with a washer located between the beam and the plate.

As shown in FIG. 64, a washer 64.803 can be used to control the spacing between the post 12 and the beam 14. If there is no washer or if the washer 64.803 is thin, there is more friction between the beam 14 and the post 12. A thicker washer 64.803 leads to less friction because the additional friction can be prevented by preventing the clamping of the post 12 between the beam 14 and the carriage. The use of washers therefore is another way of controlling the friction generated between the components and thus the collision force required to move the beam 14 relative to the post 12. If no clamping force is provided, the location of the carriage and thus the beam 14 can be established by means of a separate support or detents or bolts on the post preventing the carriage from moving below a desired height.

Figure 65:
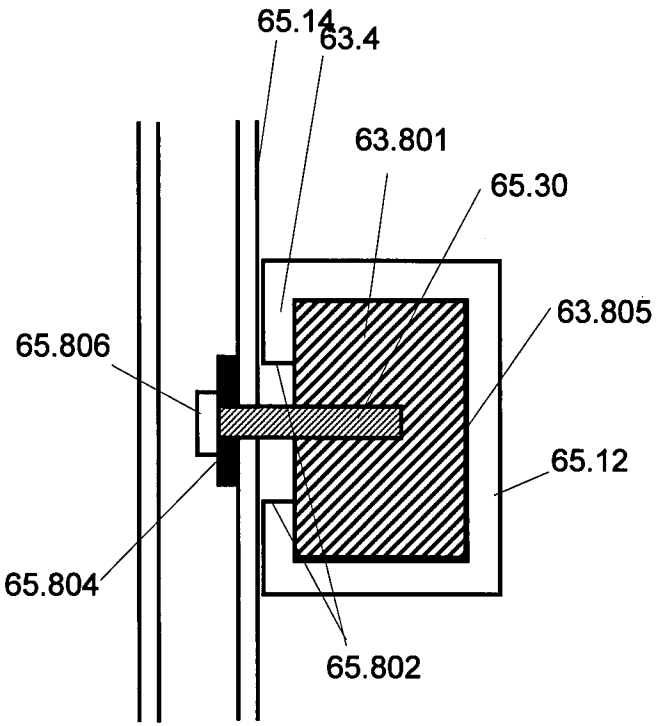
FIG. 65 illustrates a cross section view of a post and beam assembly, with a washer located outboard of the beam.

As shown in FIG. 65, the plate 63.801 can be sized so that it reaches the interior surface of the back portion 65.805 of the post 12. This creates friction between the plate 63.801 and the post 12 between other faces of these two components. The plate 63.801 can have a cross section that is substantially the same as the internal area of the post 12, that is, the plate 63.801 can fill the interior of the post 12. This arrangement further increases the friction in the system by making contact with more surfaces and thus increases the collision force required to start relative motion. The size of the plate 63.801 can also be varied to control the required collision force. This is because a larger contact area between the plate 63.801 and the flanges 63.4 introduces more friction into the system.

There can also be a washer 65.804 located outboard of the beam 14. For instance, there can be a round washer 65.804 located around the nut 65.806 of the bolt 30. The round washer 65.804 protects the beam 14 from being bitten into by any angular edges of the nut 65.806, for instance when a hexagonal nut 65.806 is used.

Figure 66:
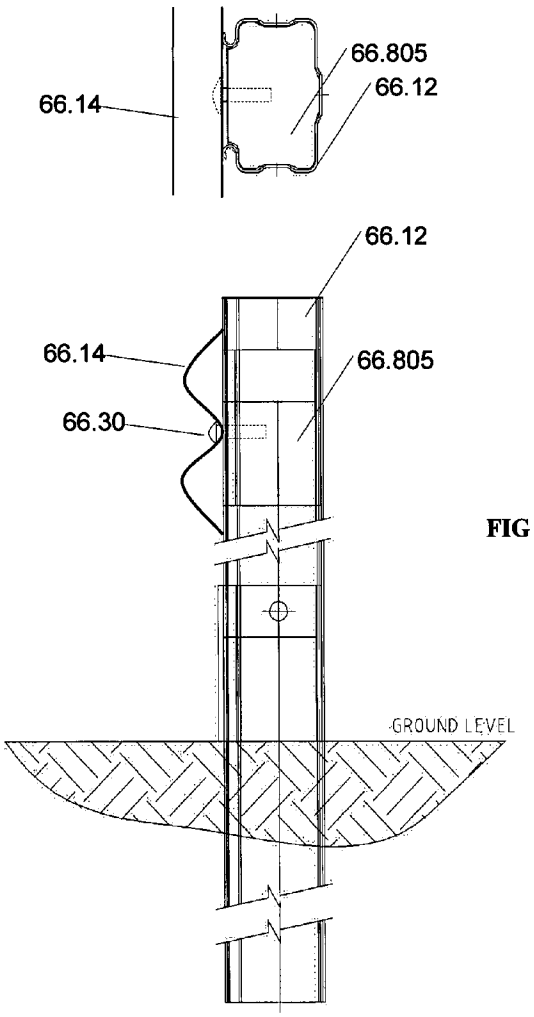
FIG. 66 illustrates a post and beam assembly that includes a plate, where the post is an O-post.
Figure 70:
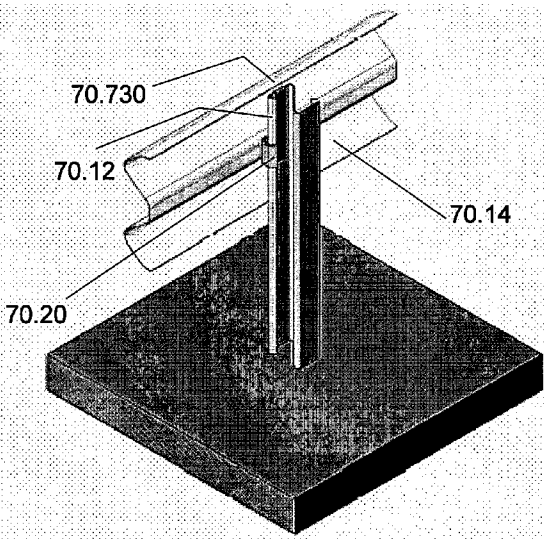
FIG. 70 is a perspective view of the assembly of FIGS. 67 to 69.
Figure 69:
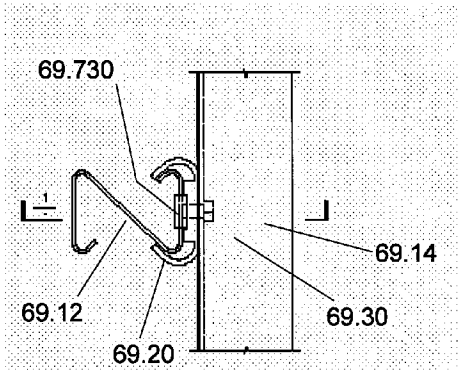
FIG. 69 is a plan view of the assembly of FIG. 68 showing section lines which produce FIG. 68.
Figure 67:
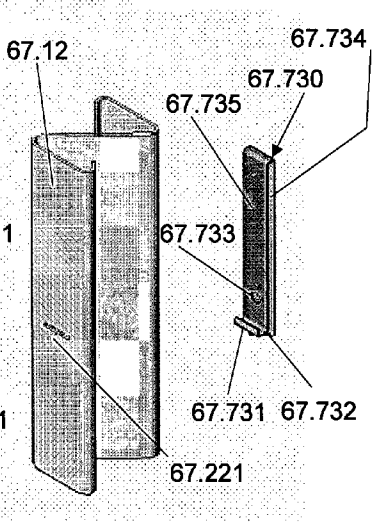
FIG. 67 illustrates an exploded view of a post, carriage and beam assembly
Figure 67:
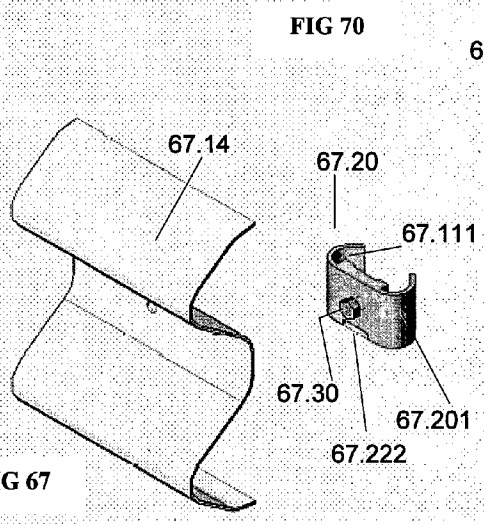
Figure 68:
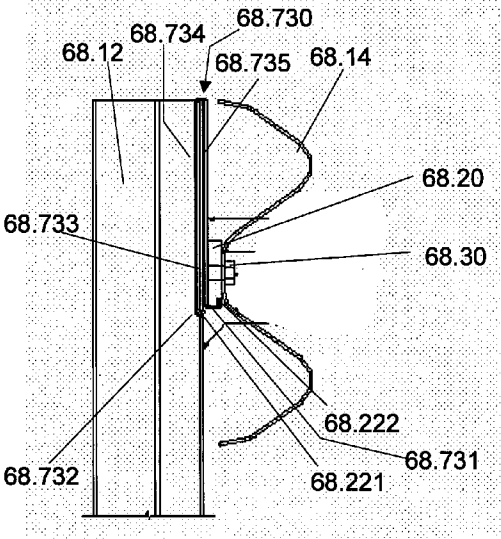
FIG. 68 is a sectional view through the assembly of FIG. 67.
Figure 74:
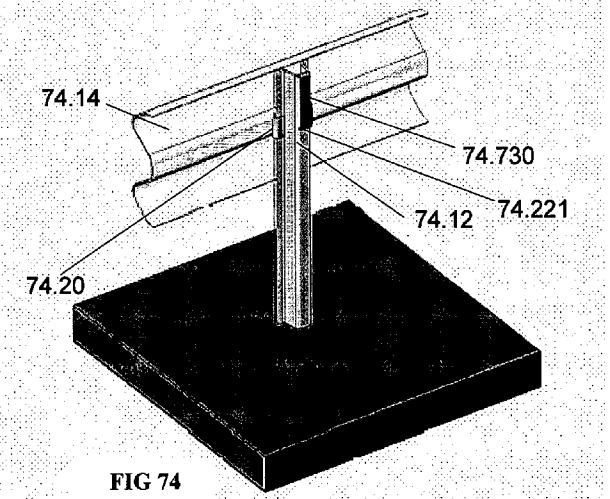
FIG. 74 is a perspective view of the assembly of FIGS. 71 to 73.
Figure 73:
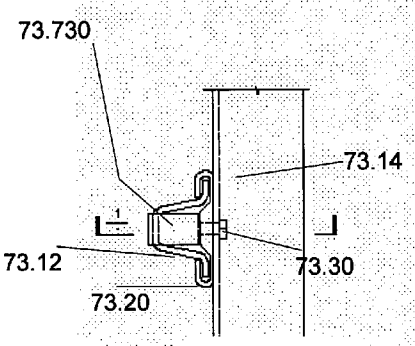
FIG. 73 is a plan view of the assembly of FIG. 72.
Figure 71:
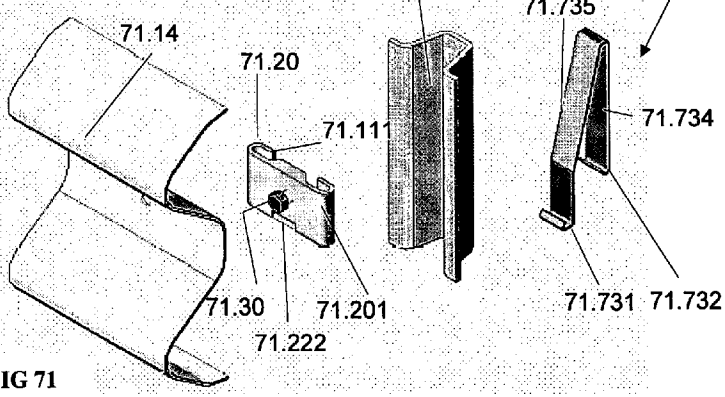
FIG. 71 is an exploded perspective view of an assembly of a beam, carriage and open hat cross section post and yielding mounting strap.
Figure 72:
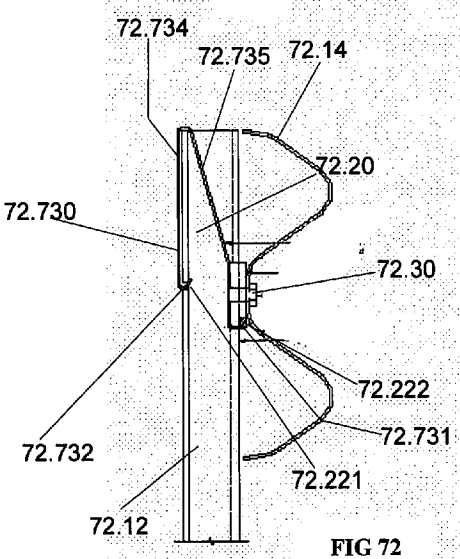
FIG. 72 is a cross section through the assembly components of FIG. 71 showing section lines which produce FIG. 72.
Figures 75, 76, 77, 78:
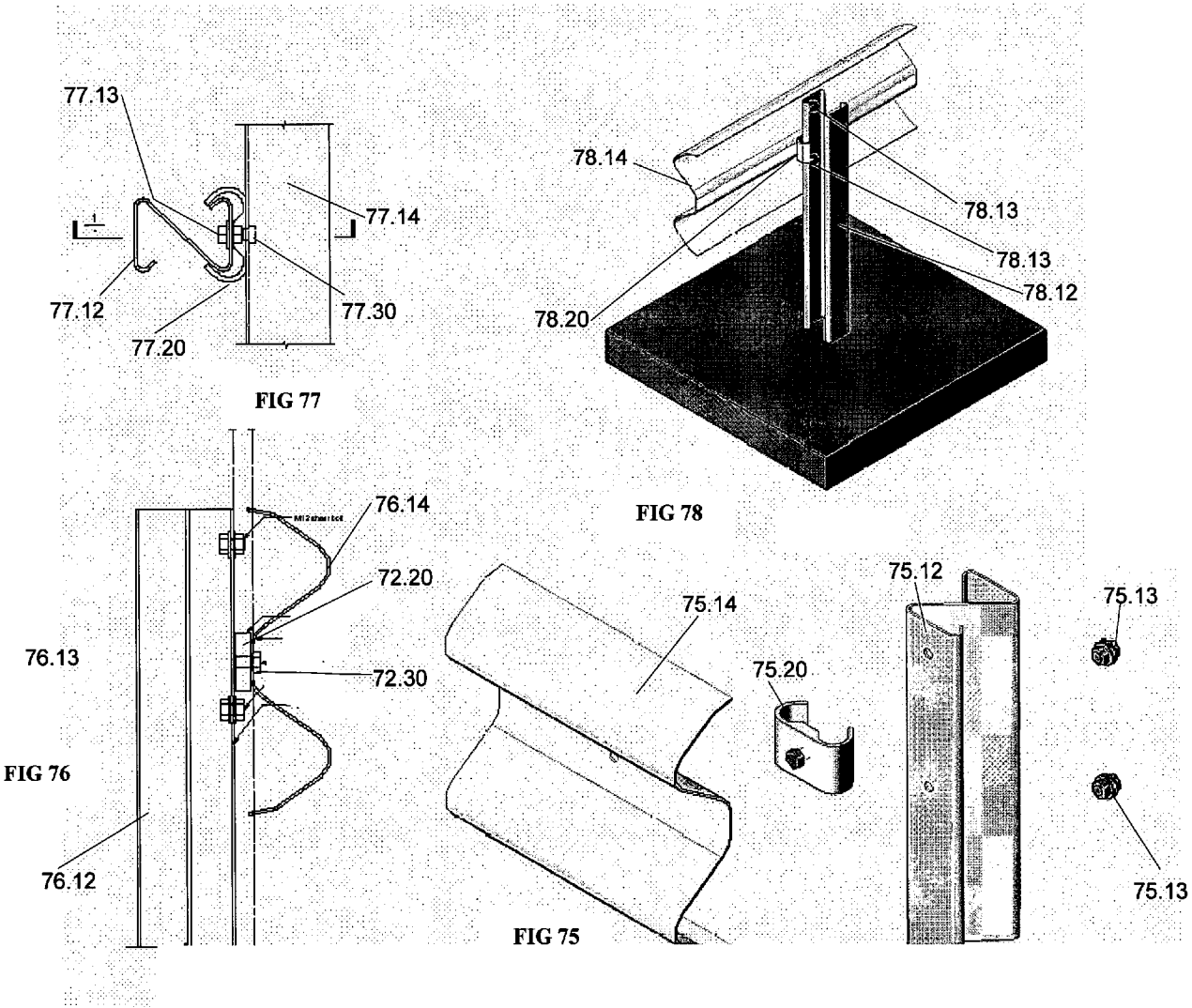
FIG. 75 is an exploded perspective view of a rail, carriage, 'Z' post and shear bolts assembly.
FIG. 76 is a cross section through the assembly of the components of FIG. 75.
FIG. 77 is a plan view of the assembly of FIG. 76 showing the section lines which produces FIG. 76.
FIG. 78 shows a perspective view of the assembly of the components as illustrated in FIG. 75 to 77.
Figures 79, 80, 81, 82:
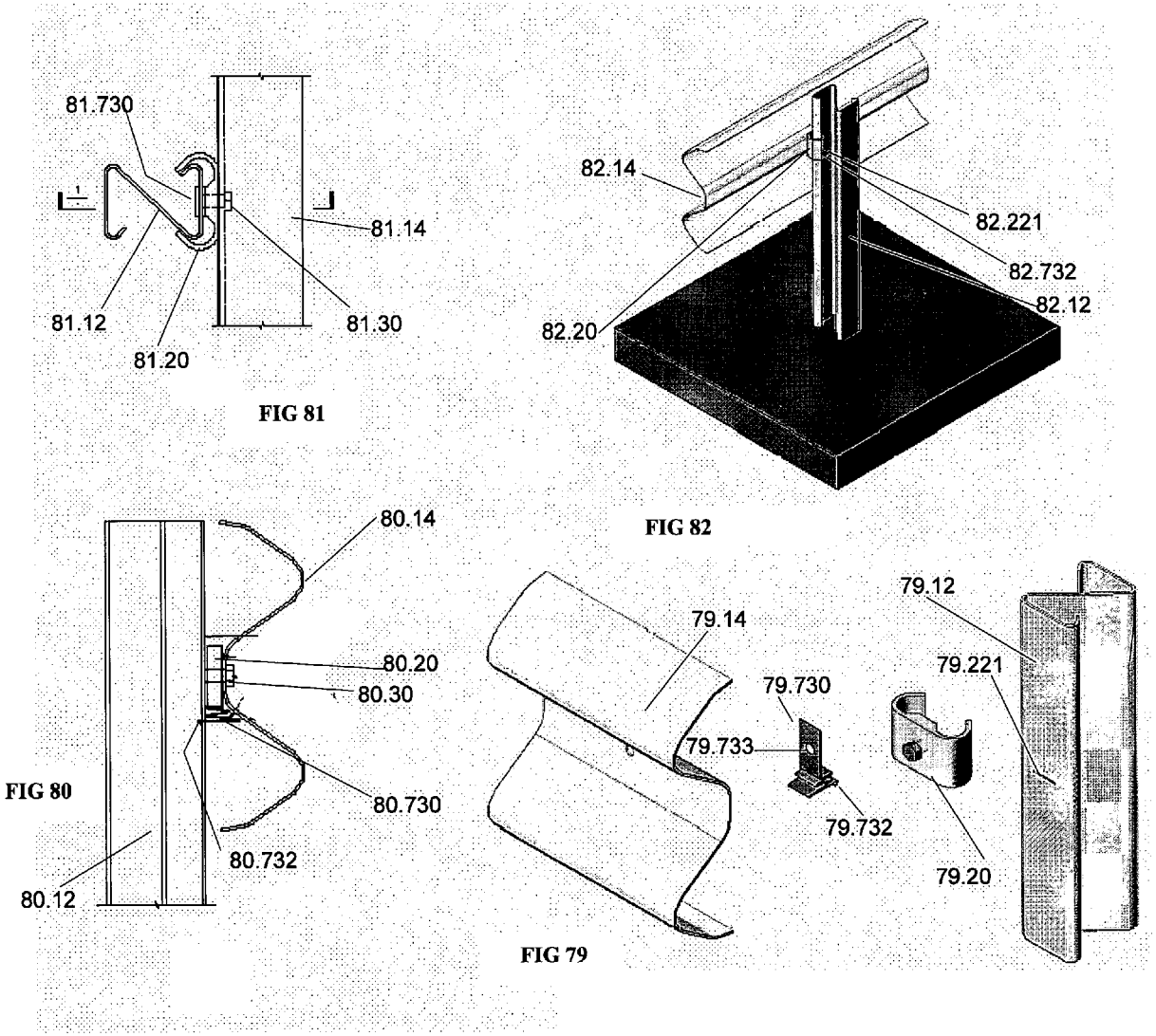
FIG. 79 illustrates an exploded perspective view of a rail yielding strap, carriage and 'Z' post assembly of a further embodiment.
FIG. 80 is a cross section through the assembly of the components of FIG. 79.
FIG. 81 is a plan view of the assembly of FIG. 80 showing the section line which produces FIG. 80.
FIG. 82 illustrates a perspective view of the assembly of the components of FIG. 79 to 81.

Illustrated in FIG. 66 is an embodiment similar to that of FIGS. 37 and 38 and also similar to that of FIG. 65, wherein the plate or member 66.805 is of a matching external profile to the internal profile of the O-post 12, but as it is not as co-extensive as the internal depth of the post, it will provide clamping of the post between the rail 14 (upper and lower edge and middle trough) and the member 66.805 of the outer curved free ends or edges of the O-post 12. Such plates can be manufactured from polymeric material with embedded threaded sleeves to receive the bolts or manufactured from steel for fire prone areas.

Illustrated in FIGS. 67, 68, 69 and 70 is a carriage 67.20 which is similar to previous embodiments. In these Figures the carriage 67.20, 68.20, 69.20 and 70.20 engages a 'Z' post 67.12 in manner similar to the previously described embodiments with projections or arms 67.201, curved inboard faces 67.111 engaging or wrapping around the curved outer periphery of the post 67.12, to provide a guide or track for the carriage to move relative to.

The carriage 67.20 in the embodiment of FIGS. 67 to 70 is suspended from the top forward edge of the 'Z' post 67.12 by means of a yielding strap 67.730. This hanger or strap 67.730 is of a substantially U-shaped form having a forward downwardly descending leg 67.735 and a rear downwardly descending leg 67.734. At the base of the leg 67.734 is a post engagement hook 67.732, whereas on the forward leg 67.735, at the base thereof, is a hook 67.731 which receives and clamps a cut out portion 67.222 at the forward base edge of the carriage 67.20. Both hooks 67.731 and 67.732 are forwardly extending and as can be seen from FIG. 68 the hook 68.732 passes through, from a rear to front direction, a transverse slot 67.221, 68.221 which is formed in the post 67.12.

The strap 67.735 also includes, at an appropriate spacing from the hook 67.731, an aperture 67.733 to enable the shank of the bolt 68.30 to pass through and to prevent a portion of the bolt from pushing the carriage off the strap 67.730. By also allowing the bolt to apply a force onto the outer forward face of the post 67.12 the interaction between the outside edges of the post being captured by the arms 69.201 creates three locations of friction in the assembly, namely between the bolt shank and the front face or surface of the post 67.12 and between the contact surfaces 67.111 and the outboard facing surfaces of the post 67.12. If the bolt 68.30 does not create friction against the surfaces of the post, then the bolt 68.30 passing through the aperture 67.733, together with the interaction with the hook 67.732 anchoring the strap 67.735, will allow the leg 67.735 to deform, in the event of a collision, thus absorbing impact energy.

The locating and yielding strap 67.730 also serves to locate the beam or bather rail 67.14, 68.14 at a correct or desired height above the ground if the post 70.12 is inserted into the ground so that sufficient height protrudes above ground level. The 'Z' post 67.12 is particularly adapted for "pile driving" into the ground so that sufficient depth of insertion into the ground is achieved to allow the post to absorb collision impact. By controlling the depth of the insertion of the post, the rail or beam height will be located at the same distance down from the top of each post.

In a variation of the assembly described with respect to FIGS. 67 to 70, the bolt 67.30 can pass into or near to the aperture 67.733, but not engage the front face of the post

67.12. In such an arrangement the yield strength of the hook 67.732 and or the connection between the carriage and hook 67.731 will determine the timing or force of release or movement of carriage 67.20 relative to the post 67.12 in the event of a collision.

If desired a combination of friction and hanger yield strength can be used to predetermine the movement or separation force which needs to be transmitted during a collision, before movement, and or separation of the carriage, relative to the post occurs.

Illustrated in FIGS. 71 to 74 is a similar system to that disclosed and described with respect to FIGS. 67 to 70 the difference being that an open hat shaped post 71.12 is utilized and the locating strap 71.730 has an N-shape configuration to take into account the depth of the open hat section of the post 71.12. In this embodiment the forward strap of the location strap 71.730 does not include a hole therethrough such as hole 67.733.

With respect to both of the embodiments of FIGS. 67 to 70 and 71 to 74 the hook 72.732 and hook 68.732 will be forced out of respective apertures 72.21 and 67.221 in the event of a collision with the barrier or beam 72.14 or 68.14 and movement of that beam and the carriage will occur relative to the post. The breaking force at which the hooks 67.221 and 72.221 will free themselves from of their respective apertures when assembled, in addition to any friction which may be in the assembled system, will determine the point at which sufficient force to cause relative movement between the beam 14 (and carriage 20) and post 12 will occur.

An advantage of the longer strap embodiments of FIGS. 67 to 70 and 71 to 74 is that while the posts 12 may be inserted to different depths, the beams 14 can be assembled at different heights relative to the top edges of the posts, by supplying a range of straps 67.730 to 71.730, where the lengths of the legs 67.734 and 71.734 are all the same length, while the legs 67.735 and 71.735 are of different lengths so as to locate the base of carriages 67.20 or 71.20 above or below the slots 67.221 or 72.221 in the posts, as required on a case by case basis by the assembler in the field.

Illustrated in FIGS. 75 to 78 is a barrier system similar to that of FIG. 14 where an upper shear bolt 75.13 is positioned in the forward face of the beam 75.12 and a lower shear bolt 75.13 prevents the carriage 75.20 from moving too far down the post 76.12. The upper shear bolt 75.13 can be of a predetermined shear strength so that the carriage 75.20 will only shear off the shear bolt 75.13 when a predetermined amount of force has been applied to the beam during a collision.

Illustrated in FIGS. 79 to 82 is an embodiment which utilizes a hanger 79.730 which has a hook 79.732 at its lower end for engaging into the slot 79.221 and together with the carriage 79.20 which keeps the beam 79.14 at a predetermined height on the front face of the post 79.12, by preventing the beams 80.14 and carriage 80.20 from moving too far down the post 80.12. The hanger 79.730 includes a leaf or "concertina" spring component to allow some adjustment for the beam relatively to the post before the bolt 80.30 is tightened sufficiently to provide a friction mounting relative to the post 80.12. As the hanger 79.730 has an aperture 79.733 through it the bolt 80.30 will pass through the aperture 79.33 so that the shank end of the bolt 80.30 will bear against the surface of the beam 80.12.

The hanger 79.730 can be manufactured in a range of heights and or in a 180° orientation (that is the hook is configured to allow the concertina to hang down from the slot 79.221) so as to allow an assembler in the field to locate the beam 14 at a desired height relative to either the top edge of the post or the slot 79.221.

The "concertina" or gathered component on the hanger 79.730 also provides a store of strap material to control the "run out" of the concertina in the event of a collision. This will, in assisting in absorbing energy of collision, and once the gathered concertinaed strap material is fully stretched away from the slot 79.221, or pushed there past, then the hook 79.732 can break free of slot 79.221 allowing full separation of carriage 79.20 from post 79.12.

Illustrated in FIGS. 83 to 86 is a capping system which provides a cap 83.700 which is similar to the cap systems illustrated in FIGS. 57 and 58. A difference between the two embodiments is that the cap system 83.700 utilizes four holes 83.231 in the forward and rear faces of a Z-shaped post 83.12, whereas the cap systems of FIGS. 57 and 58 are applicable to the carriage. Both the systems illustrated in FIGS. 57, 58 and 83 to 86 are equally applicable to directly to posts or to carriages.

Figures 83, 84, 85, 86:
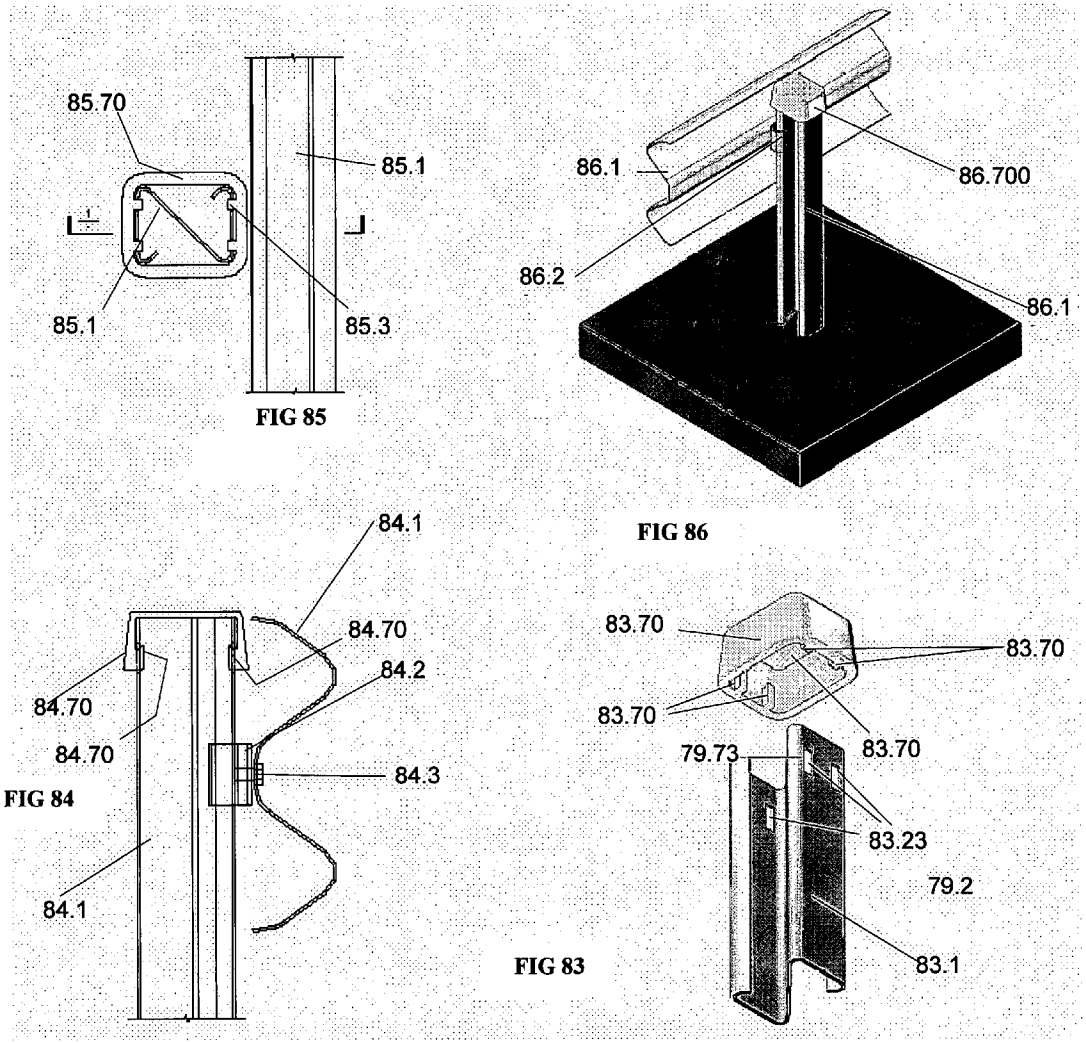
FIG. 83 is an exploded perspective view of a cap and 'Z' post assembly.
FIG. 84 is a sectional view through the components of FIG. 83.
FIG. 85 is an underneath view of the apparatus of FIG. 84 showing the section line which produces the view of FIG. 84.
FIG. 86 is a perspective view of the assembly of the components of FIGS. 83 *to* 85.
Figures 87, 88, 89, 90:
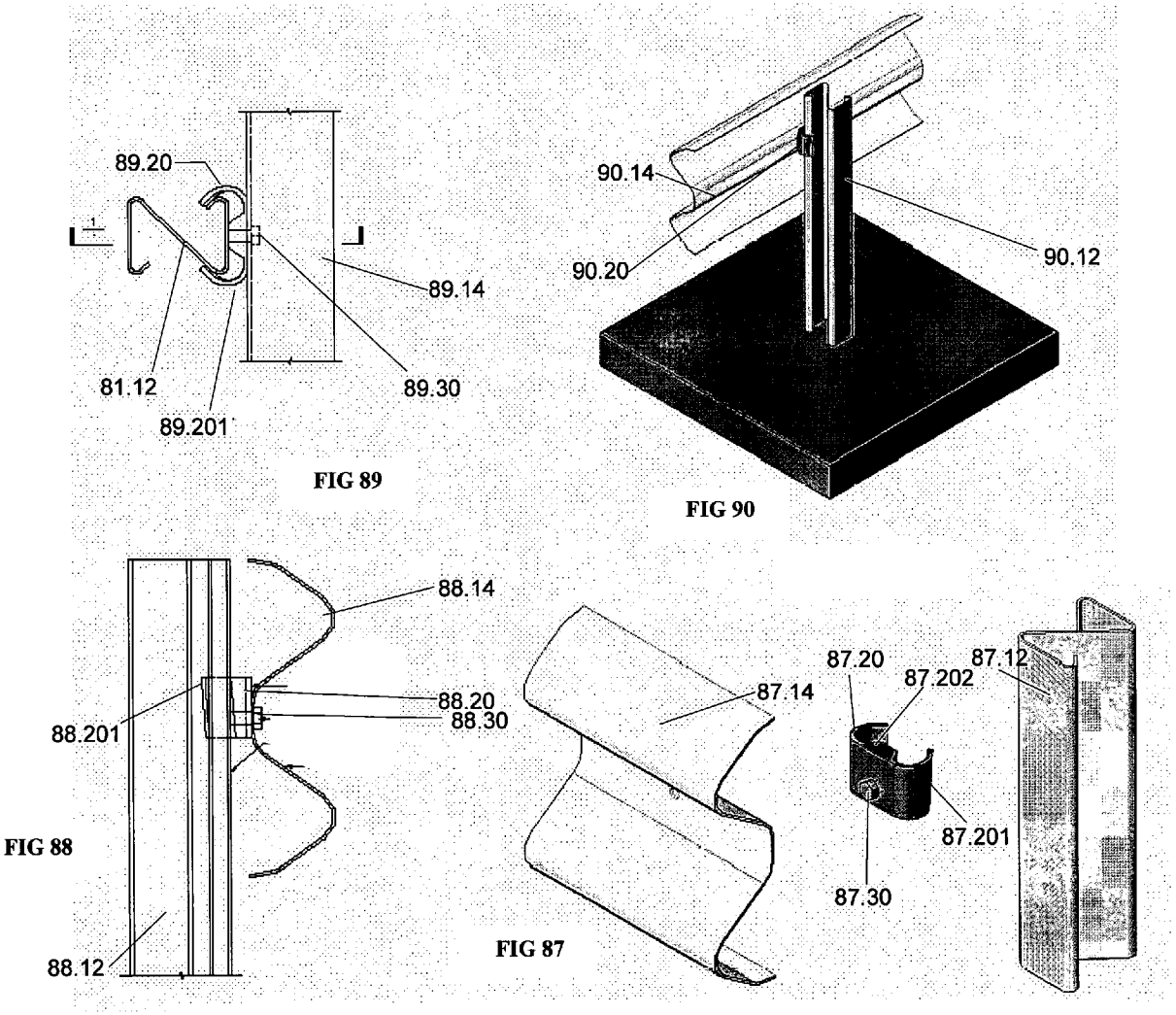
FIG. 87 is a exploded perspective view of a beam, carriage and 'Z' post assembly of another embodiment.
FIG. 88 is a cross section through the assembled components of FIG. 87.
FIG. 89 is a plan view of the assembly of FIG. 88 showing the section lines which produce the image of FIG. 88.
FIG. 90 is a perspective view showing the assembly of the components of FIGS. 87 to 89.
Figure 94:
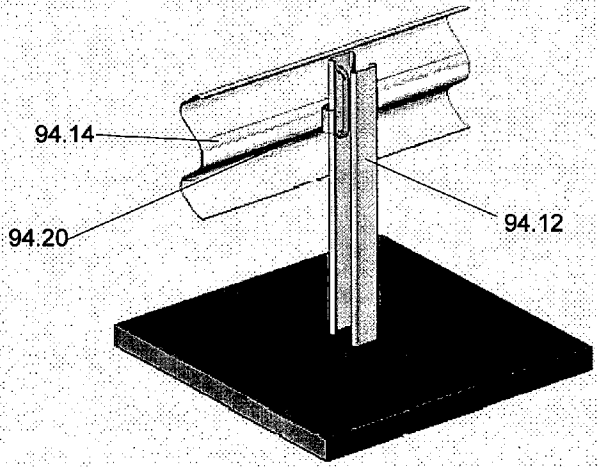
FIG. 94 illustrates a perspective view of the assembly of the components of FIGS. 91 to 93.
Figure 93:
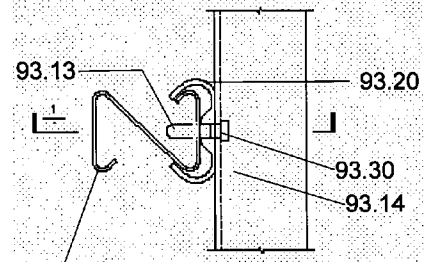
FIG. 93 illustrates a plan view of the assembly of FIG. 92 showing the section lines which produces the illustration of FIG. 92.
Figure 91:
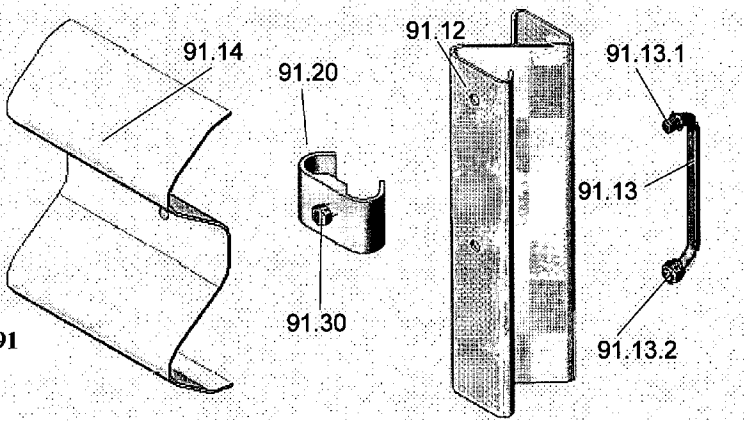
FIG. 91 illustrates an exploded perspective view of a beam, carriage, 'Z' post and U-bolt assembly of another embodiment.
Figure 92:
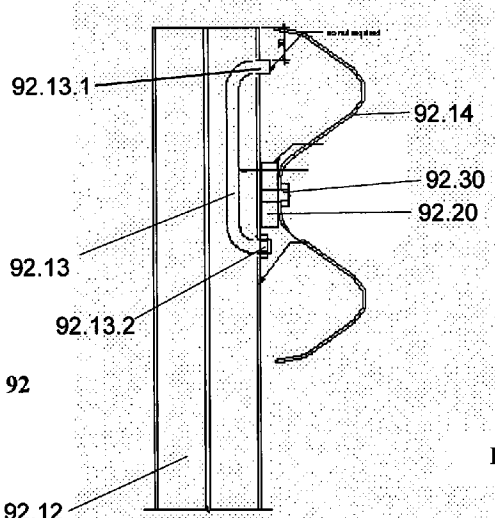
FIG. 92 shows a section through the assembly of the components of FIG. 91.

Another difference between the system of FIGS. 83 to 86 and that of FIGS. 57 *and* 58 is that the protrusions 83.704 and 83.705 have hooked ends as can be seen in the cross section of FIG. 84 so as to engage upper edges of the holes 83.231 the post, to provide extra resistance against movement of the carriage 86.20 relative to the post 86.12 and to help assist in controlling the separation force required before the carriage 86.20 separates from the post 86.12.

Illustrated in FIGS. 87 to 90 is a post, carriage and beam system which operates in a manner similar to that of FIGS. 49 and 50. In this embodiment the arms 87.201 on the carriage 87.20 have a tapered shape when viewed from the side, as is best seen in the cross section of FIG. 88. This tapering provides an "inclined" passage for the sides of the post 88.12 to engage. By providing appropriate torque to the mounting bolt 88.30, the upper edge of the bulbous portion 87.202 will be a point of pivoting and a point of high friction will result. This is also the case at the lower rearward edge of the arms 87.201. By providing such high levels of force at contact lines it is expected that the amount of friction to be overcome, to produce movement of the beam 88.14 and carriage 88.20 relative to the post 88.12, can be controlled or at least set to occur at a predetermined range of collision forces.

Illustrated in FIGS. 91 to 94 is a post, beam, and carriage system which is similar to that of FIGS. 75 to 78 except that the two shear bolts 75.13 are replaced with a single U-shaped bolt 91.13 which allows for easy assembly and requires only one nut, either on the top or on the bottom of the U-shaped bolt 91.13. Illustrated in FIGS. 92 and 91 the bolt is on the lower spigot which is required for assembly. It is preferable that the nut is placed on the lower spigot of the bolt 91.13 to prevent inadvertent dropping of the rail 93.14 and its carriage 91.20. By this means the rail can only move upward relative to the post and will shear off the upper end of the U-bolt (which may be provided with a line of weakness) or the upper end will be forced into the aperture of the post that it passes through, as the carriage passes over the upper end 91.13.1. An inclined surface on the carriage can be readily provided to effect this, such as is described below with respect to FIGS. 95 to 101, which includes an inclined surface 96.191. Preferably the U-bolt 91.13 (one end threaded the other not), as seen best at the upper portion thereof in FIG. 91, has at both its ends a flange to prevent or control the U-bolt 91.13 from passing too far through the front face of the post 91.12.

If desired, the end 91.13.1 can have an inclined plane formed thereon, so that the carriage 91.20 can slide there over against the "spring" resistance produced by the U-shaped bolt being cantilevered with respect to bolted end 91.13.2. The provision of such an inclined plane, its angle (to the vertical or horizontal) and even orientation can assist in adjusting the additional force required for the carriage to pass over the end 91.13.1 and thus the amount of delay for the carriage to break contact with the post and or the amount of force required for this to occur.

Figure 96:
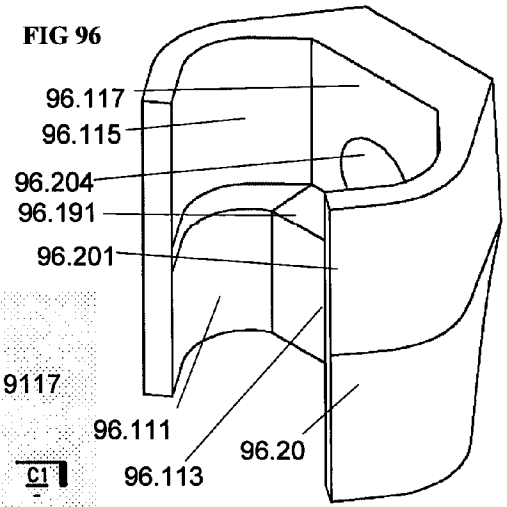
FIG. 96 illustrates a rear perspective view of the carriage of FIG. 95.
Figure 95:
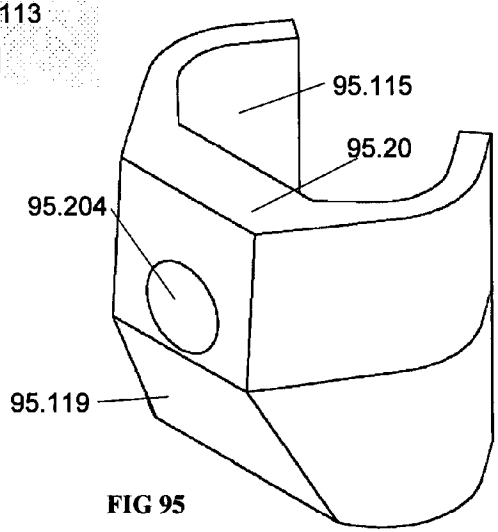
FIG. 95 illustrates a front perspective view of a carriage.
Figure 97:
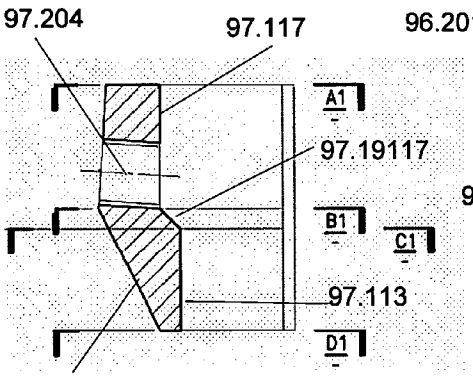
FIG. 97 illustrates a partial cross section through the carriage of FIGS. 95 and 96.

Illustrated in FIGS. 95 to 101 is a carriage 95.20. The carriage of FIGS. 95 to 101 is similar to the carriages illustrated in FIGS. 67 to 70 and 75 to 94. However there are some differences such as the carriage 95.20 has a lower portion as illustrated in FIG. 96 which has inside or inboard curved surfaces 96.111 and a forward face 96.113 to engage the flat surface of the 'Z' post as illustrated in the cross sections of FIGS. 99 to 101.

On the outboard face of the carriage 95.20 is a tapered portion 95.119 which provides for a decreased amount of material in the carriage 95.20 in order to keep production cost to a minimum.

The threaded aperture 96.204 opens into the interior space of the carriage 96.20 through a vertical face 96.117. The interior curved surfaces 96.115 on the arms 96.201 and vertical face 96.117 are respectively offset from the surface 96.113 and curved surfaces 96.111.

Figure 98:
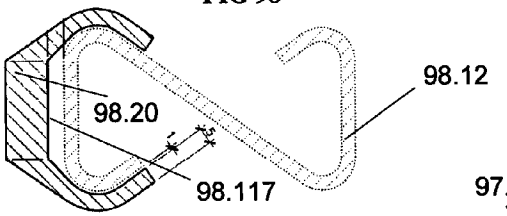
FIG. 98 illustrates a cross section of the carriage through to line A1 of FIG. 97, with the carriage assembled to a 'Z' post.
Figure 99:
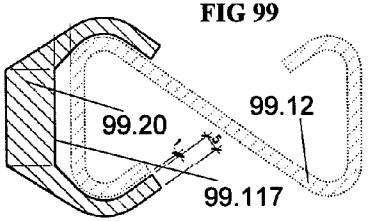
FIG. 99 illustrates a cross section of the carriage through to line B1 of FIG. 97, with the carriage assembled to a 'Z' post.
Figure 100:
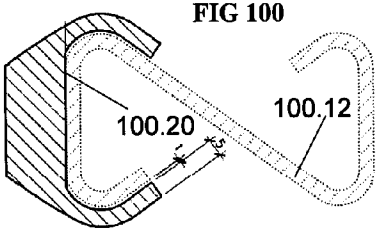
FIG. 100 illustrates a cross section of the carriage through to line C1 of FIG. 97, with the carriage assembled to a 'Z' post.
Figure 101:
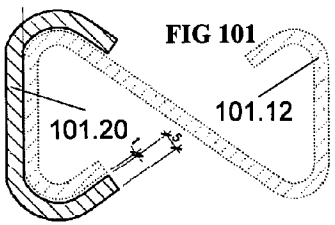
FIG. 101 illustrates a cross section of the carriage through to line D1 of FIG. 97, with the carriage assembled to a 'Z' post.

The offset nature of vertical surface 96.117 is best depicted in FIGS. 98 and 99 where there is illustrated a gap between the surface 98.117, 99.117 and the outboard face of the post 98.12 and 99.12. It can also be seen from FIGS. 98 and 99 that between the post and the carriage in the vicinity of the surfaces 96.111 has a 1 mm clearance in a similar manner to the clearance X of FIG. 9. Whereas between the surface 96.113 and the outboard face of the post 100.12 and 101.12, there is little or no clearance in an effort to generate a friction forces once motion begins. If desired, this little to no clearance can be increased to say 1 mm to minimize the friction forces generated when movement between the post and carriage occurs.

This arrangement allows for friction force to be generated at the lower portion of the carriage 95.20, by just the movement of the carriage relative to the post without the need for additional friction to be provided. As is visible from FIGS. 96 and 97, the transition between the vertical face 97.117 and forward face 97.113 is in the form of an inclined plane 97.191, 96.191.

The carriage of FIGS. 102 to 107 is very similar to that of FIGS. 95 to 101 except that the upper portion of internal surfaces 103.111 and 103.113 are not offset relative to the lower portions of these surfaces. The effect of this can be seen in the cross sections of FIGS. 105 to 107 wherein the surfaces 103.113 are shown abutting the outboard face of the post 105.12, 106.12 and 107.12, whereas the curved surfaces 102.111 are spaced by approx 1 mm from the external radii of the post on ether side of the outboard face. If desired, a 1 mm clearance can also be provided to minimize contact and avoid where possible the abutting of the surface 103.113 with the outboard face of the post.

Illustrated in FIGS. 108 and 109 are a Z-shaped post 108.12 and an open hat section post 109.12. Formed in the forward or inboard faces of these posts are punched tags 108.12.60 and 109.12.60 respectively, which are similar to those shown in FIGS. 22 and 23, to provide the lower location below which a carriage will not pass. If located above the carriage, they will provide a depressible or biased ramp against which the carriage can be pushed past and which will provide, by relative movement separation control or some control of the movement of the carriage with respect to the post. If oriented 180° to that as illustrated, and located above a carriage, they will provide a stop or detent which must be bent, or broken or hammered by the carriage and a collision force so as to clear path for the carriage to move along the post. Both of these will assist in absorbing more energy of collision, than if they were not present.

Figures 102, 103, 104, 105, 106, 107:
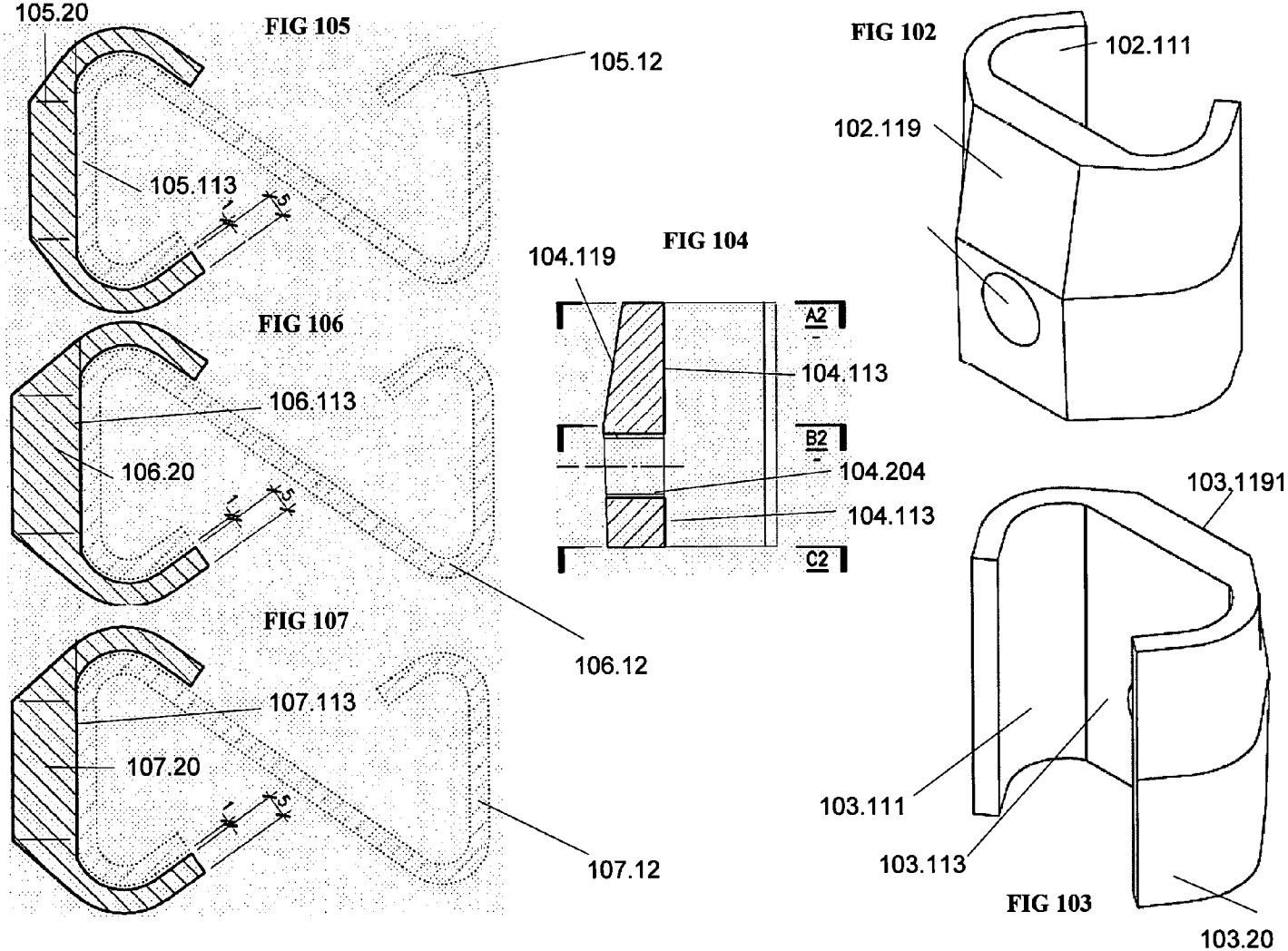
FIG. 102 illustrates another carriage perspective view.
FIG. 103 illustrates carriage of FIG. 102 in rear perspective view.
FIG. 104 illustrates a partial cross section through the carriage of FIGS. 102 *and* 103.
FIG. 105 illustrates a cross section of the carriage through to line A1 of FIG. 97, with the carriage assembled to a 'Z' post.
FIG. 106 illustrates a cross section of the carriage through to line B1 of FIG. 97, with the carriage assembled to a 'Z' post.
FIG. 107 illustrates a cross section of the carriage through to line C1 of FIG. 97, with the carriage assembled to a 'Z' post.
Figure 110:
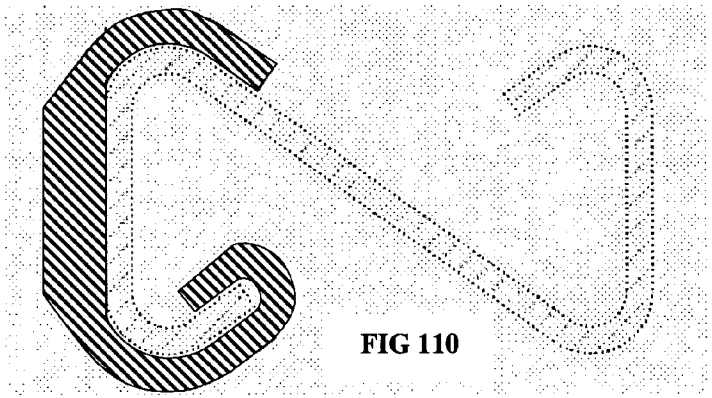
FIG. 110 is a cross section of an alternative carriage.
Figure 112:
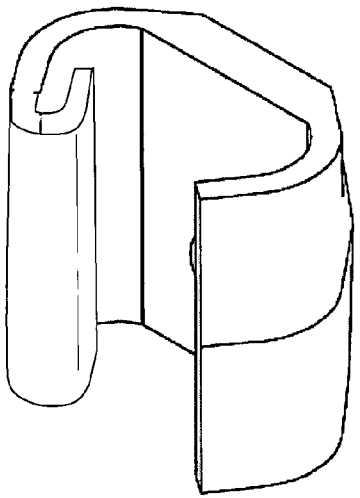
FIG. 112 is a rear perspective of the carriage of FIGS. 110 and 111.
Figure 111:
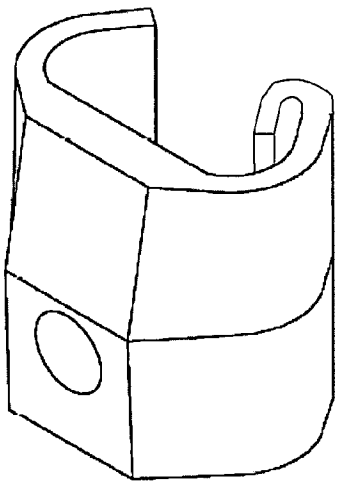
FIG. 111 is a front perspective view of the carriage of FIG. 110.

Illustrated in FIG. 110 to FIG. 112 is a modified carriage similar to that of FIGS. 102 and 103, which has a post free edge or flange envelopment, which allows for crimping, as in FIG. 10 previously, of the end of the carriage onto the flange or free edge of the post, as a means to control friction level and or separation forces.

Figure 113:
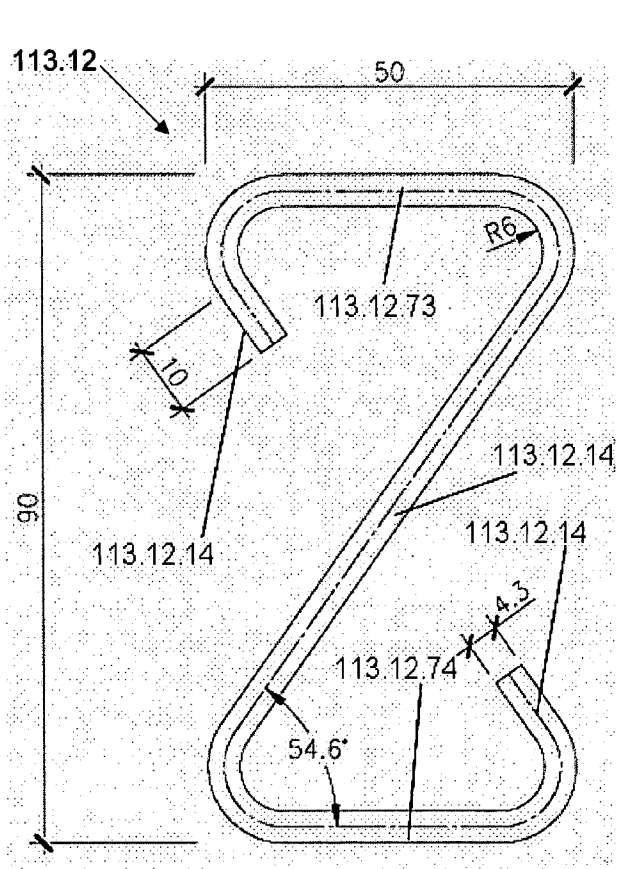
FIG. 113 is a detailed cross section of a preferred post for use with later embodiments.

Illustrated in FIG. 113 is a cross section of a Z-section post showing the preferred dimensions of the features of the cross section. Preferably the Z-post is made from roll forming or pressing, from an AS/NZS1594-HA300 steel (ASTM A 1011 SS Grade 40,45 or JISG3101 SS400 or EN10025S275JR equivalents) coil of sheeting approximately 4.3 mm in thickness. After rolling or forming the post will then be galvanized.

The Z-post of FIG. 113 has improvements over known Z-post configurations. In particular the Z-Post of FIG. 113.12 has opposed free ends or edges 113.12.14, which extend towards the middle section 113.12.75, by a distance of approx 10 mm. This provides an external friction surface for a carriage such as carriage 96.20 or 103.20, or an internal and external friction surface in the case of the carriage of FIGS. 110 to 112, along which the carriage can slide. The preferred angle between the inboard surface 113.12.73 or outboard surface 113.12.74 of the post 113.12 and the middle section 113.12.75 is approximately 54.6 degrees with a 6 mm internal radius between them. Likewise between the free end 113.12.14 and the middle section 113.12.75. This configuration also assists when the post is in use in a post and beam barrier system in that the rounded or radiused transition from mid-section to inboard surface 113.12.73 or outboard surface 113.12.74 of the post, and the rounded or radiused transition from the inboard surface 113.12.73 or outboard surface 113.12.74 of the post to the free ends or edges of the post removes sharp edges from the system which may be contacted by vehicles and road users in the event of a collision with the post 113.12. The external radii of the Z-post 113.12 are preferably of the order of 8 to 40 mm, but of the order of 15 to 25 mm is preferred.

Illustrated in FIGS. 114 to 119 is another carriage which is similar to that of FIGS. 95 to 101 with like features being like numbered. The carriage of FIGS. 114 to 119 differs from the carriage of FIGS. 95 to 101 by the external edges or corners being beveled or radiused, and the transition from face 119.117 to face 119.113 instead of being inclined, as in FIGS. 95 to 101, has an internal radius 119.132 and provides an edge 119.131 which is formed from a 90 degree corner as is illustrated in the cross section of FIG. 119. This 90 degree corner or sharp edge assists to increase the amount of friction generated when the carriage moves along the post of FIG. 113 during a collision. It will be noted that part of the inboard surface of the curved sides 118.111 of the carriage is recessed or offset from the other parts of the inboard surface of the curved sides which transition from the offset upper surface 118.117.

The carriage of FIGS. 114 to 119 is preferably made from cast steel or iron, with the cast carriage being as illustrated in FIGS. 114 to 118, with an unthreaded aperture 117.204 being formed by the casting process. Whereas, in the cross section of FIG. 119, the aperture 119.204 illustrates a threaded aperture which is produced after casting by means of a machining or threading process applied to the cast aperture 117.204.

The carriage of FIGS. 114 to 119 is most preferably cast from a spheroidal graphite iron preferably of the grade EN-GJS-400-15. By the post 113.12 and the carriage 118.20 being made of relatively ductile materials, this assists, in the event of a collision, absorption of collision energy being used to deform components, rather than result in the production of 'sharpnel', which occurs if brittle and or high strength steels or materials were used, which result in portions breaking off in the event of a collision.

While the surface 119.113 is generally parallel to the outboard face of the Z-post 113.12 before collision, it has been found that it does not remain so during a collision, and that the edge 119.131 engages the outboard face of the Z-post, and by means of an edge contact to a planar surface, rather than planar surface to planar surface, results in an increase in the amount of friction from the relatively moving components. This increase in friction results in a delayed release of the carriage 115.20 from the post 113.12, than would otherwise be the case.

In tests conducted on the carriage 115.20 used with a W-beam or rail, it was found that while the increase in friction delays the release, it is not sufficient to cause the separation of the W-beam from the carriage. The system tested also reduced disengagement of rail from posts downstream from the collision and was found to lead to softer or lower ride down acceleration of the crash test vehicle.

In the barrier system tested, no block out pieces were utilized and the height of the W-Beam above the ground was set in accord with regulation (the top edge is set at 730 mm above the ground), and the Z-posts were set at approx 2 meter centers. The Z-posts were driven straight into the ground to a depth of approximately 850 mm, while, with the W-Beam at its regulation height of approximately 730 mm above the ground, then above uppermost edge of the W-Beam there extends of the order of 20 mm of post. The equivalent height H from FIG. 16, when measured from the upper terminus of the Z-post 113.12, was of the order of 215 mm (but 200 to 220 mm could be utilized), with the carriage 115.20 being of the order of 60 mm in height, thus the amount of post above the top of the carriage is of the order of 160 mm.

The barrier system tested also did not result in any detached elements or fragments, and as posts did not fracture, but were bent, this provided a firm location for connection to the post for the purpose of extracting the bent post. Because of the features of the carriage 115.20 and the post 113.12, a barrier or guard rail system produced from these elements has a relatively simple assembly procedure. Because of this, rail connection to the post via the carriage, which carriage is not secured to the post but simply slides thereon, results in ready replication in the field when compared to testing as variations, such as post bolt torque, are eliminated.

Illustrated in FIGS. 120 and 121 is a mounting assembly 120.900, 121.900 consisting of a base plate 120.901 and welded support post 120.902. This mounting assembly 120.900 is used in those locations, such as bridges etc or concrete formations, which do not allow for the post to inserted into or pile driven into earth. The post 120.902 is arranged so as to be diagonally located on the base plate 120.901 and as can be seen a Z-post 120.12 is positioned adjacent and relative to the post 120.902 so that the inboard and outboard sides 113.12.73 and 113.12.74 are aligned or parallel to parallel edges of the base 120.901, by the Z-post middle section 113.12.75 abutting the side of the post 120.902. As can be seen from FIG. 120, the base 120.901 has four holes therethrough for mounting the base to concrete mounts by means of dyna-lock bolts, or by bolting to bridgework or other structures, where the Z-post cannot be driven into earth. The post 120.902 includes two apertures which will match up with corresponding apertures in the base of the post 120.12, so as to allow the two posts to be bolted together.

Illustrated in FIG. 122 is a generally H-section post 122.12 which, with appropriate shape changes to the carriages 20, 95.20 described above, can provide an alternative to the posts described above. The shape changes required to the carriage 95.20 for example the forming of chevron type profile 122.333 so that the carriage can engage the chevron shaped flanged end of the post 122.12. Whereas a carriage similar in profile or cross section 122.334 to that of carriage 95.20 if it were appropriately sized, will engage the post 122.12 at 90 degrees to the profile 122.333. The profiles 122.333 and 122.334 are illustrated in schematic fashion for ease of illustration.

Illustrated in FIG. 123 is a modified Y or star cross section post 123.12 having inwardly and oppositely directed termini on two flanges. A carriage such as carriage 95.20 can be used with post 123.12.

Illustrated in FIG. 124 is a modified I-beam post 124.12 which has the flanges at its free ends or edges turned towards the centre of the post in a manner similar to the Z-post 113.12 described above. A carriage 95.20 having a construction as described above can be used with the post 124.12.

In FIG. 125 is a modified T-cross section post 125.12 where the flanges of the cross bar of the T-cross section are turned inwards towards the centre of the post 125.12, in manner similar to that of post 124.12. A carriage 95.20 having a construction as described above can be used with the post 125.12.

The posts of FIGS. 122, 123, 124 and 125 are readily adapted to be made by roll forming or any other appropriate means such as pressing. The posts of FIGS. 113, 122, 123, 124 and 125 all provide a pair of opposed curved surfaces which will provide a track for use with a carriage 95.20 (with or without a shape modification to provide a matched shape to the post) when the two are assembled. Further the posts of FIGS. 113, 122 and 124 provide opposed curved surfaces on opposite sides of more than one plane passing through the centre of the post profile.

Illustrated in FIG. 126 is a roadway barrier or guard rail system having a post 126.12, a carriage 126.20 and rail 126.14 which functions in a manner similar previous embodiments. In this embodiment the carriage 126.20 is of a generally open hat profile which wraps around the outboard side of the post 126.12, with suitable clearance and secures to the rail 126.14 by means of bolts 126.30. The cross section or profile of the carriage 126.20 is preferably matched to the contacting sides or profile of the post. In FIG. 126, the carriage is restrained from moving downward by means of a bolt 126.13 or by a similar restraint such as those described above. The post 126.12 is illustrated as rectangular, as is the profile of the carriage 126.20, however any appropriate shaped post, such as those described above, could be used with an appropriately shaped carriage.

FIG. 127 illustrates a side view of a roadway barrier or guard rail system similar to that of FIG. 126, except that the restraint 127.13 is located on the inboard side of the post 127.12, and engages the lower extremity of the rail 127.14, to prevent the rail and the carriage from moving any further down the post.

FIG. 128 illustrates a side view of a roadway barrier or guard rail system similar to that of FIG. 127, except that a blocking piece 128.300 is utilized, with the blocking piece 128.300 being between the rail 128.14 and the carriage 128.20. In this instance the blocking piece is a separate piece and is sandwiched between the rail 128.14 and the carriage 128.20. However, if desired the blocking piece can be formed integrally with the carriage, and the rail attached thereto, or the blocking piece can be first attached to the carriage or the rail and then attached to the rail or carriage as the case may be.

In FIG. 128 the restraint 128.13 is located on the inboard side of the post 127.12, and engages the lower extremity of the blocking piece 128.300, to prevent the rail and the carriage from moving any further down the post. However, as in FIG. 126, the restraint can be on the outboard side of the post to engage the carriage.

The provision of restraints or abutments, such as those described with respect to FIGS. 16 to 18, 22, 23, 75, 108, 109, on the post provide an abrupt change in the post cross section by the attachment or fixture of these components, which then provides a lower most restraint to prevent the carriage form moving down past a desired location on the post. Another mechanism to create such an abrupt change in the post cross section, is to provide a post having an upper cross section which can be received into the carriage (and thereby provide a track for the carriage to move upward with respect to the post as described above) and a lower section of a different cross section along which the carriage cannot move, thereby creating a restraint to hold the carriage at a desired height on the post. Such a change in cross section can be formed in a factory by means of roll forming, or pressing, or fabrication such as welding of one section to another.

The embodiments described above can be categorized as follows:

(A) those where the post passes through the carriage, so that the post is above and below the carriage, with the carriage being free (apart from inertia and a minor amount of friction from contacting parts) to move up along the post. The carriage is prevented from moving down the post by means of a stop or restraint, which is separate from and underneath the carriage and which the carriage abuts, with the stop or restraint being located on the post. The carriage is not otherwise restrained from moving up the post except by the curved channels through the carriage which engage the extremities of the post, and the friction this may produce. For example the embodiments of FIGS. 1 to 9, FIGS. 95 to 101, FIGS. 102 to 107, each in combination with a lower restraint such as in FIG. 16 to 18, or 23 and 23 or 108 or 109;

(B) in addition to the features of (A) the provision of additional frictional or other forces such as shearing forces, by means of formations or fixtures to the post or the carriage which must be overcome after the carriage starts moving relative to the post, such as restraints or stops on the post above the carriage. For example the embodiments mentioned in (A) above where there is a lower restraint but a restraint such as additional friction is also provided as in FIGS. 12 to 15, 75 to 78, 91 to 94 or restraints similar to FIG. 108 or 109 located above the carriage on the post, and FIGS. 114 to 119 where the edge 119.131 begins to provide friction shortly after relative movement starts;

(C) the carriage is prevented from moving until sufficient force of collision is present to overcome additional frictional or other forces such as shearing forces, by means of formations or fixtures to the post or the carriage. These must be overcome before the carriage starts moving relative to the post and include fixing the carriage to the post by a bolt which passes through both. For example the embodiments where a bolt passes through the carriage to frictionally engage the post, as in FIGS. 19 to 21, 40, 84, 87 or those which clamp to the post flanges such as FIGS. 10, 45 to 47, 61 to 65, 110 to 112 or those which are secured by bolts passing through both the carriage and post such as FIG. 25 or those which have an intervening component such as FIGS. 67 to 74, 79 to 82; and (D) those where the post passes partially through the carriage, so that the post is only below the carriage, with the carriage being free (apart from inertia and a minor amount of friction from contacting parts) to move up along the post. The carriage is prevented from moving down the post by means of a stop or restraint on the carriage which engages the terminus of the post. The carriage is not otherwise restrained from moving up the post except by the curved channels through the carriage which engage the extremities of the post. For example the embodiments of FIGS. 52 to 60.

The above description in relation to the Figures also details a method of constructing a roadway barrier or guard rail system, which includes the following steps, in no particular order: inserting posts into ground in a desired position to an appropriate depth; assembling a respective carriage onto each of the posts, the carriage being free to slide relative to the post before a collision occurs, the carriage engaging at least a portion of the outer and or inner periphery of the post to enable sliding movement of the carriage relative to the post, the carriage coming to rest on the post when the carriage abuts the restraint; and securing the beam to the carriage by a securement means in such a manner that the securement means does not contact or engage the post. There can also be provided the additional step of providing a restraint on the posts at a location below the upper terminus of the post before assembly or during the assembly process, or once the carriage is at or above its desired location on the post. The carriage is also be able to move along said post after the collision occurs, with some of the above embodiments like the carriage 115.20 slowing down the movement by the introduction of additional friction from the edge 119.131, or other friction means, which delays the release of the carriage from the post.

Pile driving is one method by which the post can be inserted post into the ground, and appropriate depths would in the range of 500 mm to 900 mm, with 850 mm having been tested, as described above. A Z-post, such as that illustrated in FIG. 113 can be used. The spacing between posts can be of the order of 2 meters between centers, while the restraint can be located, below the upper terminus of the posts, preferably so as to allow 100 mm to 200 mm of post to extend above an upper edge of the carriage.

The restraint can also be located at a height down from the upper terminus of the post, so that once a beam or rail is assembled to the carriage, the top edge of the beam or rail will be at a regulation or desired height, and approximately 10 mm to 30 mm of the post protrudes above the upper edge of the beam or rail. The restraint can be installed or formed in the post at the factory if desired or installed on the site of the assembly of the barrier system.

As an example of the ways in which the order of the assembly steps can vary, a traditional assembly method could be used which would first require the posts to be installed, then the rail mounts assembled to the posts, then the beam or rail mounted to the rail mounts on the post, and splices between adjacent rail and beams being made.

However, because the carriage 115.20 is ready to slide onto the post 113.12, the carriages can be first assembled to the rails or beams, and then this sub-assembly lifted into place by engaging the carriage onto the post, and then splices between adjacent rail and beams being made.

In another assembly method, the post can be provided with a restraint of the construction similar to that of FIGS. 22, 23, 108 and 109, where the "hinge" portion (being that part which joins to the post) of the tab or restraint is located below the free end of the tab or restraint. Then, the assembler can thread the carriage, right way up, via the bottom of the post, and the post can then be pile driven into the ground, with the carriage remaining below the tab, and the ground keeping the carriage in place. Then once the post is at the desired depth, the assembler can assemble the beam or rail which is on the ground to the carriage. Once this is done the beam is on the ground but the carriage is a little way off the ground. By means of the tab having elasticity and a ramp formation, the assembler can lift the beam and thus the carriage upwards together so that the restraint or tab temporarily retracts into the cross sectional profile of the post as the carriage passes over it. Once the carriage has cleared the tab or restraint, the restraint due to its elasticity will pop back proud of the surface of the post, providing a restraint preventing the carriage from moving downwards. This lifting is readily done by a lift mechanism like a hydraulic or pneumatic jack, saving the need to assemblers to lift the mass themselves, and with the post acting as a track the lifting movement is readily guided by the interaction of the carriage and the post.

Thus the steps of the method can be performed in the following order: (a),(b),(c); or (a),(c),(b); or (b),(a),(c); or (b),(c),(a); or (c),(a),(b); or (c),(b),(a).

Another step can be added to the method: providing a restraint on the posts at a location below the upper terminus of the post prior to assembly or during assembly, or once the carriage is at or above the desired location on the post.

If it is desired to increase the amount of inertial forces for the systems described above, it will be readily understood that more mass can be provided by means of heavier rails or beams, or carriages.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A roadway barrier or guard rail system having a post and beam or rail construction wherein said beam or rail is mounted to said post by means of an intervening carriage located between said post and said beam or rail, said carriage engaging at least a portion of the outer and or inner periphery of said post to enable sliding movement of said carriage relative to said post, said post including at least one formation which prevents said carriage moving downward below a predetermined height of said post, and the carriage being free to move along the post away from the formation after assembly of the system and prior to, and in the event of, a collision.

2. A roadway barrier or guard rail system as claimed in claim 1, wherein said post can be of any appropriate cross-section including C section, Charlie post, O-post, open hat cross-section, Z-Post or section, square hollow section, round hollow section, I post or section, H shaped post or section.

3. A roadway barrier or guard rail system as claimed in claim 1, wherein engagement of said carriage with said post entails the partial or complete cross-sectional envelopment of the post by the carriage.

4. A roadway barrier or guard rail system as claimed in claim 1, wherein the engagement of the post by the carriage includes bridging of free ends or edges of said post by said carriage member.

5. A roadway barrier or guard rail system as claimed in claim 1, wherein said carriage and beam or rail will move relative to said post in predetermined conditions including forces applied during assembly or before securement or during collision.

6. A roadway barrier or guard rail system as claimed in claim 1, wherein frictional means and or detent means which release when a predetermined breaking force is achieved during a collision, is or are provided on said carriage and or said post.

7. A roadway barrier or guard rail system as claimed in claim 1, wherein the means to control the amount of force required to disconnect or allow the carriage to move relative to the post includes one or more than one of the following: securing means of the carriage relative to the post; a welded member attached to the post; a bolt through said post; a cap at the top of said post having engagement with said post; a cap and bolt at the top of said post; a frangible bolt; a bolt through said carriage to engage said post; a bolt through said carriage to engage formations on said post; a bolt through said carriage to engage a depression or recess in said post; convex formations on said post to engage said carriage; a bolt passing through said carriage and said beam or rail and said post, whether with or without the use of a nut; crimping said carriage to said post; the carriage has a shape which assists in the generation of frictional forces; the carriage includes surfaces at a lower portion of the carriage to contact said post which are offset from upper surfaces which do not contact said post prior to collision; the carriage has an angled passage through it for parts of said post to pass through; said post includes along one or more surfaces thereof formations which will engage said carriage as it moves along said post; said post includes one or more of the following to be engaged by said carriage and or a bolt associated with said carriage: ramp formations, depressible formations, biased formations; yielding formations; cantilevered formations.

8. A roadway barrier or guard rail system as claimed in claim 1, wherein the outer periphery of a hollow section post or a portion of the periphery of a post having free ends or edges is used to guide said carriage relative to said post and constrain the movement of said carriage relative to said post.

9. A roadway barrier or guard rail system as claimed in claim 1, wherein a beam or rail utilizes one or more carriages to connect to said post.

10. A roadway barrier or guard rail system as claimed in claim 1, wherein during a collision, as said carriage travels along said post a varying resistance to movement is encountered by said carriage relative to said post.

11. A roadway barrier or guard rail system as claimed in claim 1, wherein the downward movement of said carriage relative to said post is limited by detents associated with said post abutting a portion of said carriage.

12. A roadway barrier or guard rail system as claimed in claim 1, wherein said carriage includes threaded inserts or threaded portions for a bolt to engage in order that the bolt secures said beam or rail to said carriage.

13. A roadway barrier or guard rail system as claimed in claim 1, wherein multiple resistances to movement of said carriage relative to said post are located along said post.

14. A roadway barrier or guard rail system as claimed in claim 1, wherein said carriage has a longitudinal or axial channel therein to cooperate with at least a portion of the outer periphery of said post to enable sliding movement of said carriage relative to said post in the event of a collision.

15. A roadway barrier or guard rail system as claimed in claim 14, wherein said carriage has a landing formation or an offset mounting surface through which a mounting aperture passes, said landing formation or an offset mounting surface spacing an edge of said beam or rail away from one or both of said post or a post side of said carriage.

16. A roadway barrier or guard rail system as claimed in claim 1, wherein said post includes two opposed convex curved surfaces on at least an upper portion of said post, and said carriage includes two opposed concave curved surfaces to receive said curved surfaces of said post.

17. A roadway barrier or guard rail system as claimed in claim 1, wherein said post includes a pair of opposed surfaces extending along at least an upper portion of said post, to serve a track function for a carriage to which a beam or rail can be assembled, to enable said carriage to slide along said post.

18. A roadway barrier or guard rail system as claimed in claim 17, wherein said pair of opposed surfaces are curved and are formed by two opposed flanges.

19. A roadway barrier or guard rail system as claimed in claim 18, wherein said flanges include free ends or edges, and wherein the free ends or edges of the post angle toward a mid-section of the post.

20. A roadway barrier or guard rail system as claimed claim 1, wherein said carriage includes engagement means to engage at least a portion of the outer and or inner periphery of said post to enable sliding movement of said carriage relative to said post.

21. A roadway barrier or guard rail system as claimed in claim 1, wherein a channel or aperture of said carriage which receives said post, are sized to provide enough space to allow a longitudinal axis of the carriage to be at an angle to the longitudinal axis of said post, which will determine an angle which the beam or rail will be oriented relative to the post.

22. A roadway barrier or guard rail system as claimed in claim 21, wherein said beam or rail is oriented so that its upper regions are closer to the roadway than its lower regions.

23. A roadway barrier or guard rail system as claimed in claim 1, wherein said carriage includes inboard upper and lower portions, wherein said upper and lower portions are offset from each other.

24. A roadway barrier or guard rail system as claimed in claim 1, wherein said carriage includes inboard upper and lower portions, and said lower portion is offset from said upper portion so as to make contact in use with said post.

25. A roadway barrier or guard rail system as claimed in claim 24, wherein between said upper and lower portion is one or more of the following: an edge and a 90 degree corner.

26. A roadway barrier or guardrail system as claimed in claim 1, wherein said carriage is formed as a cap to sit atop of a post, and is free for movement up along the post in the event of a collision.

27. A roadway barrier or guard rail system as claimed in claim 1, wherein said carriage has a series or an array of mounting apertures therein along the height or length dimension.

28. A roadway barrier or guard rail system as claimed in claim 1, wherein said carriage is associated with, or is a part of, or cooperates with, a blocking piece to offset said rail from said post.

29. A roadway barrier or guard rail system as claimed in claim 1, wherein after said carriage has moved relative to said post, one formation or more than one formation on said post is or are engaged by said carriage and or a bolt associated with said carriage.

30. A roadway barrier or guard rail system as claimed in claim 1, wherein the predetermined height is above the higher of a bottom end of said post and a ground in which said post is inserted.

31. A roadway barrier or guard rail system having a post and beam or rail construction wherein said beam or rail is mounted to said post by means of an intervening carriage, said carriage engaging at least a portion of the outer and or inner periphery of said post to enable sliding movement of said carriage relative to said post, said post includes at least one formation which engages a bolt mounting said rail or beam to said carriage with said bolt contacting said formation but not passing through said post, whereby said formation and said bolt preventing a downward movement of said carriage below a predetermined height, and said carriage being able to slide along said post away from said formation, after assembly of the system, prior to the event of a collision and in the event of a collision.

32. A roadway barrier or guard rail system having a post and beam or rail construction wherein said beam or rail is mounted to said post by means of an intervening carriage, said carriage engaging at least a portion of the outer and or inner periphery of said post to enable sliding movement of said carriage relative to said post, said carriage not being secured to said post and thereby not preventing upward movement along said post after assembly of the system, prior to the event of the collision and in the event of the collision, said post including at least one formation which engages said carriage to prevent a downward movement of said carriage below a predetermined height that is above the higher of a bottom end of said post and a ground in which said post is inserted.

* * * * *